US012781353B2

(12) United States Patent
Lichtenberger et al.

(10) Patent No.: US 12,781,353 B2
(45) **Date of Patent: *Nov. 3, 2026**

(54) METALLOPOLYMERS FOR CATALYTIC GENERATION OF HYDROGEN

(71) Applicant: ARIZONA BOARD OF REGENTS ON BEHALF OF THE UNIVERSITY OF ARIZONA, Tucson, AZ (US)

(72) Inventors: Dennis Lichtenberger, Tucson, AZ (US); Dong-Chul Pyun, Tucson, AZ (US); Richard S. Glass, Tucson, AZ (US); Arthur Gibson, Tucson, AZ (US); Addison Coen, Tucson, AZ (US); Mary Salyards, Tucson, AZ (US)

(73) Assignee: ARIZONA BOARD OF REGENTS ON BEHALF OF THE UNIVERSITY OF ARIZONA, Tucson, AZ (US)

( * ) Notice: Subject to any disclaimer, the term of this patent is extended or adjusted under 35 U.S.C. 154(b) by 677 days.

This patent is subject to a terminal disclaimer.

(21) Appl. No.: 18/315,433

(22) Filed: May 10, 2023

(65) Prior Publication Data

US 2023/0383421 A1 Nov. 30, 2023

Related U.S. Application Data

(63) Continuation-in-part of application No. 16/466,571, filed as application No. PCT/US17/65632 on Dec. 11,
(Continued)

(51) Int. Cl.
*C25B 1/04* (2021.01)
*C25B 1/50* (2021.01)
(Continued)

(52) U.S. Cl.
CPC ..... *C25B 1/04* (2013.01); *C25B 1/50* (2021.01); *C25B 9/19* (2021.01); *C25B 11/048* (2021.01); *C25B 11/085* (2021.01); *C25B 15/083* (2021.01)

(58) Field of Classification Search
None
See application file for complete search history.

(56) References Cited

U.S. PATENT DOCUMENTS 5,279,910 A 1/1994 Sasaki et al.
5,334,292 A 8/1994 Rajeshwar et al.
(Continued)

FOREIGN PATENT DOCUMENTS

CN 107175106 A 9/2017
WO WO2013023216 A1 2/2013
WO 2018107169 A1 6/2018

OTHER PUBLICATIONS

Zamader, A. et al "Electrode Integration of Synthetic Hydrogenase as Bioinspired and Noble Metal-Free Cathodes for Hydrogen Evolution" ACS Catalysis, 2023, 13, 1246-1256. (Year: 2023).*
(Continued)

*Primary Examiner* — Brian W Cohen
(74) *Attorney, Agent, or Firm* — NGUYEN TARBET IP LAW

(57) ABSTRACT

Metallopolymers composed of polymers and catalytically active diiron-disulfide ([2Fe-2S]) complexes. [FeFe]-hydrogenase mimics have been synthesized and used to initiate polymerization of various monomers to generate metallopolymers containing active [2Fe-2S] sites which serve as catalysts for a hydrogen evolution reaction (HER). Vinylic monomers with polar groups provided water solubility relevant for large scale hydrogen production, leveraging the supramolecular architecture to improve catalysis. Metallopolymeric electrocatalysts displayed high turnover fre-
(Continued)

quency and low overpotential in aqueous media as well as aerobic stability. Metallopolymeric photocatalysts incorporated P3HT ligands to serve as a photosensitizer to promote photoinduced electron transfer to the active complex.

17 Claims, 31 Drawing Sheets

Related U.S. Application Data

2017, now Pat. No. 11,649,548, application No. 18/315,433, filed on May 10, 2023 is a continuation-in-part of application No. 16/771,597, filed as application No. PCT/US18/64936 on Dec. 11, 2018, now Pat. No. 11,846,032.

(60) Provisional application No. 62/431,964, filed on Dec. 9, 2016, provisional application No. 62/597,242, filed on Dec. 11, 2017.

(51) Int. Cl.

| | |
|---|---|
| ***C25B 9/19*** | (2021.01) |
| ***C25B 11/048*** | (2021.01) |
| ***C25B 11/085*** | (2021.01) |
| ***C25B 15/08*** | (2006.01) |

(56) References Cited

U.S. PATENT DOCUMENTS

| | | | | |
|---|---|---|---|---|
| 6,262,212 | B1 | 7/2001 | Yeung et al. | |
| 2005/0164297 | A1 | 7/2005 | Chen et al. | |
| 2008/0014487 | A1 | 1/2008 | Highgate et al. | |
| 2009/0020734 | A1 | 1/2009 | Jang et al. | |
| 2014/0318979 | A1 | 10/2014 | Cronin et al. | |
| 2015/0203638 | A1 | 7/2015 | Sivanandan et al. | |
| 2015/0275379 | A1 | 10/2015 | Nakamura et al. | |
| 2017/0121831 | A1 | 5/2017 | Kaczur et al. | |
| 2019/0345618 | A1* | 11/2019 | Pyun | C01B 3/02 |
| 2020/0299848 | A1* | 9/2020 | Lichtenberger | C25B 9/17 |
| 2022/0064807 | A1* | 3/2022 | Lewis | C25B 9/15 |

OTHER PUBLICATIONS

Zamader, "Electrode Integration of Synthetic Hydrogenase as Bioinspired and Noble Metal-Free Cathodes for Hydrogen Evolution" Supplemental Information, p. S1-S47. (Year: 2023).*

Seidel et al. Synthesis and characterization of [FeFe]-hydrogenase mimics appended with a 2-phyenylazopyridine ligand, Journal of Sulfur Chemistry, 2013, 567-579, vol. 34, No. 6, Taylor & Francis, Tucson, Arizona, USA.

Swenson, Matthew. "Synthesis and Characterization of [FeFe] Hydrogenase Mimics." (2013).

Green et al. "Resin-bound models of the [FeFe]-hydrogenase enzyme active site and studies of their reactivity." Dalton Transactions 22 (2009): 4344-4350.

Ibrahim et al. "Electropolymeric materials incorporating subsite structures related to iron-only hydrogenase: active ester functionalised poly (pyrroles) for covalent binding of {2Fe3S}-carbonyl/cyanide assemblies." Chemical communications 15 (2007): 1535-1537.

Wang et al. "Enable PVC plastic for a novel role: its functionalisation with diiron models of the sub-unit of [FeFe]-hydrogenase, assembly of film electrodes, and electrochemical investigations." RSC advances 1.7 (2011): 1211-1219.

Tooley, C. A., S. Pazicni, and E. B. Berda. "Toward a tunable synthetic [FeFe] hydrogenase mimic: Single-chain nanoparticles functionalized with a single diiron cluster." Polymer Chemistry 6.44 (2015): 7646-7651.

Zhan et al. "Synthesis and characterisation of polymeric materials consisting of {Fe2 (CO) 5}-unit and their relevance to the diiron sub-unit of [FeFe]-hydrogenase." Dalton Transactions 39.46 (2010): 11255-11262.

Zhu, Xinglong, Wei Zhong, and Xiaoming Liu. "Polymers functionalized with 1, 2-benzenedithiolate-bridged model compound of [FeFe]-hydrogenase: Synthesis, characterization and their catalytic activity." International Journal of Hydrogen Energy 41.32 (2016): 14068-14078.

Heine et al. "Controlled radical polymerization of styrene-based models of the active site of the [FeFe]-hydrogenase." Journal of Polymer Science Part A: Polymer Chemistry 51.10 (2013): 2171-2180.

Yu et al. "Exceptional dendrimer-based mimics of diiron hydrogenase for the photochemical production of hydrogen." Angewandte Chemie International Edition 21.52 (2013): 5631-5635.

Zhu, Diyang, Zhiyin Xiao, and Xiaoming Liu. "Introducing polyethyleneimine (PEI) into the electrospun fibrous membranes containing diiron mimics of [FeFe]-hydrogenase: Membrane electrodes and their electrocatalysis on proton reduction in aqueous media." International Journal of Hydrogen Energy 40.15 (2015): 5081-5091.

Michelin, Clement, and Norbert Hoffmann. "Photosensitization and photocatalysis—Perspectives in organic synthesis." ACS Catalysis 8.12 (2018): 12046-12055.

Eloi et al. "Metallopolymers with emerging applications." Materials today 11.4 (2008): 28-36.

Suzuki et al. "Hydrogen generation using water-insoluble polymer-boundruthenium (II) complexes." Chemical Communications 2 (1997): 227-228.

Ding et al. "Photoelectrocatalytic water splitting: significance of cocatalysts, electrolyte, and interfaces." ACS catalysis 7.1 (2017): 675-688.

Shinagawa, Tatsuya, and Kazuhiro Takanabe. "Towards versatile and sustainable hydrogen production through electrocatalytic water splitting: electrolyte engineering." ChemSusChem 10.7 (2017): 1318-1336.

Elmas et al. "Platinum terpyridine metallopolymer electrode as cost-effective replacement for bulk platinum catalysts in oxygen reduction reaction and hydrogen evolution reaction." ACS Sustainable Chemistry & Engineering 5.11 (2017): 10206-10214.

'Polypyrrole', Wikipedia. Jul. 2, 2017 (Jul. 2, 2017). p. 1 [retrieved Feb. 15, 2019 (Feb. 15, 2019) via the internet a <https:llen.wikipedia.org/wlindex.php?title=Polypyrrole&oldid=788636059>].

Li et al. "Unique Co-Catalytic Behavior of Protic Ionic Liquids as Multifunctional Electrolytes for Water Splitting." ChemElectroChem 3.2 (2016): 204-208.

* cited by examiner

100

100

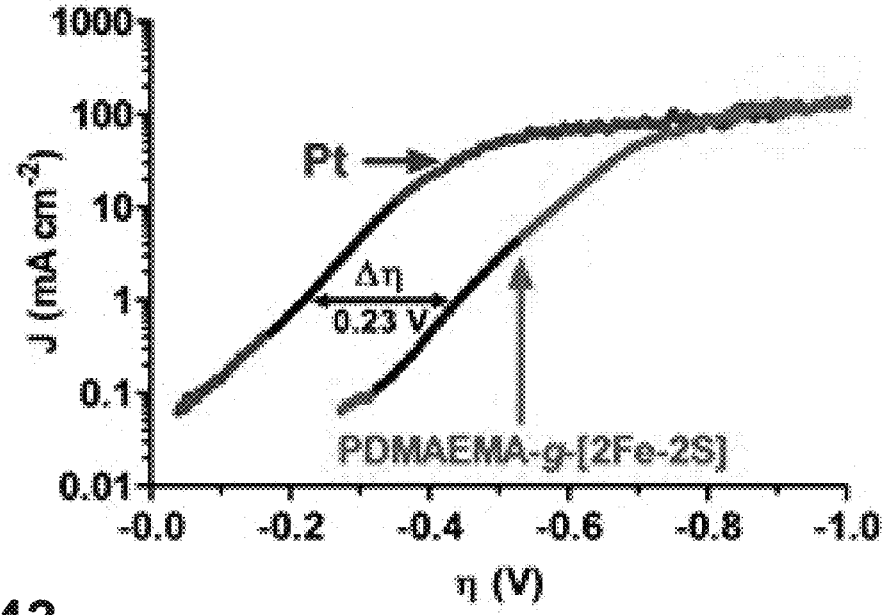
FIG. 43
FIG. 44A
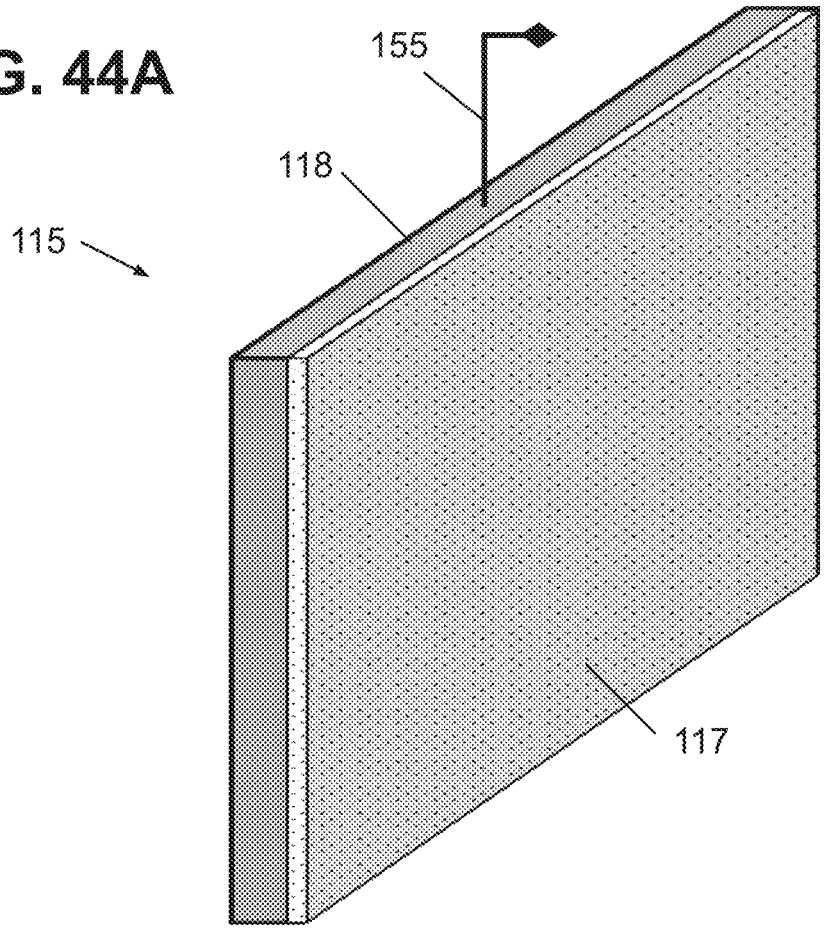

METALLOPOLYMERS FOR CATALYTIC GENERATION OF HYDROGEN

CROSS REFERENCE

This application is a continuation-in-part and claims benefit of U.S. patent application Ser. No. 16/466,571 filed Jun. 4, 2019, which is a 371 application and claims benefit of PCT Application No. PCT/US17/65632 filed Dec. 11, 2017, which claims benefit of U.S. Provisional Application No. 62/431,964, filed Dec. 9, 2016, the specifications of which are incorporated herein in their entirety by reference.

This application is a continuation-in-part and claims benefit of U.S. patent application Ser. No. 16/771,597 filed Jun. 10, 2020, which is a 371 application and claims benefit of PCT Application No. PCT/US18/64936 filed Dec. 11, 2018, which claims benefit of U.S. Provisional Application No. 62/597,242, filed Dec. 11, 2017, the specifications of which are incorporated herein in their entirety by reference.

GOVERNMENT SUPPORT

This invention was made with government support under Grant Nos. 1111570, 1111718, 1664745, and 1954641 awarded by the National Science Foundation. The government has certain rights in the invention.

FIELD OF THE INVENTION

The present invention relates to electrolyzers having cathodes comprised of metallopolymers for catalytic generation of molecular hydrogen ($H_2$), in particular, the metallopolymers comprise diiron-based complexes that are biomimetic analogues of the active sites in Fe—Fe hydrogenase enzymes.

BACKGROUND OF THE INVENTION

There has been a tremendous world-wide interest in developing clean and abundant energy sources as alternatives to fossil fuels to satisfy the rapidly growing need for energy. Development of solar voltaic cells to convert solar energy into electrical energy is very promising. However, this energy source is intermittent and electrical energy, while useful, must be used immediately or it is lost. One promising way to store this energy is in the form of chemical bonds. Particularly promising is to warehouse this energy in the strong chemical bond in molecular hydrogen ($H_2$). The development of the "$H_2$ economy", which is a proposed system based on the production, storage, and utilization of hydrogen as an energy carrier, has generated considerable interest. However, one of the key challenges in this field is the creation of efficient catalytic systems to generate $H_2$ via splitting of $H_2O$. Electrochemical splitting of water to convert it into $H_2$ and $O_2$ typically uses platinum catalysts, which are rare and expensive. Considerable inspiration has been drawn from photosynthetic processes and other biological systems for the generation of $H_2$. Promising alternatives are suggested by the hydrogenase enzymes produced by anaerobic bacteria that catalyze the reduction of protons to $H_2$ with very high rates (up to ca. $10^4$ molecules of $H_2$ per enzyme per second) with little overpotential and whose active sites contain the Earth abundant and inexpensive metals: iron and nickel. The active site 1 of [FeFe]-hydrogenase is shown below:

1

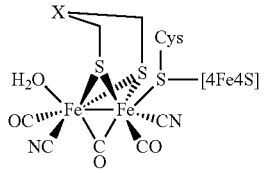

Owing to the relative simplicity of the active site 1, X═NH of this enzyme, [FeFe]-hydrogenase and [NiFe]-hydrogenase have inspired the preparation and study of small molecule mimics of these active sites as electrocatalysts for $H_2$ production. Numerous biomimetic analogues of the active site have been synthesized and studied as electrocatalysts for $H_2$ production. The active site is buried within the protein of the enzymes (FIG. 2). Electrons, e.g. from reduced methyl viologen which is a commonly used in vitro reductant (the physiological electron donors are ferredoxin and flavodoxin), are transferred to the buried active site via [4Fe4S] redox centers (one of which is shown in 1 and the entire moiety shown in 1 is known as the H-cluster). Proton and $H_2$ channels have also been proposed and convincingly established for this enzyme. The current hypothesis is that the reduced form of the enzyme is an Fe(I)-Fe(I) species and the catalytically active Fe(I)-Fe(II) yields H-Fe(II)-Fe(II) on protonation coupled with the [4Fe4S] redox center donating an electron to the distal iron. Although a p-bridged hydride is more stable than a terminal hydride, the terminal hydride is believed to be more reactive and formed kinetically.

Scheme 2 shows non-limiting examples [FeFe]-hydrogenase active site analogues.

2

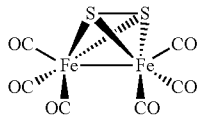

3

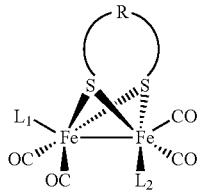

4

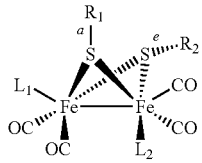

Previous reports demonstrated that disulfide 2 could be synthesized by reaction of iron pentacarbonyl, sulfur and base. For example, referring to Scheme 2, three strategies have been reported for transforming 2 into bridged 3 and unbridged 4 which are analogues of the active site of [FeFe]-hydrogenase: (1) reduction of 2 to the corresponding dithiolate followed by alkylation; (2) nucleophilic addition to sulfur of the disulfide by Grignard of lithium organometallic reagents followed by alkylation; and (3) conjugate addition of the dithiol obtained from 2 to α,β-unsaturated carbonyl compounds. In addition, reaction of thiols, dithiols or disulfides with iron carbonyl complexes also affords 3 or 4. Complexes analogous to 3 and 4 in which CO ligands have been substituted by cyanides, isocyanides, phosphines, phosphites, bis-phosphines, heterocyclic carbenes, sulfides, sulfoxides, or nitrosyl ligands have also been reported. Despite impressive advances in this area, several important challenges remain: to increase the activity and stability of the catalysts, to lower their overpotential, to use water as the solvent and proton source, to inhibit aggregation while maintaining rapid electron transfer to the active site, and to increase aerobic stability.

To overcome many of the current limitations in biomimetic [2Fe-2S] electrocatalysts, immobilization of these complexes onto heterogeneous or homogeneous supports has been widely explored. More recently, conjugation of soluble polymers to [2Fe-2S] complexes has been explored, particularly as a route to catalytic metallopolymers, where the active catalyst is incorporated into either the main chain of the polymer, or as pendant side chain groups. The synthesis of these materials has been demonstrated for a number of different systems. For example, Green et al. discloses amide coupling to TentaGel resin beads (Kayla N. Green, Jennifer L. Hess, C. M. T. and M. Y. D. Resin-bound models of the [FeFe]-hydrogenase enzyme active site and studies of their reactivity. *Dalton Trans.* 4344 (2009). doi: 10.1039/b821432h), and Ibrahim et al. teaches ester coupling to functionalized polypyrrole and thiol bridging to functionalized polypyrrole (Ibrahim, S. K., Liu, X., Tard, C. & Pickett, C. J. Electropolymeric materials incorporating subsite structures related to iron-only hydrogenase: active ester functionalised poly(pyrroles) for covalent binding of {2Fe3S}-carbonyl/cyanide assemblies. *Chem. Commun.* 1535-1537 (2007).

As another example, the use of "click" reactions with small molecule [2Fe-2S] moieties bearing alkyne components onto azide functional polyvinyl chloride has also been explored by Wang et al. (Wang, L., Xiao, Z., Ru, X. & Liu, X. Enable PVC plastic for a novel role: its functionalisation with diiron models of the subunit of [FeFe]-hydrogenase, assembly of film electrodes, and electrochemical investigations. *RSC Adv.* 1, 1211 (2011)). Moreover, Tooley et al. discloses polymer backbones prepared by controlled radical polymerization (CRP) methods, namely reversible addition-fragmentation chain transfer (RAFT) polymerization has been utilized via use of chain end modifications to unmask thiol end-groups for subsequent thiol-ene reactions to alkene/alkyne functional [2Fe-2S] complexes (Tooley, C. A., Pazicni, S. & Berda, E. B. Toward a tunable synthetic [FeFe] hydrogenase mimic: single-chain nanoparticles functionalized with a single diiron cluster. *Polym. Chem.* 6, 7646-7651 (2015)).

In addition to attaching [2Fe-2S] moieties to polymers, [2Fe-2S] small molecules with appropriate functional groups were polymerized. For instance, a [2Fe-2S] core appended with one alkyne group was polymerized with $WCl_6$-$Ph_4Sn$ to give a polyene with multiple [2Fe-2S] sites which was spin coated on an electrode, as taught in Zhan et al. (Zhan, C. et al. Synthesis and characterisation of polymeric materials consisting of {Fe2(CO)5}-unit and their relevance to the diiron sub-unit of [FeFe]-hydrogenase. *Dalton Trans.* 39, 11255 (2010)). Also, Zhu et al. discloses polymers prepared by "click" chemistry using small molecule diazides and [2Fe-2S] moieties appended with two alkynes (Zhu, X., Zhong, W. & Liu, X. Polymers functionalized with 1,2-benzenedithiolate-bridged model compound of [FeFe]-hydrogenase: Synthesis, characterization and their catalytic activity. *Int. J. Hydrogen Energy.* 41, 14068-14078 (2016)). Further still, CRP of [2Fe-2S] functional styrenics via RAFT has also been achieved and studied as an electrocatalyst for $H_2$ generation by Heine et al. (Heine, D., Pietsch, C., Schubert, U. S. & Weigand, W. Controlled radical polymerization of styrene-based models of the active site of the [FeFe]-hydrogenase. *J. Polym. Sci. Part A Polym. Chem.* 51, 2171-2180 (2013)), and Frechet-type dendrimers containing [2Fe-2S] units have been prepared but not studied as electrocatalysts for $H_2$ production in Li et al. (Li, Y. et al. Exceptional dendrimer-based mimics of diiron hydrogenase for the photochemical production of hydrogen. *Angew. Chem. Int. Ed.* 52, 5631-5635 (2013)).

While these reports demonstrate the viability of conjugated [2Fe-2S] complexes to polymeric materials to enhance catalytic performance, there remain numerous challenges to this concept, namely, homogeneity under aqueous electrocatalytic conditions and robust air stability. To date, three strategies have been explored to use [2Fe-2S] mimics in water: (1) attaching the [2Fe-2S] moiety to the electrode covalently, or modified electrode surface; (2) as a heterogeneous catalyst, by appending the [2Fe-2S] core with hydrophilic moieties; and (3) by including the [2Fe-2S] species in water soluble supramolecular complexes or micelles. Use of membrane electrodes for $H_2$ generation in water has been reviewed by Xu et al. (Xu, E. et al. [FeFe]-hydrogenase-inspired membrane electrode and its catalytic evolution of hydrogen in water. *RSC Adv.* 2, 10171-10174 (2012)) and use of polyethyleneimine membrane electrodes with [FeFe] mimics more recently reported by Zhu et al. (Zhu, D., Xiao, Z. & Liu, X. Introducing polyethyleneimine (PEI) into the electrospun fibrous membranes containing diiron mimics of [FeFe]-hydrogenase: Membrane electrodes and their electrocatalysis on proton reduction in aqueous media. *Int. J. Hydrogen Energy.* 40, 5081-5091 (2015)). Water solubility has been previously achieved with [FeFe] cores via appended sulfonates, sugars, 3,7-diacetyl-1,3,7-triaza-5-phosphabicyclo[3.3.1]nonane ligands, two cyano ligands (dianion), water soluble quantum dots, and polyacrylic acid linked [FeFe] moiety. The [FeFe] biomimetics have been incorporated into micelles and studied in water as hydrogen evolving electrocatalysts.

Development of approaches to enhance the air stability of this class of HER electrocatalytic complexes has proven to be even more challenging as notably most [FeFe]-hydrogenases and [2Fe-2S] biomimetics are deactivated by $O_2$. Recent experiments in the field suggest that neighboring amino groups mitigate this deactivation via the capturing of reduced oxygen species. In addition, use of redox hydrogels has also been shown to be effective in protecting [FeFe]-hydrogenase from $O_2$.

However, there remains a clear need for robust synthetic methods to afford new catalysts with improved catalytic performance in water with air stability. The present invention features an incorporation of a [2Fe-2S] hydrogenase biomimetic into a polymer that affords advances on all of the challenges described above.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

An objective of the present invention is to provide metallopolymer compositions as catalysts (electrocatalysts or photocatalysts) for hydrogen evolution reactions (HER). Embodiments of the invention are given in the dependent claims. Embodiments of the present invention can be freely combined with each other if they are not mutually exclusive.

Diiron-disulfide hexacarbonyl complexes ($Fe_2S_2(CO)_6$) can be selectively functionalized to afford a variety of bonding motifs that readily lend themselves to the formation of metallopolymeric materials. According to some aspects, the present invention features polymers with [2Fe-2S] moieties as HER electrocatalysts. In some embodiments, an active site mimetic is incorporated into metallopolymers via atom transfer radical polymerization (ATRP) with various vinylic monomers to provide well-defined polymers with a site-isolated complex. Without wishing to limit the invention to any theory or mechanism, by site isolating the complex during electrocatalysis, the electrocatalytic lifetimes and stabilities of these mimetic materials are greatly improved.

In one aspect, the HER electrocatalytic metallopolymers are synthesized by the functionalization of [2Fe-2S] complexes with α-haloesters to prepare metalloinitiators for ATRP. Without wishing to limit the invention to any theory or mechanism, this approach allows for diverse functionalization of [2Fe-2S] metallopolymers with well-defined polymers to tune electrocatalyst solubility and improve overall activity by variation of water-soluble, vinylic monomers. Polymers of the desired molecular weights and low molecular weight distribution were obtained using Cu(I) catalysts and active nitrogen ligands at low temperatures. IR spectroscopy was used to confirm retention of the [2Fe-2S] moiety and estimate the $Fe_2S_2(CO)_6$ concentration. Chromatography with UV-Vis detection at 400 nm confirmed covalent attachment of the [2Fe-2S] system to the polymer. Cyclic voltammetry is used to assess the rate of catalysis defined by a turnover frequency (TOF), and the thermodynamic efficiency of catalysis in terms of overpotential (η). By selecting an appropriate monomer/polymer conjugate around the [2Fe-2S]-complex, the HER electrocatalysts prepared using this methodology demonstrated excellent HER catalysis in neutral water with reduced overpotential for a homogeneous HER catalyst in water, and robust aerobic stability.

As will be described herein, the metallopolymer electrocatalysts have proven to generate $H_2$ in acetonitrile from acetic acid, and in water for the water soluble metallopolymers. In one embodiment, the water soluble metallopolymer based on 2-(dimethylamino)ethyl methacrylate (DMAEMA) appended with alkyl amine groups, at pH 7 generates $H_2$ at rates comparable to platinum under similar conditions, with a modest overpotential, shows no tendency for the catalytic site to aggregate, and exhibits unusual stability under aerobic conditions.

According to other aspects, the present invention features metallopolymeric materials comprising regioregular poly(3-hexylthiophene) (P3HT) and catalytically active diiron-disulfide complexes. These materials enable solar assisted conversion of a proton source, such as for example, thiols, sulfides, and water. The conjugated polymers, such as P3HT, serve as the photosensitizer to promote photoinduced electron transfer to activate the diiron complex which, in the presence of an appropriate proton donor, catalytically generates hydrogen ($H_2$). This coupling of a conjugated polymer to a diiron center and photocatalytic hydrogen generation with this type of diiron catalyst has not been done before.

One of the unique and inventive technical features of the present invention is the use of P3HT as an electron donor to promote a photo-induced reaction. Without wishing to limit the invention to any theory or mechanism, P3HT is likely the optimal polymeric ligand for these materials due to the development of a number of synthetic methods that allow for control of molecular weight/MWD and precise functional group placement. Furthermore, the band edge/frontier orbital energetics for P3HT ligands and $Fe_2S_2(CO)_6$ points to favorable potential gradients to promote photoinduced charge transfer. None of the presently known prior references or work has the unique inventive technical feature of the present invention.

According to some embodiments, the methods described herein utilizes small molecule complexes with unsymmetric ligand coordination via the nucleophilic attack of alkyl/aryl Grignard, or organolithium agents with diiron-disulfide hexacarbonyl ($Fe_2S_2(CO)_6$) followed by treatment of the reactive thiolate with alkyl halides as electrophiles to promote alkylation. Regioregular P3HT is used in the preparation of the metallopolymers, particularly those prepared from Grignard metathesis (GRIM) or other transition metal catalyzed variants of these methods to create P3HT with -MgX chain ends that can react with high efficiency with $Fe_2S_2(CO)_6$. Subsequently, the reactive thiolate form of the P3HT complex can be alkylated with small molecules, or polymers terminated with alkyl halides to form the targeted unsymmetric complex.

In some embodiments, the solubility and chemical environment around the diiron complex can be tuned with the differential incorporation of a second polymeric ligand to impart water solubility to these otherwise hydrophobic ligands. The incorporation of metal centers into polymeric constructs while retaining their initial catalytic activity remains challenging. However, the methods to prepare metallopolymers combining P3HT and other polymers as ligands enable the preparation of novel, metallopolymeric materials that install photocatalytically reactive metal centers. Further still, the polymeric ligands can be used to make metallopolymers to modulate properties and chemical environment around the catalyst.

In one embodiment, the polymeric ligand is a P3HT. The P3HT may be terminated with either -MgBr, or -Li end groups which can be used to ring-open the disulfide bridge in $Fe_2S_2(CO)_6$ and the resulting thiolate intermediate can be alkylated with alkyl halide terminated polymers to form unsymmetric diiron complexes with differential ligation of the Fe centers. Well-defined polymers bearing a terminal alkyl halide can be prepared using either nitroxide mediated polymerizations (NMP) or by end group modification of commercially available polyethylene oxides.

In further aspects, the present invention also investigates iron-phosphorus coordinate motifs by the preparation of phosphine terminated P3HT ligands. The salient feature of these approaches is the ability to prepare well-defined metallopolymers that maintain the photoactivity of the small molecule complexes.

According to other aspects, the present invention features an electrolyzer for generating hydrogen ($H_2$). The electrolyzer may comprise a cathode comprising the electrocatalytic metallopolymer and an electrically conductive material, an anode for the electrical circuit to the cathode, and an aqueous solution. In some embodiments, the metallopolymer may be any of the electrocatalytic metallopolymers described herein.

In some embodiments, a membrane may be disposed between the cathode and the anode to form a cathode chamber and an anode chamber. In further embodiments, the aqueous medium includes an electrolyte such as a buffer solution and/or a co-catalyst. In some embodiments, the electrolyzer is powered by an energy source that is electrically coupled to the cathode and the anode via electrode contacts. The energy source for powering the reactions may be a renewable energy source.

In some other embodiments, the present invention features a method of producing a fuel or chemical. The method may comprise providing an electrolyzer having a cathode comprising an electrocatalytic metallopolymer and an anode for the electrical circuit to the cathode, flowing one or more solutions through the electrolyzer, and applying a voltage across the anode and cathode that causes a chemical reaction that produces a plurality of products from the one or more solutions, with the fuel or chemical being one of said products. In some embodiments, the fuel is hydrogen produced by the reduction of water. In other embodiments, the fuel or chemical is a product of other types of reduction reactions.

BRIEF DESCRIPTION OF THE DRAWINGS

The features and advantages of the present invention will become apparent from a consideration of the following detailed description presented in connection with the accompanying drawings in which:

FIG. 43 shows that the metallopolymer catalyst described herein is competitive with a platinum catalyst under the same operating conditions .

FIG. 44A shows a non-limiting example of a flat cathode comprising an electrocatalytic metallopolymer described herein disposed on a surface of an electrically conductive material.

DESCRIPTION OF PREFERRED EMBODIMENTS

Figure 1:
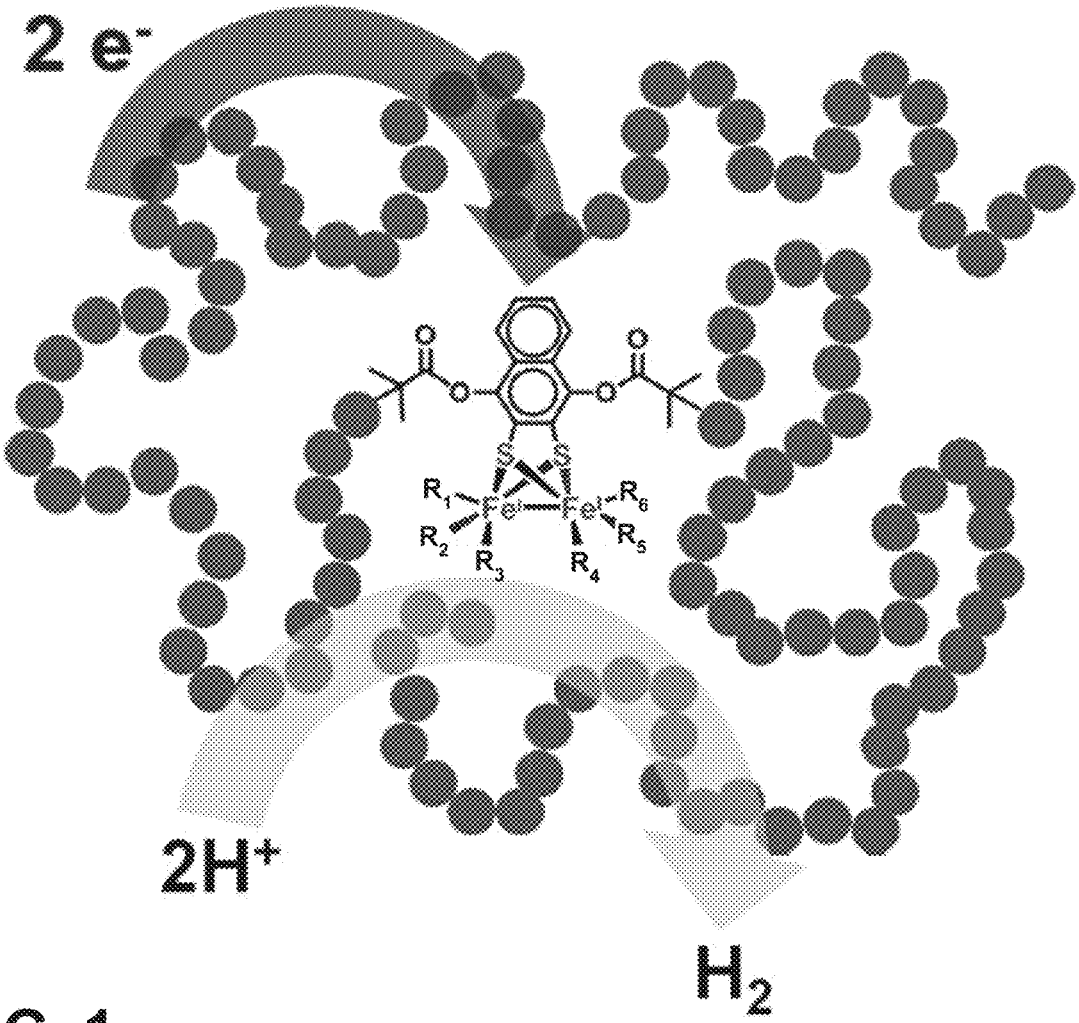
FIG. 1 shows a non-limiting embodiment of a metallopolymer catalyst of the present invention.
Figure 2:
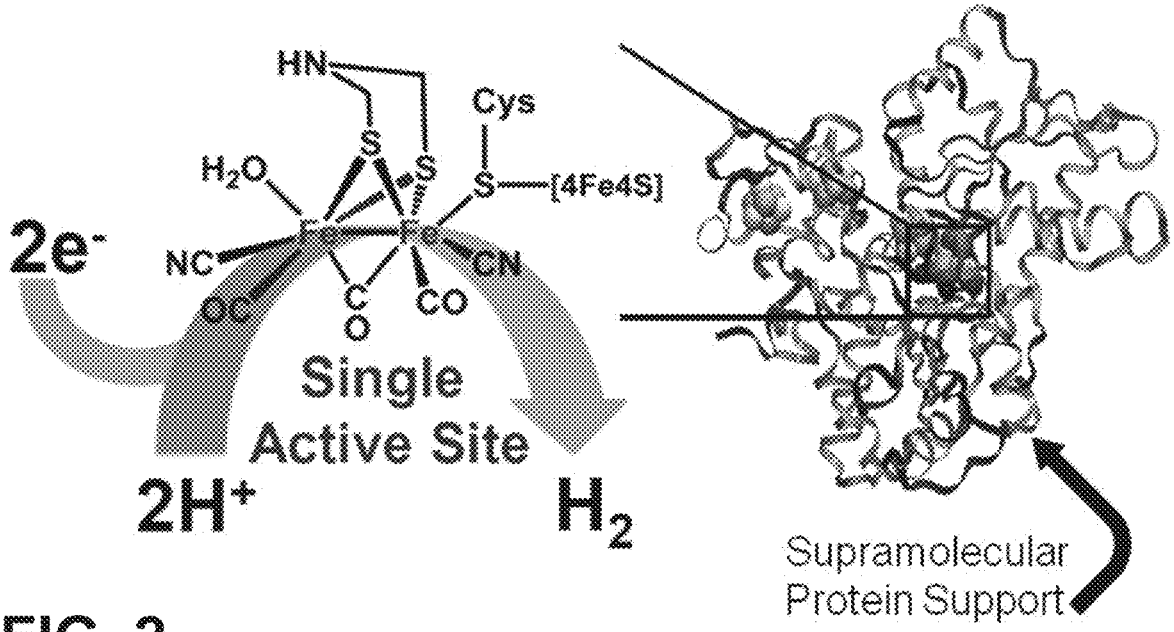
FIG. 2 shows [FeFe]-Hydrogenase, its active site and the elementary reaction for $H_2$ generation.

Following is a list of elements corresponding to a particular element referred to herein:

100 electrolyzer
110 cathode chamber
115 cathode
117 electrocatalytic metallopolymer
118 electrically conductive material
120 anode chamber
125 anode
130 aqueous solution
135 electrolyte
140 membrane
145 gasket
150 energy source
155 electrode contact
160 Flow Cell Cap
161, 163 Inlets
162, 164 Outlets As used herein, STP refers to 0° C. and 1 atmosphere (atm) pressure. Unless indicated otherwise, the volume of a gas reported herein is at STP.

Electrocatalytic Metallopolymer

As known to one of ordinary skill in the art, an atom transfer radical polymerization (ATRP) is a method of controlled radical polymerization (CRP) where an alkyl halide (e.g. R-X, X: Br or CI) is activated by a transition metal complex (e.g. cuprous halide salts with amine, or N-heterocyclic ligands, such as Cu Br with bipyridine ligands) to form an active radical that reacts with a vinyl group (i.e. monomer) and the intermittently formed radical reacts with additional monomer units for propagation to put monomers together in a piece-by-piece fashion. The ATRP method enables the creation of a wide range of polymeric materials with a controlled molecular weight and molecular weight distribution using monomers with different functionalities for specific target applications.

Referring now to FIG. 1-37, in one embodiment, the present invention features an electrocatalytic metallopolymer for generating hydrogen ($H_2$). According to some embodiments, the electrocatalytic metallopolymer may comprise an electrocatalytically active complex bonded to a polymer. For example, the metallopolymer may be according to the following: Complex-$L_1$-(Polymer)$_i$, where i may be 1 or 2.

In some embodiments, the electrocatalytically active complex contains the following [2Fe-2S] cluster:

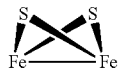

As shown in FIG. 1, in some embodiments, the [2Fe-2S] cluster has moieties $R_1$-$R_6$. In some embodiments, $R_1$, $R_2$, $R_3$, $R_4$, $R_5$, and $R_6$ may each be CO. In other embodiments, $R_1$, $R_2$, $R_3$, $R_4$, $R_5$, and $R_6$ may each be a cyanide, isocyanide, phosphine derivative, phosphite derivative, nitrosyl, alkoxide, thioalkyl, thioether, carbene, or amine.

In some embodiments, $L_1$ may be bonded to the complex. Examples of $L_1$ include, but are not limited to:

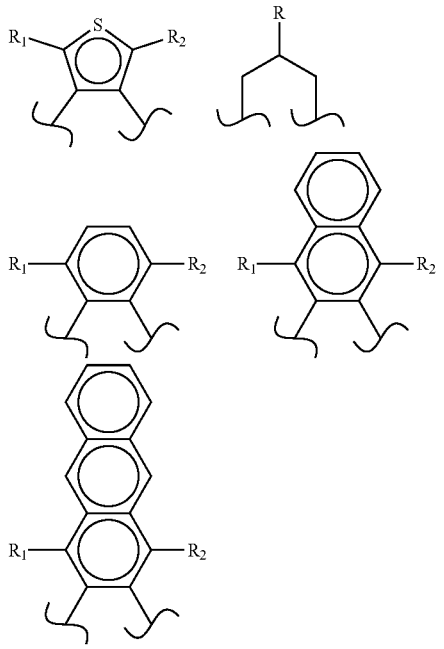

In the above examples of $L_1$, the squiggly lines represent bonding to the sulfur atoms of the [2Fe-2S] complex. In some embodiments, R is the polymer. In other embodiments, $R_1$ is the polymer. In some other embodiments, $R_2$ is the polymer.

In non-limiting embodiments, $L_1$ may be the following:

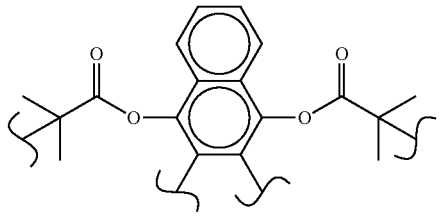

or

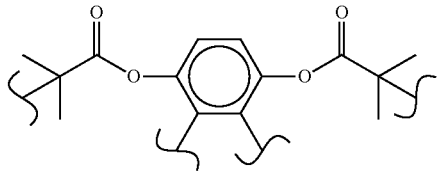

In accordance with these embodiments of $L_1$, a phenyl group of $L_1$ may be bonded to the complex. For example, the phenyl group of $L_1$ may be bonded to the disulfide group of the complex. In some embodiments, each side group of $L_1$ is bonded to the polymer. A non-limiting embodiment of the electrocatalytically active complex may be the following:

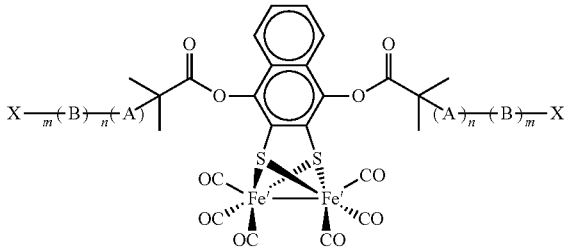

In still other embodiments, the polymer may be according to the following:

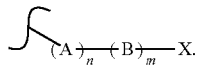

In some embodiments, X may be I, Br or Cl. In some embodiments, m and n can each range from about 1-1,000. In other embodiments, A and B may each be derived from an unsaturated monomer. In one embodiment, A may be identical to B. In an alternative embodiment, A may be different from B.

In preferred embodiments, the polymer can impart water solubility to the metallopolymer. Further still, the polymer can function to site-isolate the complex during electrocatalysis, thus improving the electrocatalytic lifetime and stability of the metallopolymer.

According to other embodiments, the electrocatalytic metallopolymer for generating hydrogen ($H_2$) may comprise a metallopolymer complex according to Formula 1:

(Formula 1)

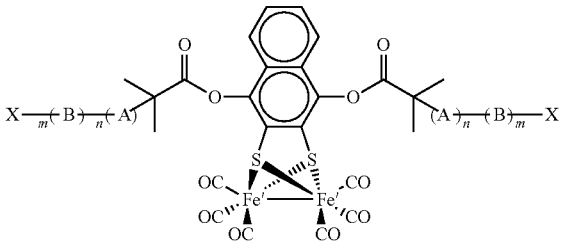

In some embodiments, X may be I, Br or Cl. In some embodiments, m and n can each range from about 1-1,000. In other embodiments, A and B may each be derived from an unsaturated monomer. In one embodiment, A may be identical to B. In an alternative embodiment, A may be different from B.

Consistent with any embodiment of the metallopolymer, the unsaturated monomer may be water-soluble. In one embodiment, the unsaturated monomer may be a vinylic monomer. In some embodiments, the vinylic monomer may be a styrenic monomer, a methacrylate monomer, an acrylate monomer, or functional analogues thereof. For example, the vinylic monomer may be methyl methacrylate, 2-(dimethylamino)ethyl methacrylate, poly(ethylene glycol) methacrylate, styrene (Sty), Sty-$SO_3Na$, or Sty-$NR_2$, where $R_2$ is H or $CH_3$.

In other embodiments, the vinylic monomer may comprise a functional water-soluble group that imparts water solubility to the metallopolymer. Non-limiting examples of the functional water-soluble group include alcohols, amines, amides, esters, carboxylic acids, sulfonic acids, ammonium groups, carboxylate groups, sulfonate groups, or ether groups. In some embodiments, the ether group may be an oligo(ethylene glycol) or a poly(ethylene glycol).

According to other embodiments, the electrocatalytic metallopolymer for generating $H_2$ may comprise a metallopolymer complex according to Formula 2:

(Formula 2)

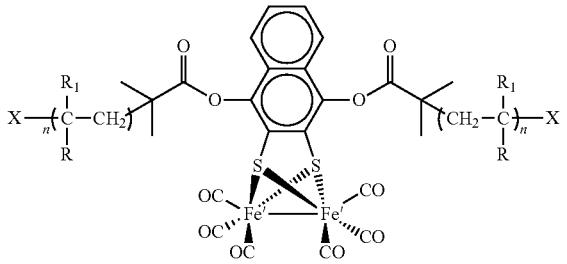

In some embodiments, X may be I, Br or Cl. In some embodiments, n can range from about 1-1,000. In other embodiments, R may be Ph, Ph-$NR_2$, Bn-$NR_2$, Ph-$SO_3Na$, $COOCH_3$, COOBn, $COO(CH_2)_2N(CH_3)_2$, $COO(CH_2)_2N(CH_2CH_3)_2$ or $COO((CH_2)_2O)_mCH_3$. In further embodiments, $R_1$ and $R_2$ may individually be H or $CH_3$. In still further embodiments, m can range from about 1-100.

Examples of the metallopolymer complex according to Formula 1 or 2 include, but are not limited to, the following:

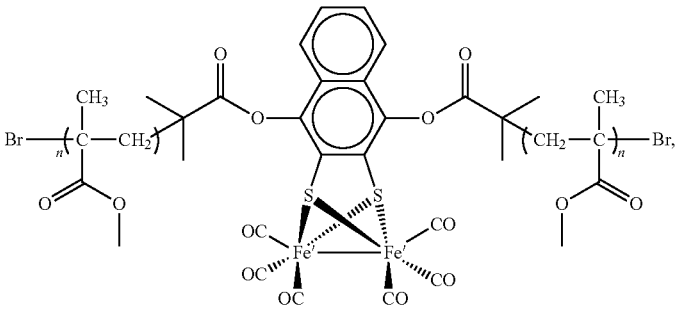

(PMMA-g-[2Fe-2S])

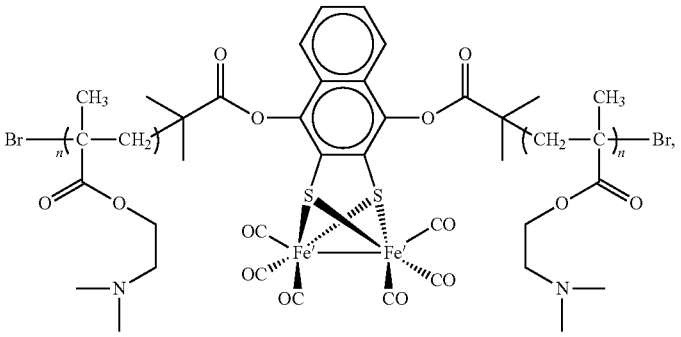

(PDMAEMA-g-[2Fe-2S])

-continued

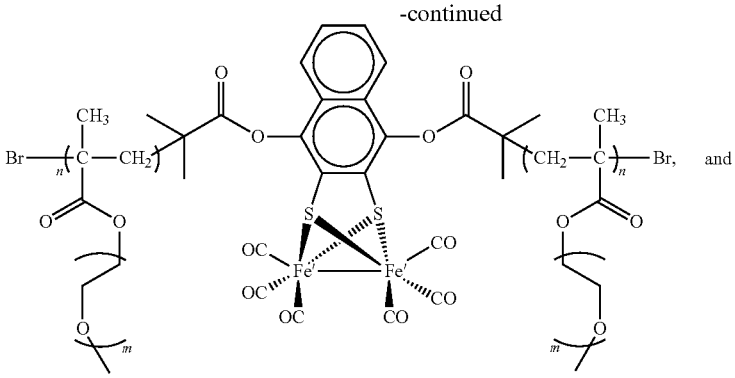

(PEGMA-g-[2Fe-2S])

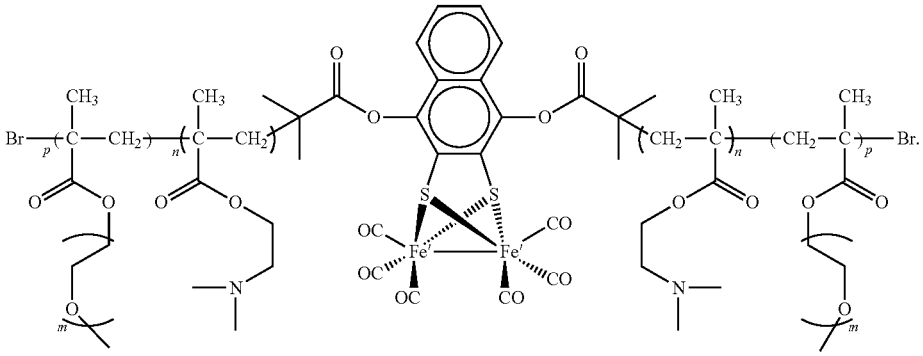

(PDMAEMA-r-PEGMA)-g-[2Fe2S] Random Copolymer)

In accordance with the aforementioned examples, m can range from about 1-100. In some embodiments, n and p can each range from about 1-1,000.

Consistent with any of the electrocatalytic metallopolymers described herein, the metallopolymer complex may be soluble in organic or aqueous solutions. In preferred embodiments, the metallopolymer complex is preferably capable of generating $H_2$ from the organic or aqueous solutions. In other preferred embodiments, the metallopolymer complex may be stable when exposed to an aerobic environment. For example, the metallopolymer complex can maintain stability when exposed to the aerobic environment, such as $O_2$ bubbles, during $H_2$ generation.

In some embodiments, the metallopolymer complex may have an $M_w$:$M_n$ ratio that is less than about 1.3. For example, the $M_w$:$M_n$ ratio can range from about 1.01 to 1.30 In other embodiments, the metallopolymer complex may have a high turnover frequency. For example, the turnover frequency may be at least about $10^3$ k($s^{-1}$) in water. In further embodiments, the metallopolymer complex may have an overpotential of at most about 700 mV in water.

Since, in one aspect, the present invention provides electrocatalytic metallopolymers for generating $H_2$, it is another objective of the present invention to provide methods for generating molecular hydrogen ($H_2$). In one embodiment, the method may comprise providing any of the electrocatalytic metallopolymers described herein, adding the electrocatalytic metallopolymer to an organic or aqueous electrolyte solution to form an electrocatalytic mixture, and performing electrolysis using the electrocatalytic mixture. Without wishing to be bound by a particular theory or mechanism, the electrocatalytic metallopolymer can accept electrons from a cathode, thereby generating a reduced form of the electrocatalytic metallopolymer, which is then protonated by some protic species in solution. Thus, the protons in the electrolyte solution are reduced to produce $H_2$. Examples of the electrolyte solution include, but are not limited to, water, tetrahydrofuran, acetonitrile, alcohol, ammonium, alkyl ammoniums, sulfonic acids, carboxylic acids, or combinations thereof.

According to other embodiments, the present invention may feature methods of producing any of the electrocatalytic metallopolymers described herein. In some embodiments, the method may comprise providing a metalloinitiator according to the following structure:

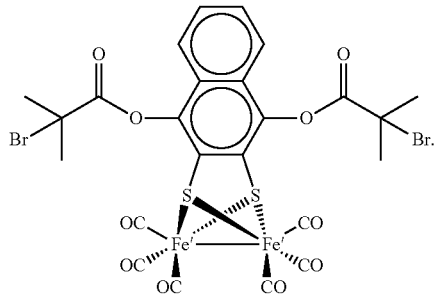

In some embodiments, the metalloinitiator is prepared by providing α-bromoisobutyryl bromide (BIBB) and a hydroquinone complex according to the following structure:

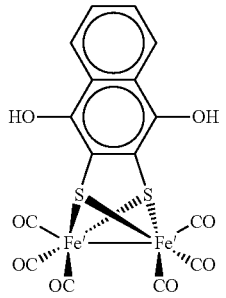

The hydroquinone complex and BIBB may be combined and mixed together so that the BIBB esterifies the hydroquinone complex to produce the metalloinitiator.

After providing a metalloinitiator, the method may further comprise providing an unsaturated monomer, providing a transition metal catalyst, providing a ligand, mixing the transition metal catalyst and ligand to form a metal-ligand catalyst, and mixing and heating the metalloinitiator, unsaturated monomer, and metal-ligand catalyst to activate an atom-transfer radical-polymerization (ATRP) reaction, thereby forming the electrocatalytic metallopolymer. In some embodiments, the transition metal catalyst may comprise a copper complex such as Cu(I)Br. In other embodiments, the ligand may be 4,4'-dinonyl-2,2'-dipyridyl, or N,N,N',N",N"-pentamethyldiethylenetriamine, or 1,1,4,7,10,10-hexamethyltriethylene-tetramine.

In preferred embodiments, the unsaturated monomer may be water-soluble. In one embodiment, the unsaturated monomer may be a vinylic monomer. In some embodiments, the vinylic monomer may be a styrenic monomer, a methacrylate monomer, an acrylate monomer, or functional analogues thereof. For example, the vinylic monomer may be methyl methacrylate, 2-(dimethylamino)ethyl methacrylate, poly (ethylene glycol) methacrylate, styrene (Sty), Sty-$SO_3Na$, or Sty-$NR_2$, where $R_2$ is H or $CH_3$.

In other embodiments, the vinylic monomer may comprise a functional water-soluble group that imparts water solubility to the metallopolymer. Non-limiting examples of the functional water-soluble group include alcohols, amines, amides, esters, carboxylic acids, sulfonic acids, ammonium groups, carboxylate groups, sulfonate groups, or ether groups. In some embodiments, the ether group may be an oligo(ethylene glycol) or a poly(ethylene glycol).

In further embodiments, the electrocatalytic metallopolymers of the present invention may be disposed or incorporated into a chromophore. Without wishing to limit the invention to a particular theory or mechanism, this incorporation of the metallopolymers into chromophores may advantageously allow for photocatalysis using said metallopolymers to generate $H_2$. For instance, the metallopolymers in the chromophores may be exposed to a light source, such as UV or visible light, which initiates the HER.

ELECTROCATALYST EXAMPLES

The following are non-limiting examples of the present invention. It is to be understood that said examples are provided for the purpose of demonstrating the present invention in practice, and is in no way intended to limit the invention. Equivalents or substitutes are within the scope of the invention.

In some embodiments, the strategy for incorporation of [2Fe-2S] complexes into polymer architectures comprises the synthesis of a difunctional ATRP initiator bearing the [2Fe-2S] moiety. A difunctional initiator allows for polymer growth from both sides of the complex, ideally giving a central active site protected from known associative reactions. With this modular approach, the synthesis of many different polymeric systems around a common [2Fe-2S] core makes it possible to tune the polymer architecture to improve catalysis via modulation of the secondary coordination sphere by including flexible R-$NMe_2$ groups.

Experimental

All synthesis and electrochemical experiments were carried out under an atmosphere of argon and using anhydrous, deoxygenated solvents and Schlenk techniques unless otherwise noted. Cyclic voltammetry experiments were performed with a Gamry Reference 3000 or Gamry Reference 1000 was used for the collection of all electrochemical data. All potentials in acetonitrile (ACN) were referenced to the Fc/Fc+ couple. Potentials in water are referenced to SHE using the standard conversion of 0.210 V vs. Ag/AgCl/3M KCl. The working electrodes (3 mm PEEK-encased glassy carbon and 1.5 mm PEEK encased Pt, BASi) were polished using a Buehler microcloth with 1.0 then 0.05 μ alumina micropolish suspended in deionized water, then briefly (ca. 10 s) sonicated in distilled water. A Pt mesh was used as the counter-electrode. A silver wire in 0.01 M $AgNO_3$ was used as a reference electrode in acetonitrile. A silver wire coated with a layer of AgCl suspended in 3.0 M KCl was used for water experiments. In both cases the reference electrode was separated from the analyte solution by a Vycor frit.

Synthesis of [2Fe-2S]-initiator [μ-2,3-(naphthalene-1,4-diyl bis(2-bromo-2-methylpropanoate) dithiolato]bistricarbonyliron (5).

Figure 3:
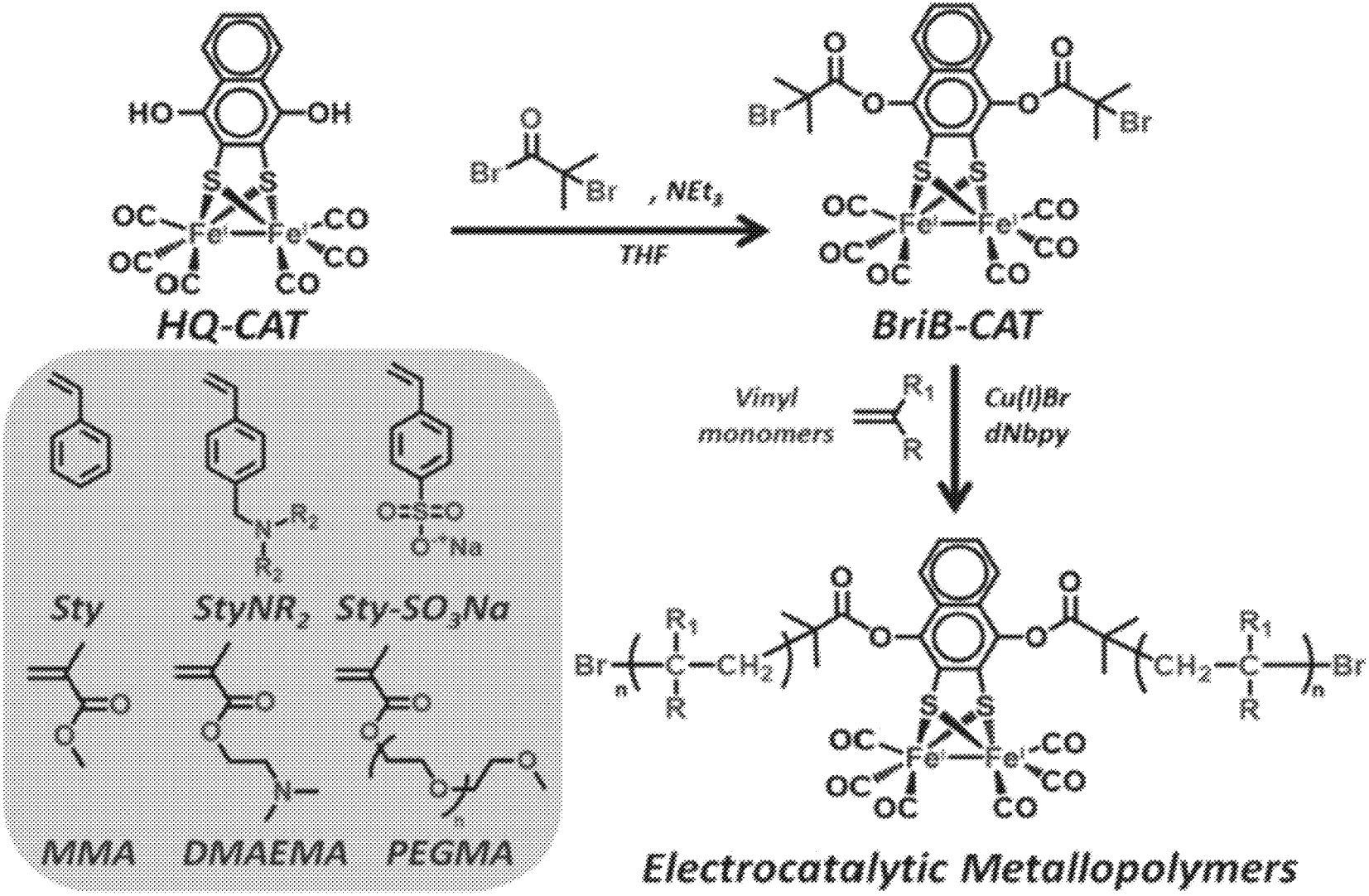
FIG. 3 shows a reaction scheme for synthesizing the metalloinitiator and the metallopolymer. Non-limiting examples of vinylic monomers to prepare the metallopolymer are also shown.

Referring to FIG. 3, metalloinitiator 5 for ATRP was prepared in three steps starting with the known complex NHQ-CAT. Sufficient $NaCNBH_3$(2.26 mg, 0.036 mmol) was added to NHQ-CAT (45 mg, 0.90 mmol) in THF (2 mL) to reduce the quinone and the solution was stirred at room temperature for 2 h. Triethylamine (TEA) (75 μL, 0.54 mmol) was then added via micro syringe and the solution was stirred for 20 minutes. α-Bromoisobutyryl bromide (BIBB) (30 μL, 0.22 mmol) was added for esterification of NHQ-CAT via micro syringe and the solution was stirred at room temperature for 2.25 h. The reaction was filtered to remove precipitate and solvent removed by rotary evaporation (23° C., ca. 200 torr) to yield a red/orange solid. Purification via column chromatography on silica gel (30% DCM in hexane) gave 63 mg of 5 (0.079 mmol, 87%) as a powdery orange solid upon removal of solvent. This solid was recrystallized via layering of toluene/MeOH to obtain crystals for electrochemical experiments and polymer synthesis. The structure of metalloinitiator 5, shown in FIG. 6, was unequivocally confirmed by single crystal X-ray crystallography. $^1$H NMR: ($CDCl_3$, 500 MHz, 298 K) δ (ppm) 7.81 (2H, dd J=6.5, 3.4 Hz) 7.49 (2H, dd J=6.5, 3.4 Hz), 2.19 (12H, s) $^{13}$C NMR:($CDCl_3$, 125 MHz, 298 K) δ (ppm) 206.8 (OC-Fe), 168.3 (C═O), 143.0 ($C_{1,4\text{-}O}$), 134.8 ($C_{2,3\text{-}S}$), 129.1 ($C_{6,7\text{-}H}$), 128.1 ($C_{9,10}$), 121.9 ($C_{5,8\text{-}H}$), 54.8 (CH—Br), 31.0 ($CH_3$) IR ($CHCl_3$, thin film on NaCl): 3688 $cm^{-1}$(w), 3619 $cm^{-1}$(w, $C_{sp2}$-H), 3154 $cm^{-1}$(w, $C_{sp2}$-H), 3019 $cm^{-1}$(vs, Csp2-H), 2976 $cm^{-1}$(w, Csp3-H), 2082 $cm^{-1}$(Fe—CO, s), 2050 $cm^{-1}$(Fe—CO, s), 2012 $cm^{-1}$(Fe—CO, s) 1760 $cm^{-1}$ (C═O ester, w), 1522 $cm^{-1}$(C═C, w), 1423 $cm^{-1}$(C—H, w), 1210 $cm^{-1}$(C—O, vs)

Synthesis of [2Fe-25] Metallopolymers via ATRP.

The growth of well-defined(co)polymers from the [2Fe-2S] metalloinitiator 5 via ATRP is a unique method among polymeric-[2Fe-2S] systems as it provides a facile method to tune the environment around the catalyst core in a single step by variation of comonomer feed and chain length of the covalently tethered macromolecules without post-polymerization modification. The synthesis of metallopolymers was initially investigated by the ATRP of methyl methacrylate (MMA) to confirm the chemical tolerance of the [2Fe-2S] complex to polymerization conditions and facilitate characterization of metallopolymers using conventional polymer solution characterization in non-polar media.

Figure 4:
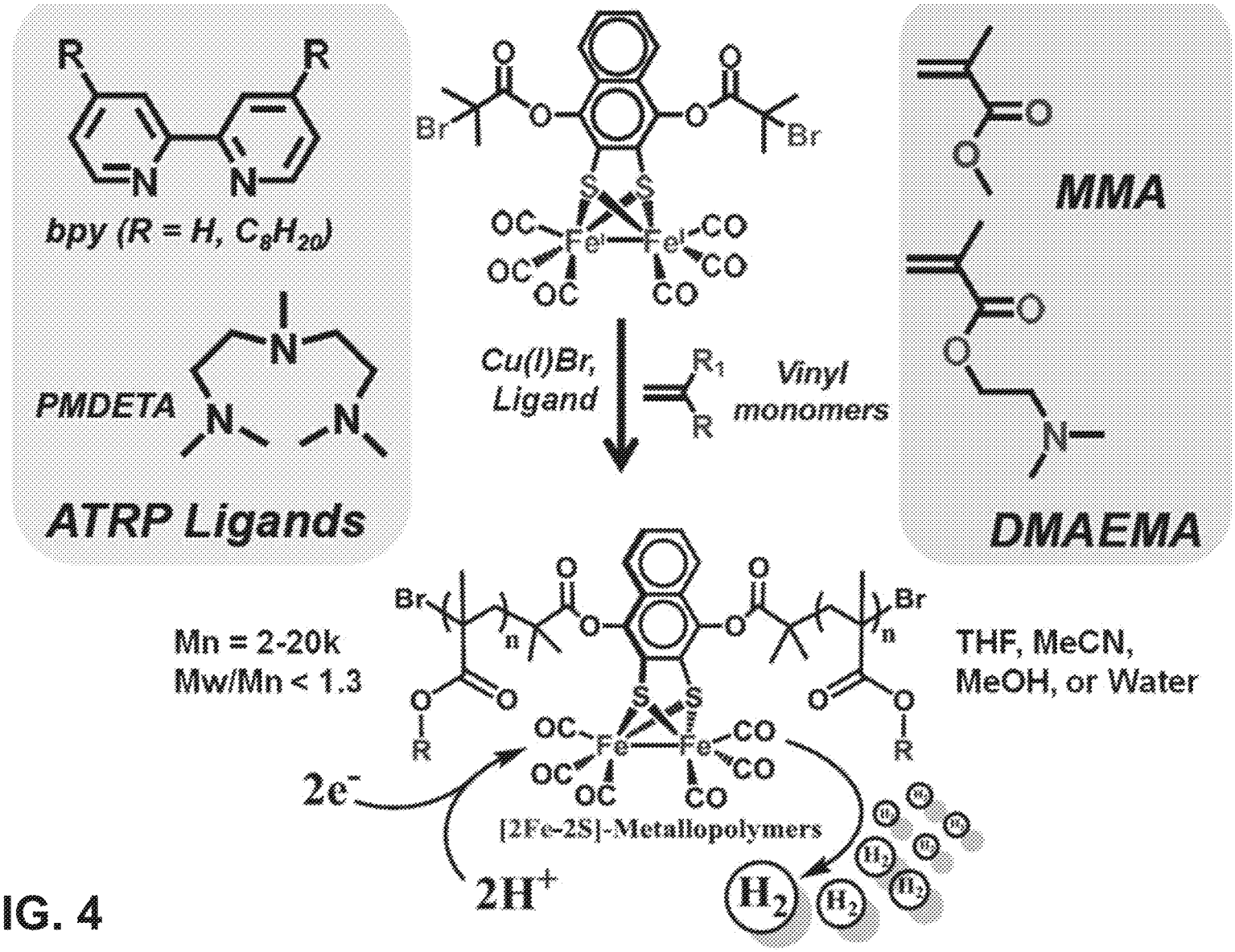
FIG. 4 shows a reaction scheme for synthesizing the metallopolymer via ATRP. Non-limiting examples of ATRP ligands and vinylic monomers to prepare the metallopolymer are also shown.
Figure 5:
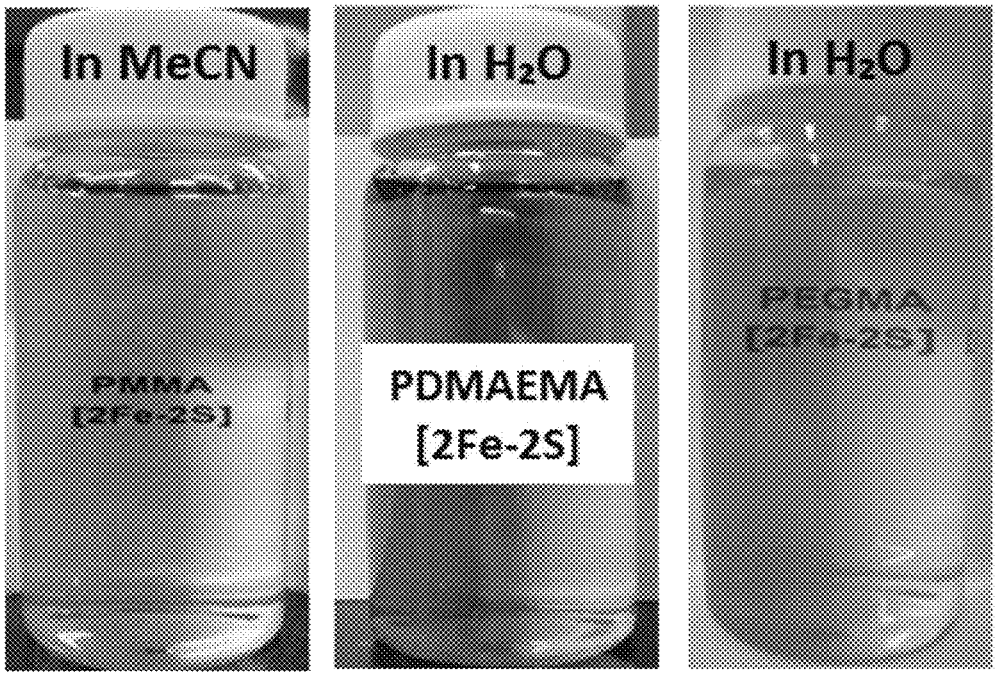
FIG. 5 shows homogeneous methacrylate-based, polymer-supported electrocatalysts, PMMA-g-[2Fe-2S] in organic media, PDMAEMA-g-[2Fe-2S] and PEGMA-g-[2Fe-2S] in aqueous media.
Figure 6:
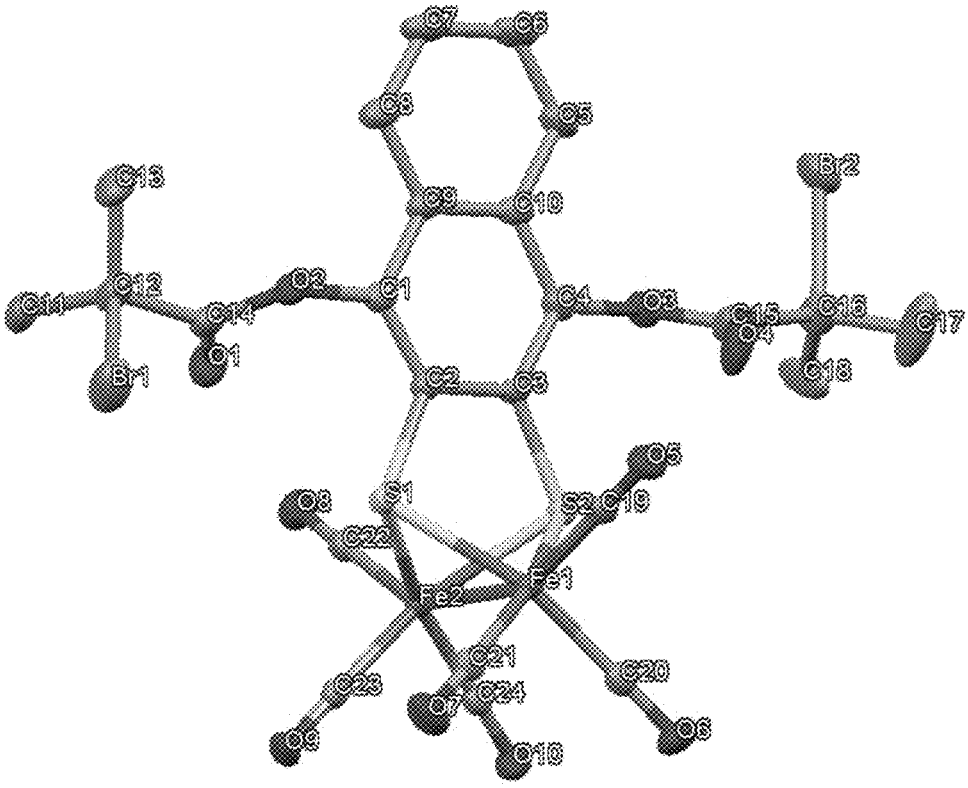
FIG. 6 shows an ORTEP diagram of the initiator with hydrogen atoms omitted and thermal ellipsoids shown at 50% probability level.
Figure 7:
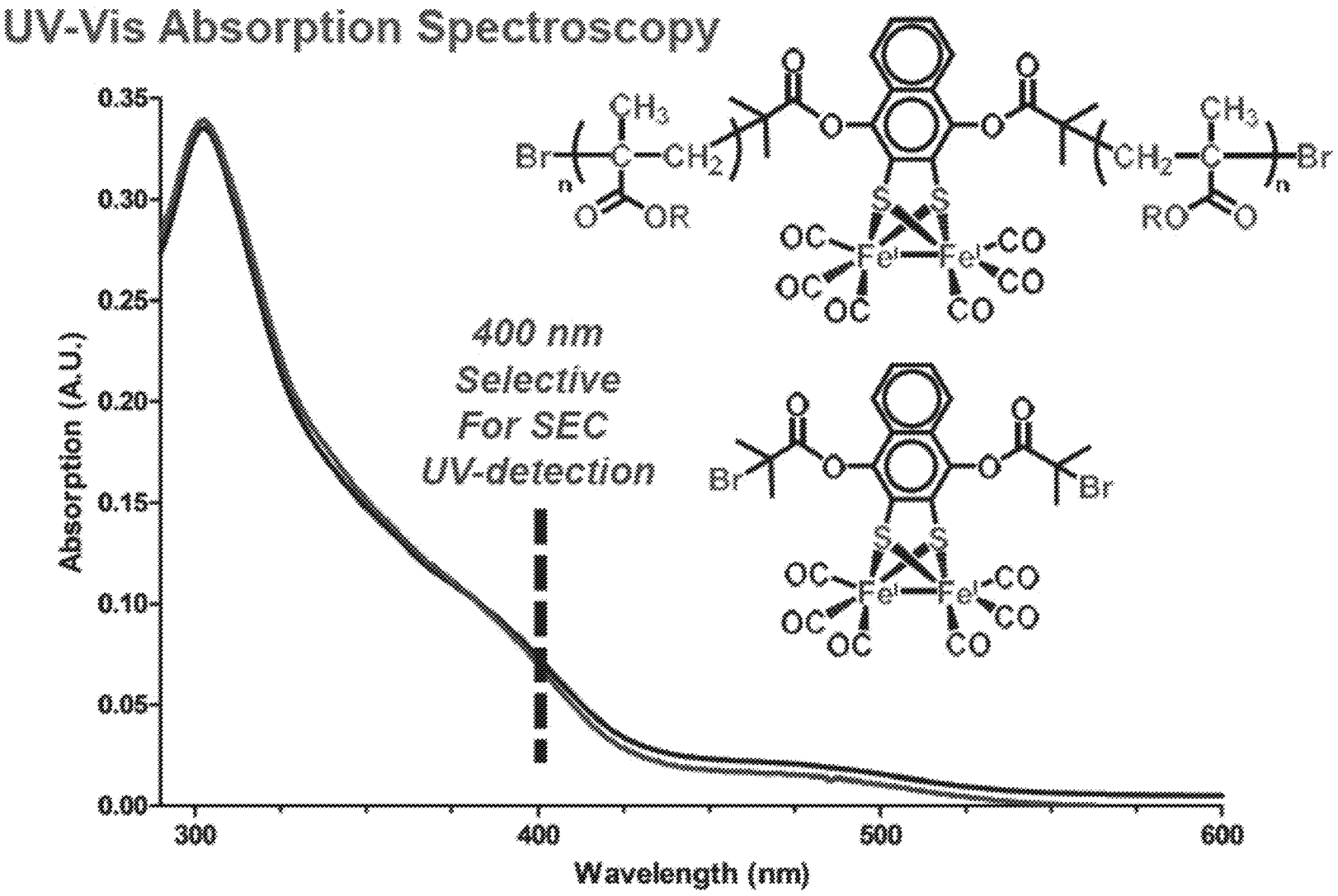
FIG. 7 shows UV-Vis absorption spectra of the ATRP metalloinitiator and a PMMA-g-[2Fe-2S] metallopolymer in toluene. The PMMA-g-[2Fe-2S] metallopolymer was made using the ATRP metalloinitiator.

PMMA-g-[2Fe-2S] metallopolymers: Referring to FIG. 4, PMMA metallopolymers (PMMA-g-[2Fe-2S]) were prepared using metalloinitiator 5 as a difunctional ATRP initiator with a copper (I) bromide (Cu(I)Br)/4,4'-Dinonyl-2,2'-dipyridyl (dNbpy) catalyst system at 55° C. Molar masses of ca. 10,000 g/mol (i.e., 5,000 g/mol per each initiator site) were targeted to enable sufficient site isolation of the iron complex, while still being amenable to size exclusion chromatography (SEC) and NMR spectroscopy end-group analysis for molecular weight characterization.

Figure 14:
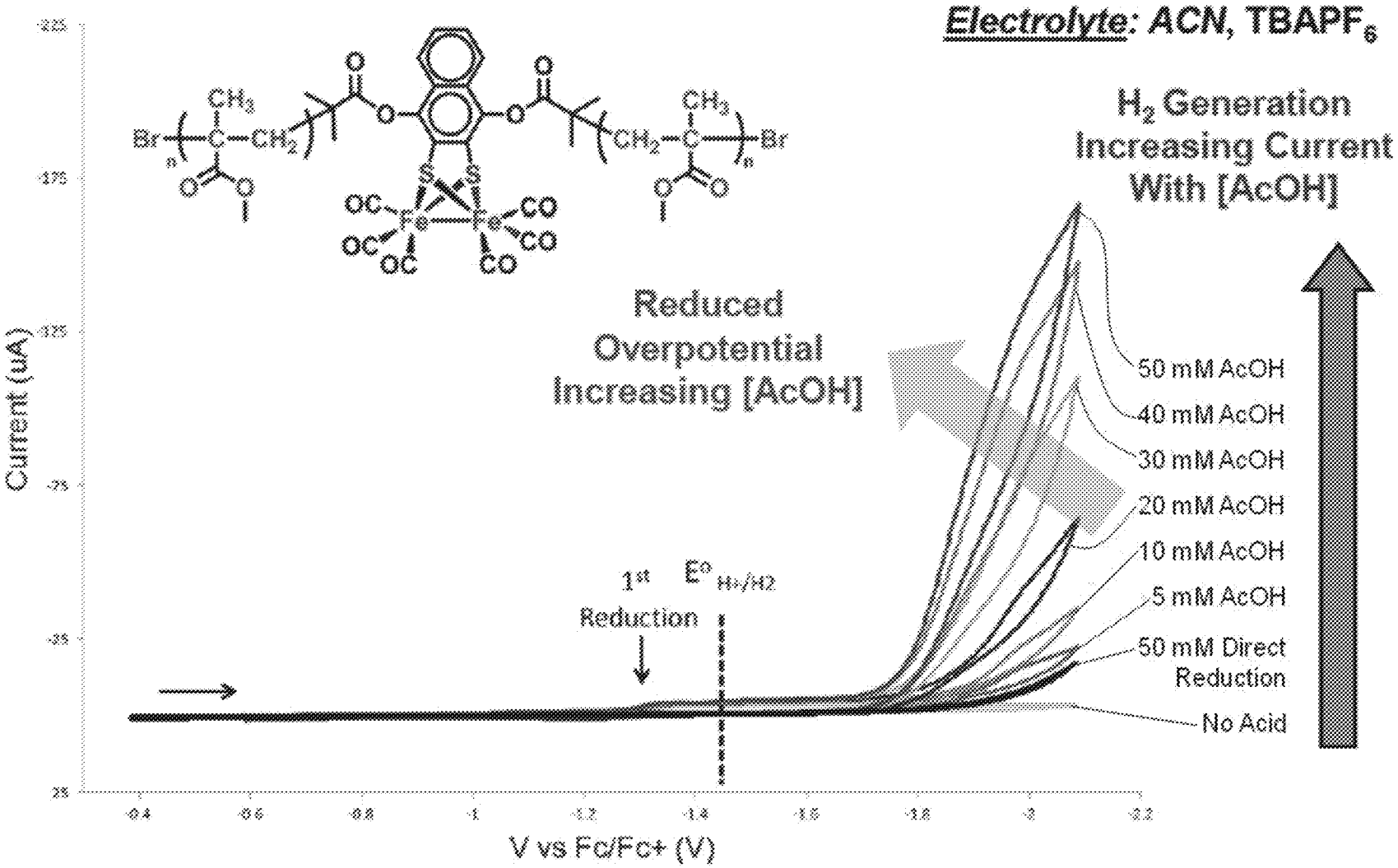
FIG. 14 shows CV electrocatalysis of PMMA-g-[2Fe-2S] with increasing [AcOH] in acetonitrile.
Figure 15:
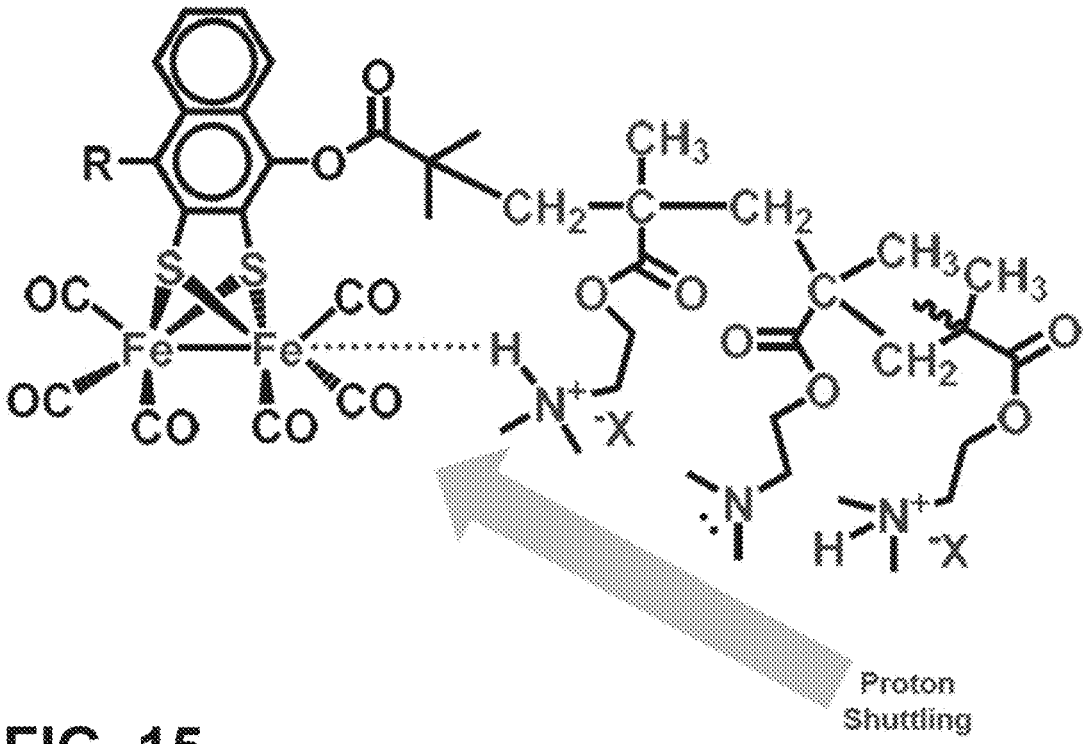
FIG. 15 shows an exemplary scheme of proton shuttling in PDMAEMA-g-[2Fe2S]. The amines in PDMAEMA are partially protonated at neutral pH which may facilitate proton transport and form an H-bond to the Fe—Fe center.

The successful formation of well-defined PMMA-g-[2Fe-2S] metallopolymers ($M_{n,SEC}$=11,982 g/mol; $M_w/M_n$=1.10) was confirmed using a combination of IR spectroscopy of the characteristic Fe—CO stretching frequencies (FIG. 10) along with size exclusion chromatography (SEC) in tetrahydrofuran (THF) coupled with UV-vis detection (at 400 nm) (FIG. 9A) and end-group analysis using $^1$H NMR spectroscopy (not shown). Furthermore, PMMA-g-[2Fe-2S] metallopolymers were found to be electrocatalytic active for HER in acetonitrile in the presence of AcOH (FIG. 14).

Figure 9A:
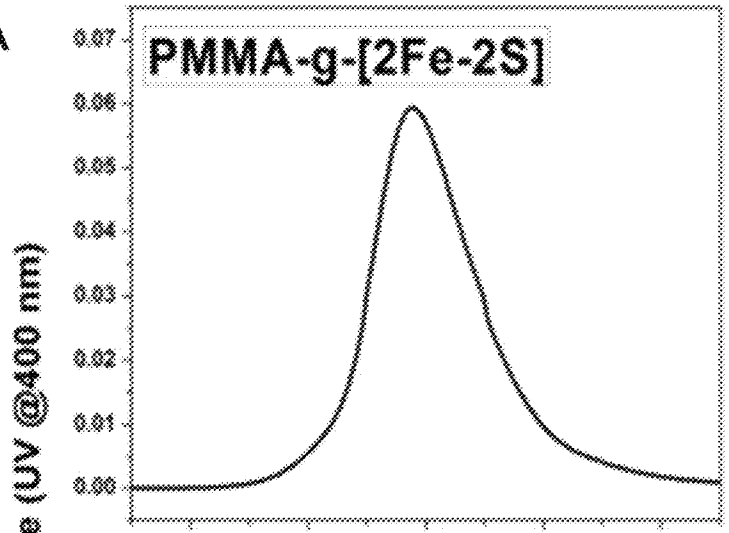
FIGS. 9A and 9B show GPC data for PMMA-g-[2Fe-2S] (Mn=7,194 g/mol, Mw/Mn=1.06) and PDMAEMA-g-[2Fe-2S] (Mn=9,500 g/mol, Mw/Mn=1.33), respectively, with a UV-Vis detector operating at 400 nm, which is characteristic of the initiator, but not for PMMA or PDMEAMA polymers.
Figure 9B:
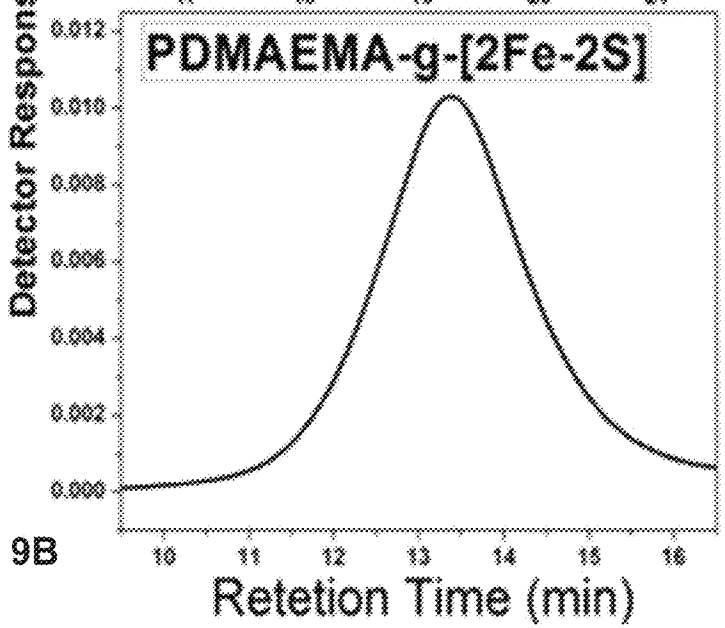
Figure 8:
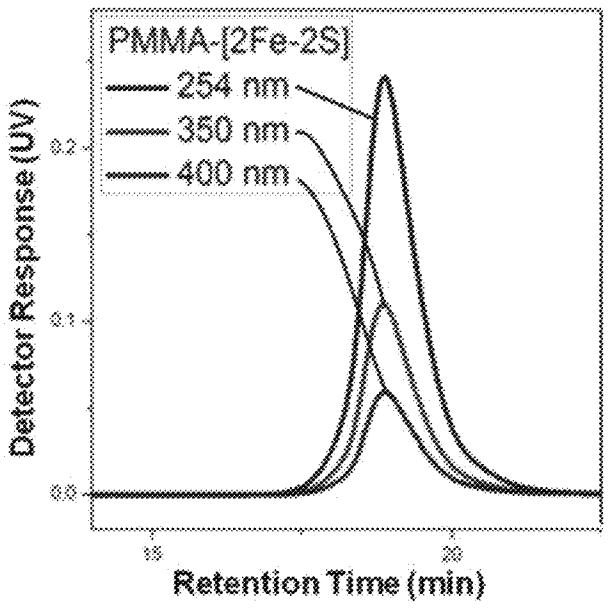
FIG. 8 shows GPC data of PMMA-g-[2Fe-2S] with a UV-Vis detector operating at 254 nm, 350 nm, or 400 nm.
Figure 10:
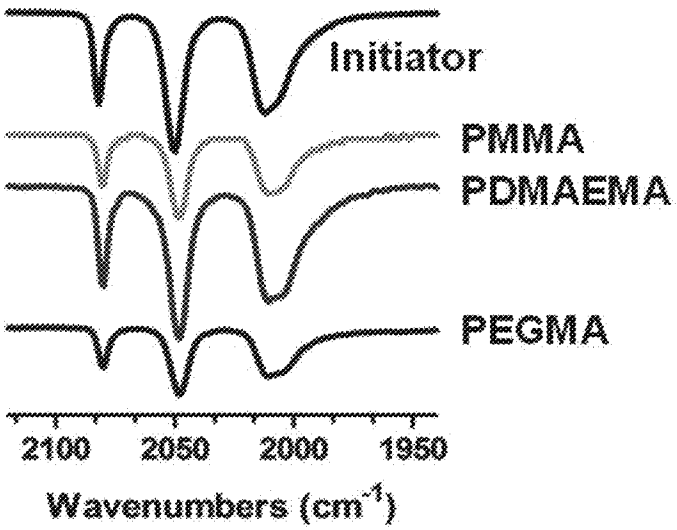
FIG. 10 is an IR overlay of the initiator, PMMA, PDMAEMA, and PEGMA showing retention of characteristic Fe—CO stretching frequencies.
Figure 11:
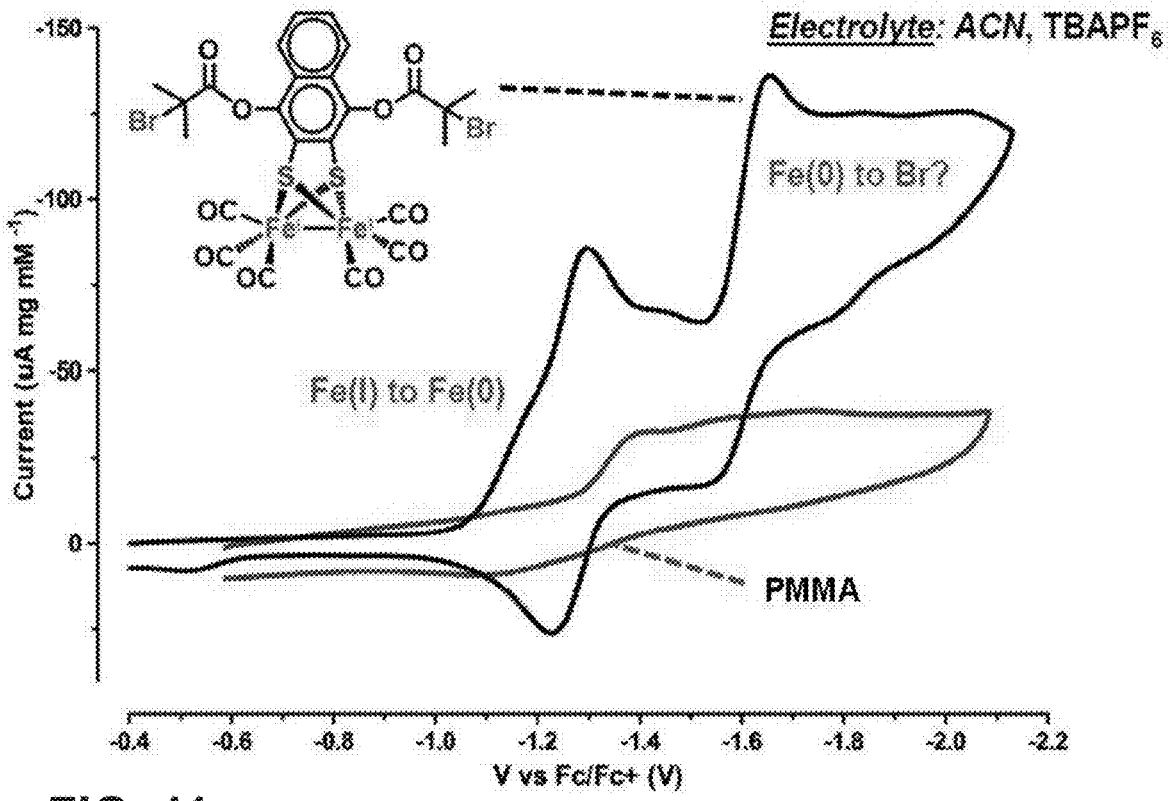
FIG. 11 shows cyclic voltammetry (CV) of the metalloinitiator and PMMA-g-[2Fe-2S] in acetonitrile to observe Fe(I) to Fe(O) reduction in the metallopolymer.
Figure 12:
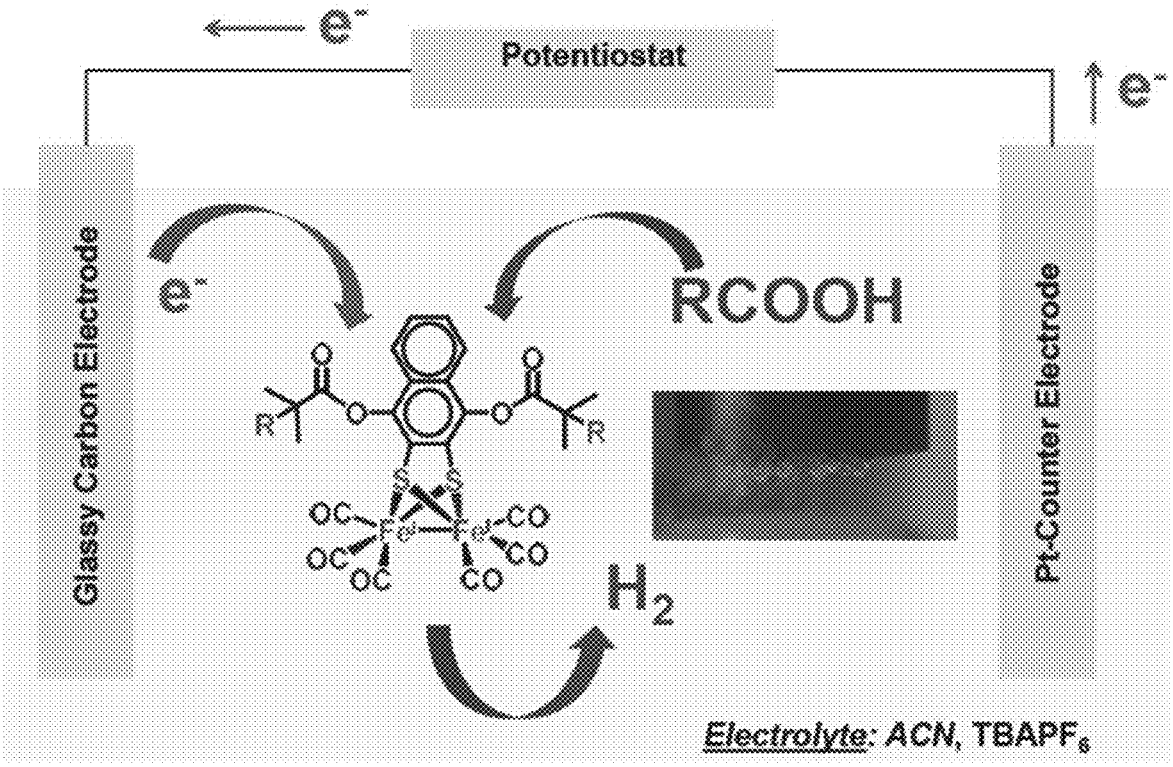
FIG. 12 is an exemplary schematic of a CV experiment to measure current from $H_2$ generation.
Figure 13:
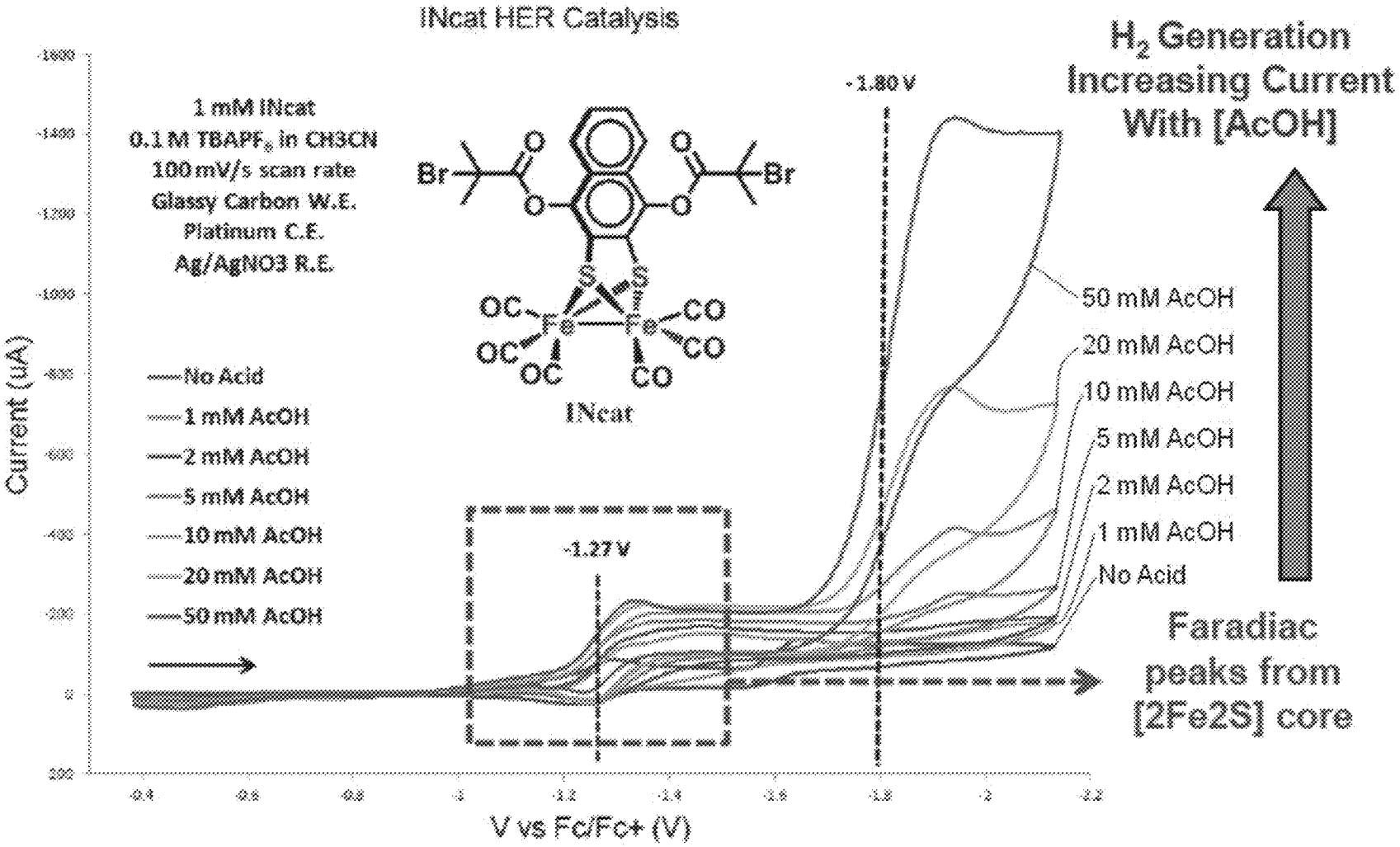
FIG. 13 shows CV electrocatalysis of the metalloinitiator with increasing [AcOH] in acetonitrile.

PDMAEMA-g-[2Fe-2S] metallopolymers: Upon structural confirmation that well-defined [2Fe-2S] metallopolymers could be prepared via the ATRP methodology, the preparation of water soluble materials was then pursued, particularly with the aim of engineering the microenvironment around the [2Fe-S2] complex to enhance HER electrocatalysis. To achieve this goal, tertiary amines were incorporated as side chain groups to metallopolymers to impart both water solubility to these complexes, and facilitate proton transfer to the [2Fe-2S] core upon protonation of the amine groups. These metallopolymers were prepared by ATRP of 2-(dimethylamino)ethyl methacrylate (DMAEMA) from metalloinitiator 5 using a Cu(I)Br/N,N,N',N',N"-pentamethyldiethylenetriamine (PMDETA) or Cu(I)Br/1,1,4,7,10,10-hexamethyltriethylenetetramine (HMTETA) catalyst system to afford the PDMAEMA-g-[2Fe-2S] metallopolymer, as confirmed by IR spectroscopy (FIG. 10) and SEC in LiBr-DMF mobile phase ($M_{n,SEC}$=9,500; $M_w/M_n$=1.33; (FIG. 9B). Hence, using this approach, a much higher local concentration of amine groups around the [2Fe-2S] core is created, since every DMAEMA repeating unit carries an amine side chain group, which could be precisely controlled by variation of the degree of polymerization as achieved by ATRP. PDMAEMA metallopolymers in the range of 10,000-15,000 g/mol with low dispersity were prepared and were water soluble, as well as soluble in ACN and DMF.

For ATRP of DMAEMA using 5, a 10 mL Schlenk flask equipped with a Teflon-coated magnetic stir bar was added Cu(I)Br (2.55 mg, 0.0178 mmol), sealed with a rubber septum, evacuated and backfilled with Ar three times. Deoxygenated HMTETA (7.3 μL, 0.0267 mmol) was added to the flask followed by the addition of 0.2 mL of deoxygenated THF via purged syringe. The resulting mixture was stirred for 10 minutes to allow for the formation of the Cu-ligand complex. In a second 10 mL Schlenk flask equipped with a Teflon-coated magnetic stir bar, 5 (14.24 mg, 0.0178 mmol) was added. The flask was sealed with a rubber septum, evacuated and backfilled with Argon three times, and then purified and deoxygenated DMAEMA (0.30 mL, 1.78 mmol) was added via purged syringe, followed by the addition of 0.30 mL of deoxygenated, anhydrous THF. The solution was stirred until homogeneous then transferred to the reaction flask via purged syringe. The flask was placed in an oil bath at 50° C. and stirred for 90 min.

Results

Figure 16:
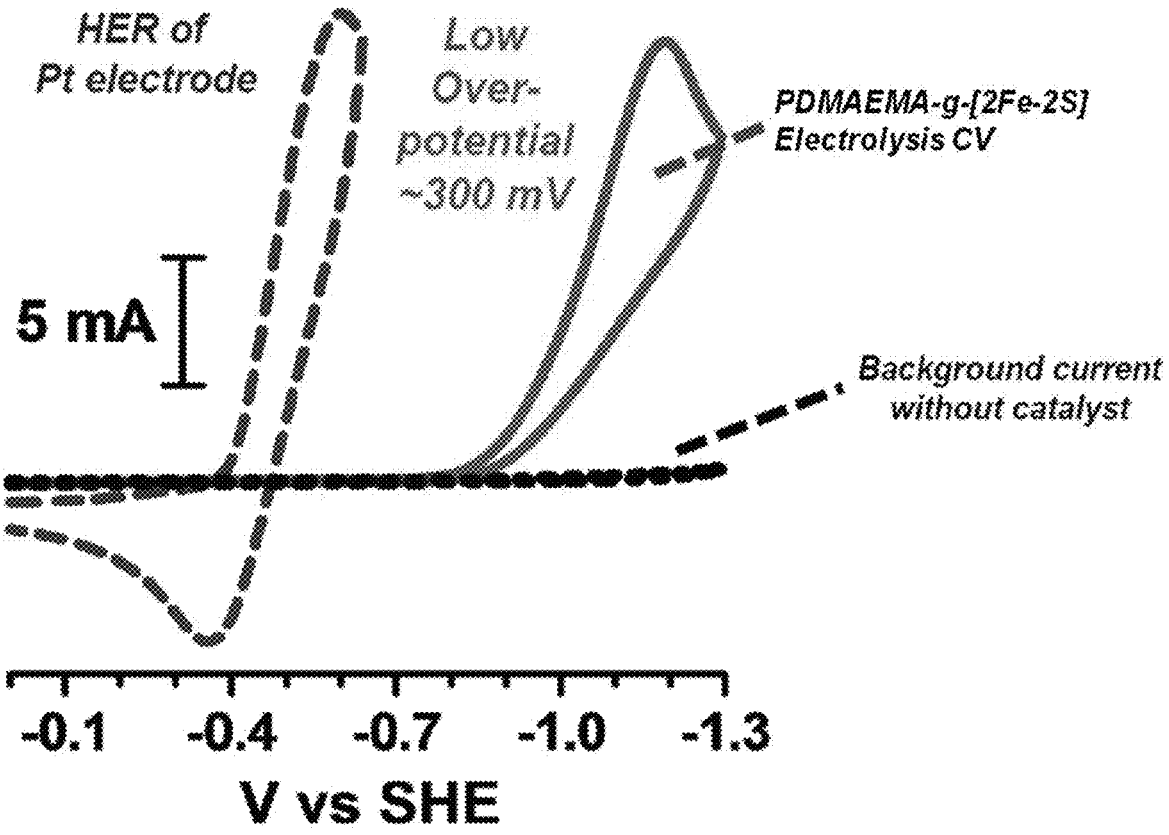
FIG. 16 is a CV current density comparison of 100 μM PDMAEMA-g-[2Fe-2S] metallopolymer to a Pt electrode for $H_2$ generation under identical conditions.
Figure 17:
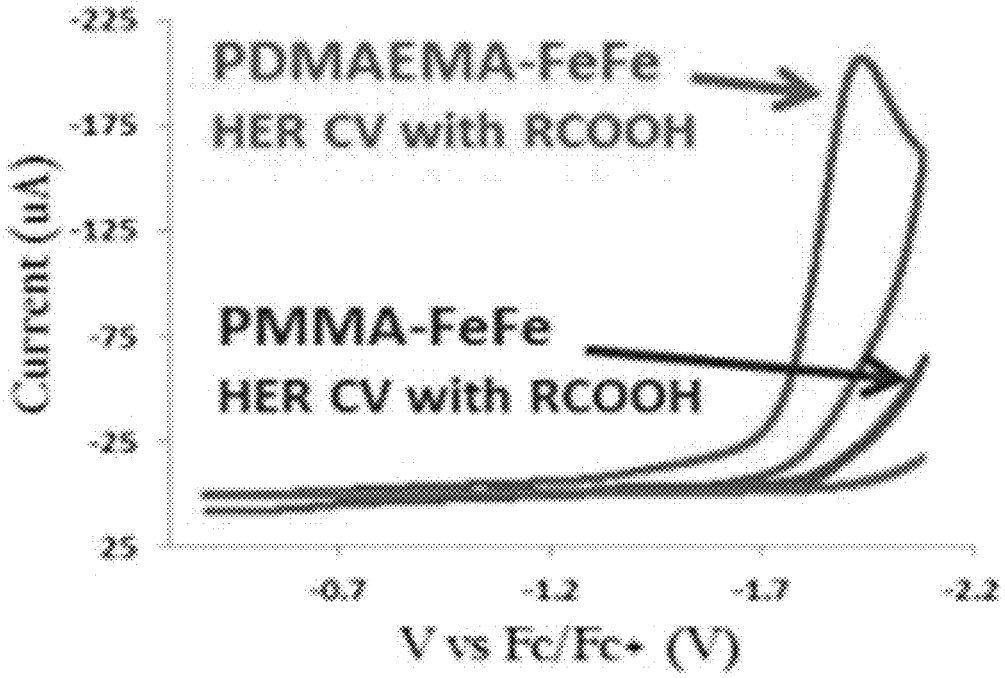
FIG. 17 is a CV current density comparison of PDMAEMA-g-[2Fe-2S] and PMMA-g-[2Fe-2S] metallopolymers for $H_2$ generation under identical conditions.
Figure 18:
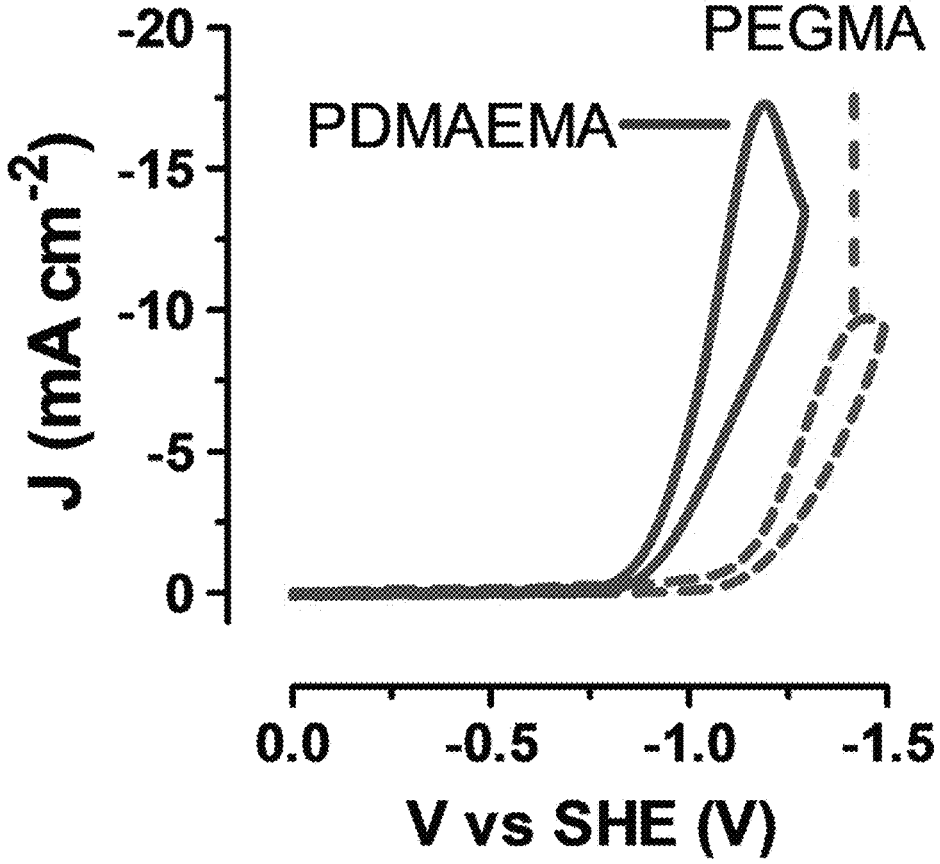
FIG. 18 is a CV current density comparison of 0.10 mM PDMAEMA-g-[2Fe-2S] and 0.52 mM PEGMA-g-[2Fe-2S] metallopolymers to a Pt electrode for $H_2$ generation under identical conditions.
Figure 19:
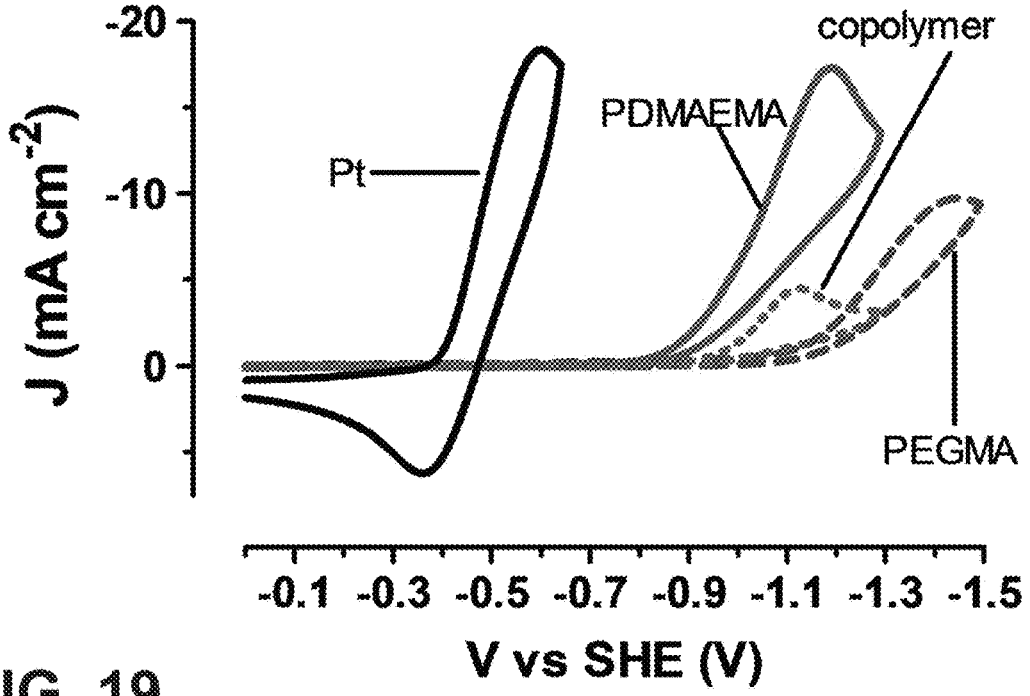
FIG. 19 is a CV current density comparison of 0.1 mM PDMAEMA-g-[2Fe-2S], 0.52 mM PEGMA-g-[2Fe-2S], and 0.2 mM PDMAEMA-r-PEGMA-g-[2Fe-2S] copolymer to a Pt electrode for $H_2$ generation under identical conditions.
Figure 20:
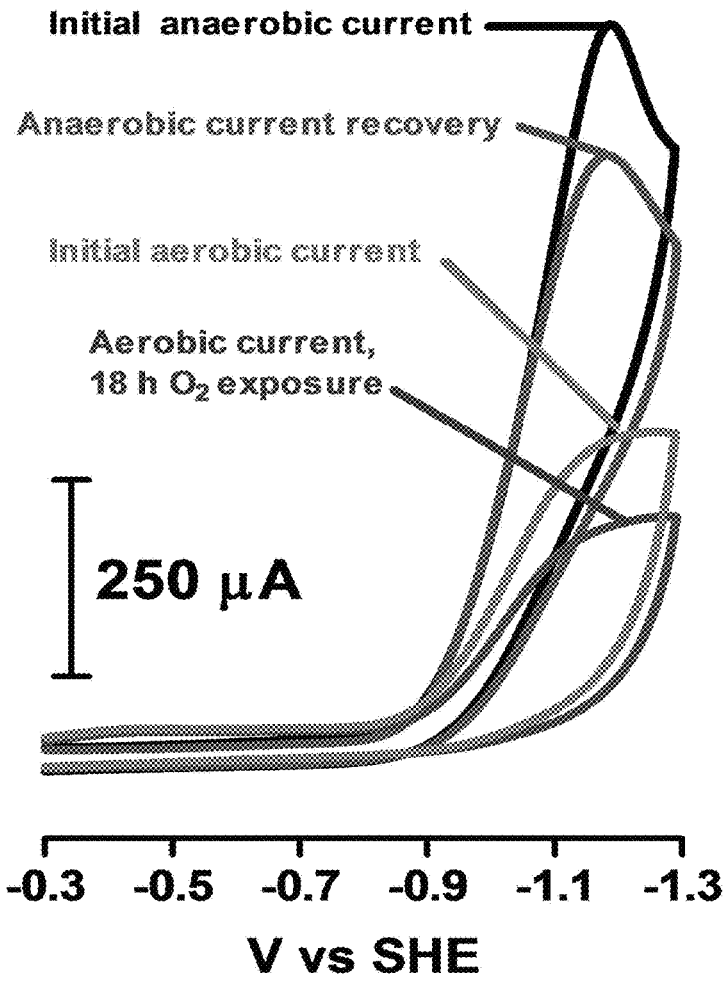
FIG. 20 shows cyclic voltammetry comparison of anaerobic and aerobic activity of PDMAEMA-g-[2Fe-2S] (ca. 50 pM [2Fe-2S] via IR, 2.5 mg/mL). Freshly prepared anaerobic solution, initial aerobic current response, current response after 18 hours of storage under aerobic conditions, and recovery of current upon return to anaerobic conditions. Current has been normalized to current density by dividing by experimentally determined area of the glassy carbon electrode (A=0.07469 $cm^2$).
Figure 21:
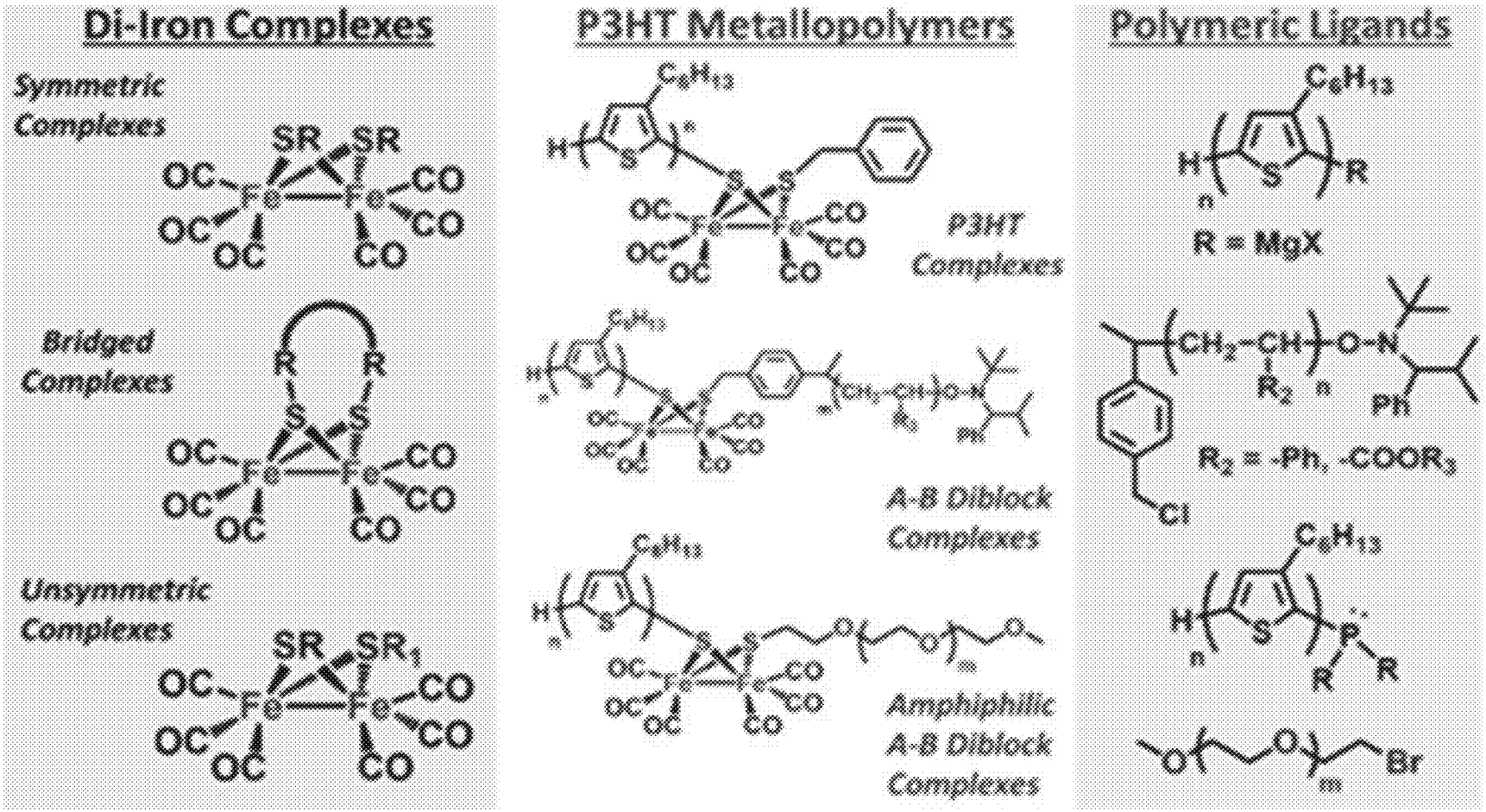
FIG. 21 shows non-limiting examples of metallopolymers that are synthesized using $Fe_2S_2(CO)_6$ complexes with P3HT and other polymeric ligands to enable photogeneration of $H_2$ and alkylation of diiron-disulfide complexes with Grignard, or organolithium reagents and alkyl halides to form unsymmetric complexes, or A-B diblock metallopolymers.
Figure 22:
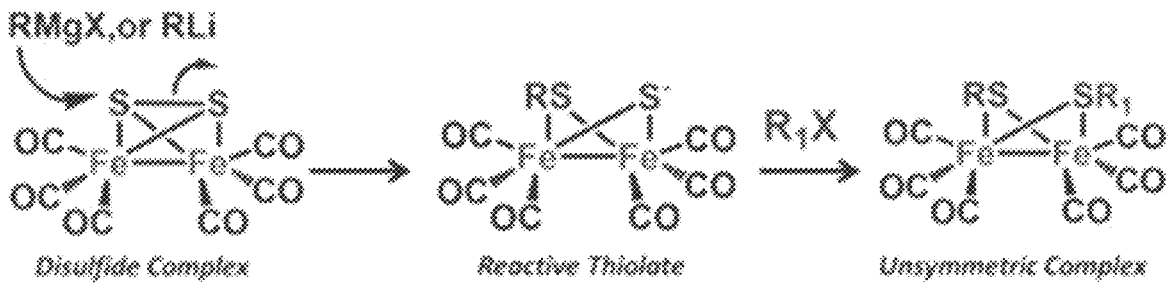
FIG. 22 shows a non-limiting example of a reaction scheme for preparing unsymmetric metallopolymer complexes.

Electrocatalytic CV experiments with PDMAEMA-g-[2Fe-2S] metallopolymers were performed in pH 7 neutral water. The PDMAEMA-g-[2Fe-2S] metallopolymer was catalytically active for $H_2$ generation at low potentials ($E_{onset}$=−0.85 V, $E_{1/2}$=−1.05 V, and $E_{ipc}$=−1.18 V, all aqueous potentials reported vs SHE), and modest metallopolymer loadings (1.6 mg/mL). Furthermore, the current densities generated by the PDMAEMA-g-[2Fe-2S] metallopolymer were comparable to that of a Pt electrode for $H_2$ generation under identical conditions (FIG. 16).

Air Stable Metallopolymers for HER.

The oxygen sensitivity of PDMAEMA-g-[2Fe-2S] metallopolymers in aqueous media was investigated since it is known that one of the major challenges in developing robust [2Fe-2S] biomimetic catalysts is the poor oxygen stability of these complexes as also encountered in the [FeFe]-hydrogenase enzymes. Referring to FIG. peak catalytic current, $I_{pc}$, was established for the sample under anaerobic conditions then the solution was bubbled with compressed air (21% $O_2$) for 30 minutes. Cyclic voltammograms of the oxygenated solution showed a peak for $O_2$ reduction (c.a. −0.4 V vs SHE) as well as a catalytic peak which retained 55% (±11%) of the peak catalytic current determined under anaerobic conditions. After storing the aerated solution in ambient conditions for 18 hours, the sample had slightly reduced activity compared with the previous day (39±7% of $I_{pc}$) but sparging with argon for 30 minutes allowed for recovery of 90% (±2%) of $I_{pc}$. Subsequently, a controlled potential Coulometry in a cyclic voltammetry cell was performed with no attempt to separate the catalytic solution from the $O_2$ producing Pt counter electrode. No decay in current was observed over this time period, confirming the aerobic stability of the PDMAEMA-g-[2Fe-2S] system. This level of activity and stability in aerobic solutions is remarkable in light of the fact that oxygen sensitivity is one of the most persistent, unsolved problems plaguing [FeFe]-$H_2$ ase mimics.

The previously described example demonstrated a versatile new methodology for the incorporation of catalytic moieties into metallopolymer frameworks. Using this new methodology, new metallopolymer systems were successfully synthesized, including PDMAEMA-g-[2Fe-2S], a water soluble HER catalyst that exhibits current densities comparable to a platinum electrode with an overpotential of only 0.23 V. This system has also demonstrated substantial aerobic stability. While the methodology has been demonstrated with vinylic monomers, the present invention is not limited to vinylic monomers alone. In other embodiments, this approach to active site polymer encapsulation may be utilized in a wide variety of catalytic systems to provide site isolation, solubility, improved stability, processability, and rate increases.

ALTERNATIVE CATALYST EMBODIMENTS

According to another embodiment, the present invention features a metallopolymer comprising photoactive regioregular poly(3-hexylthiophene) (P3HT) and catalytically active diiron-disulfide complexes. These diiron-based complexes are biomimetic analogues of the active sites in Fe—Fe hydrogenase enzymes that are also active in the electrocatalytic generation of molecular hydrogen ($H_2$). As previously described, diiron-disulfide hexacarbonyl complexes ($Fe_2S_2CO_6$) can be selectively functionalized to afford a variety of bonding motifs that readily lend themselves to the formation of metallopolymeric materials.

Referring now to FIG. 21-31, the present invention features a photocatalytic metallopolymer composition for generating hydrogen ($H_2$). In one embodiment, the composition may comprise a metallopolymer complex according to the following:

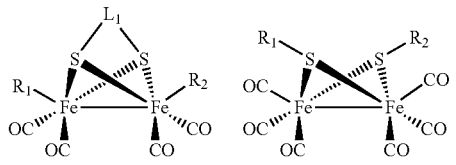

In some embodiments, $R_1$ can be a polymeric ligand selected from a group consisting of a photoactive regioregular poly(3-hexylthiophene)(P3HT) ligand, a water soluble ligand, polyethylene oxide, poly(acrylic acid), and a polymer derived from monomers selected from a group consisting of vinylic monomers, ethylenically unsaturated monomers, styrenic monomers, acrylate monomers, methacrylate monomers, acrylonitrile monomers, allylic monomers, vinylpyridine monomers, isobutylene monomers, maleimide monomers, norbornene monomers, monomers having at least one vinyl ether moiety, monomers having at least one isopropenyl moiety, and alkynylly unsaturated monomers, In other embodiments, $R_2$ may be selected from a group consisting of a phenyl, a

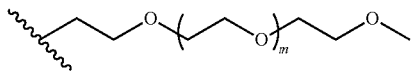

with m ranging from 1 to 20, a

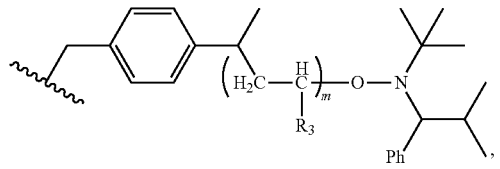

where $R_3$ is a phenyl or $COOR_4$ and $R_4$ is H or an alkyl group $C_2$-$C_{10}$, and a polymer derived from monomers selected from a group consisting of vinylic monomers, ethylenically unsaturated monomers, styrenic monomers, acrylate monomers, methacrylate monomers, acrylonitrile monomers, allylic monomers, vinylpyridine monomers, isobutylene monomers, maleimide monomers, norbornene monomers, monomers having at least one vinyl ether moiety, monomers having at least one isopropenyl moiety, and alkynylly unsaturated monomers. In a preferred embodiment, $R_2$ can impart water solubility to the metallopolymer complex.

Without wishing to limit the invention to a particular theory or mechanism, the polymeric ligand is capable of promoting photoinduced electron transfer to a diiron metal center of the metallopolymer complex. Further still, the metallopolymer complex generates $H_2$ upon irradiation of the photocatalytic metallopolymer composition in the presence of a proton donor.

According to another embodiment, the photocatalytic metallopolymer composition for generating hydrogen ($H_2$) may comprise a metallopolymer complex according to the following:

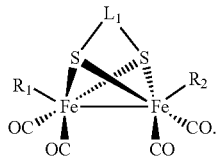

In one embodiment, $L_1$ may be an aryl. In another embodiment, $R_1$ and $R_2$ can each be, independently, a —CO or a polymeric ligand capable of promoting photoinduced electron transfer to a diiron metal center of the metallopolymer complex. Examples of the polymeric ligand include, but are not limited to, a photoactive regioregular poly(3-hexylthiophene)(P3HT) ligand, a water soluble ligand, polyethylene oxide, poly(acrylic acid), and a polymer derived from monomers such as, for example, vinylic monomers, ethylenically unsaturated monomers, styrenic monomers, acrylate monomers, methacrylate monomers, acrylonitrile monomers, allylic monomers, vinylpyridine monomers, isobutylene monomers, maleimide monomers, norbornene monomers, monomers having at least one vinyl ether moiety, monomers having at least one isopropenyl moiety, or alkynylly unsaturated monomers. Preferably, upon irradiation of the photocatalytic metallopolymer composition in the presence of a proton donor, the metallopolymer complex generates $H_2$.

In preferred embodiments, the polymeric ligand of any of the photocatalytic metallopolymer compositions described herein is a P3HT ligand. The P3HT ligand can act as a photosensitizer and intermolecular electron donor. In some embodiments, the P3HT ligand may be according to the following:

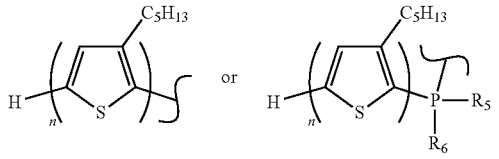

In some embodiments, n can range from 1 to 20. In other embodiments, $R_5$ and $R_6$ are each independently an H, an alkyl group $C_2$-$C_{10}$, or a phenyl.

For any of the photocatalytic metallopolymer compositions described herein, the metallopolymer complex can absorb light in the UV-Visible spectrum. The metallopolymer complex may also be a biomimetic analogue of hydrogenase.

According to one embodiment, the present invention features a method of generating molecular hydrogen ($H_2$). The method may comprise providing any of the photocatalytic metallopolymer compositions, adding the photocatalytic metallopolymer composition to a proton source, and irradiating the photocatalytic metallopolymer composition and proton source with UV or visible light. Without wishing to limit the invention to a particular theory or mechanism, the photocatalytic metallopolymer composition can act as an electron donor upon irradiation with light, thereby reducing a proton of the proton source to produce $H_2$. Examples of the proton source include, but are not limited to, water, a carboxylic acid, or a thiol.

According to another embodiment, the present invention features a method of producing a photocatalytic metallopolymer complex for generating molecular hydrogen ($H_2$). The method may comprise providing a diiron-disulfide complex according to the following structure:

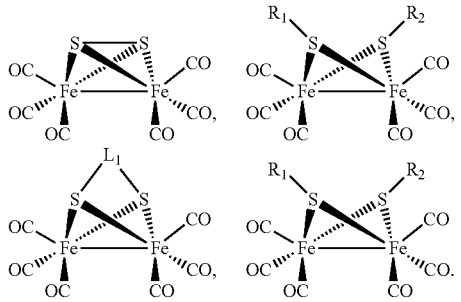

In one embodiment, the method may further comprise providing poly(3-hexylthiophene)(P3HT), reacting the P3HT with an organometallic halide to produce a halide-terminated P3HT ligand, reacting the halide-terminated P3HT ligand with the diiron-disulfide complex such that the P3HT ligand binds to one of the sulphides, providing an alkyl halide-terminated polymer ligand, and alkylating the diiron-disulfide complex with the alkyl halide-terminated polymer ligand at the second sulfide to produce the photocatalytic metallopolymer complex. In some embodiments, the organometallic halide is MgX. In other embodiments, the alkyl halide-terminated polymer is benzyl chloride (BzCl), polystryrene BzCl (PS-BzCl), or poly(t-butyl acrylate)-BzCl)(PtBA-BzCl). Without wishing to limit the invention to a particular theory or mechanism, the P3HT ligand is capable of promoting photoinduced electron transfer to a diiron metal center of the metallopolymer complex. Upon irradiation of the metallopolymer complex in the presence of a proton donor, the metallopolymer complex generates $H_2$.

In yet another embodiment, the method of producing a photocatalytic metallopolymer complex for generating molecular hydrogen ($H_2$) may comprise providing a diiron-disulfide complex according to the following structure:

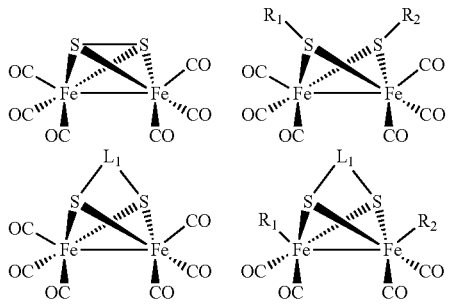

where $L_1$ can be an aryl.

In one embodiment, the method may further comprise providing poly(3-hexylthiophene)(P3HT), reacting P3HT with a phosphine to produce a phosphine-terminated P3HT ligand, and substituting at least one carbonyl moiety of the diiron-disulfide complex with the phosphine-terminated P3HT ligand to produce the photocatalytic metallopolymer complex. Without wishing to limit the invention to a particular theory or mechanism, the P3HT ligand is capable of promoting photoinduced electron transfer to a diiron metal center of the metallopolymer complex. The metallopolymer complex generates $H_2$ upon irradiation of the metallopolymer complex in the presence of a proton donor.

In some embodiments, a phosphine moiety of the phosphine-terminated P3HT ligand may comprise —$PPh_2$. In other embodiments, one carbonyl moiety of the diiron-disulfide complex is substituted with the phosphine-terminated P3HT such that metallopolymer complex is unsymmetric. In yet other embodiments, two carbonyl moieties of the diiron-disulfide complex are each substituted with the phosphine-terminated P3HT such that metallopolymer complex is symmetric.

PHOTOCATALYST EXAMPLES

The following are non-limiting examples of the present invention. It is to be understood that said examples are provided for the purpose of demonstrating the present invention in practice, and is in no way intended to limit the invention. Equivalents or substitutes are within the scope of the invention.

Synthesis of P3HT Metallopolymers.

Figure 23:
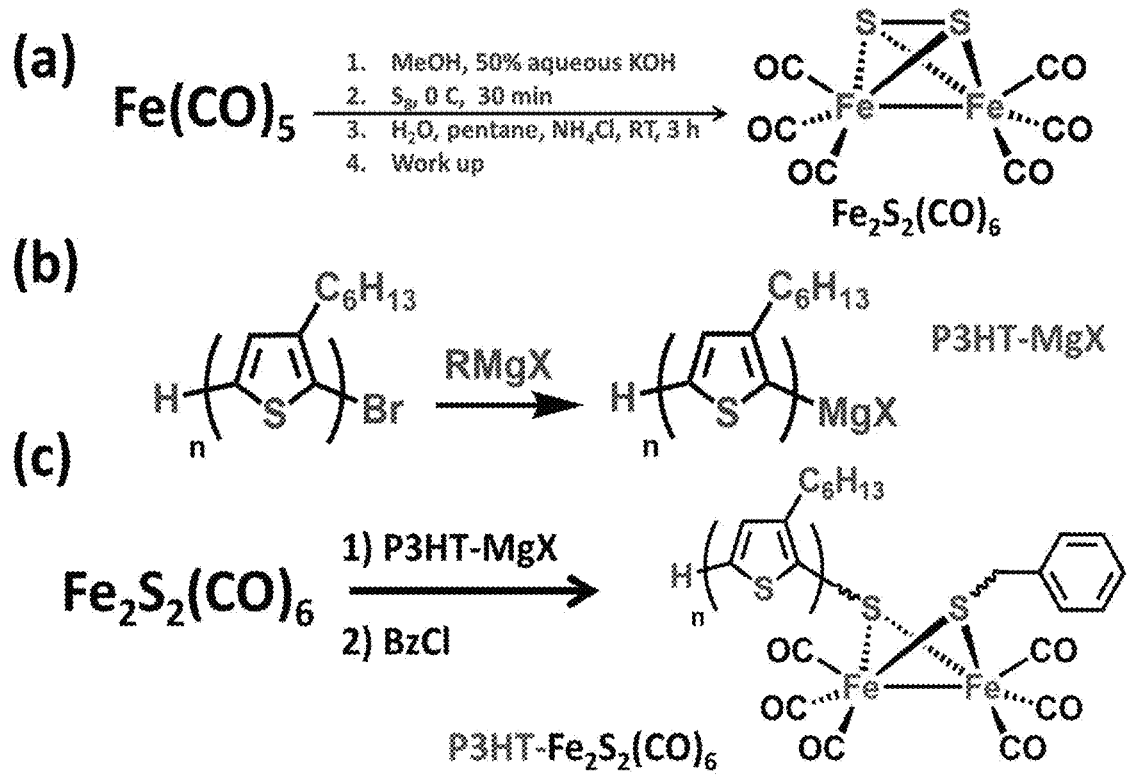
FIG. 23 shows an exemplary reaction scheme for (a) synthesis of $Fe_2S_2(CO)_6$ disulfide complex; (b) Grignard terminated regioregular P3HT; and (c) unsymmetric diiron complex via reaction of P3HT-MgX and alkylation with benzyl halides.

The synthesis of metallopolymers bearing a single P3HT ligand and a small molecule benzyl, or methyl group is shown in FIG. 23. A P3HT with a single terminal —MgX group is prepared via magnesium halogen exchange of a P3HT prepared by the GRIM method (which are capped with —H and —Br groups) followed by treatment with i-PrMgCl. Alkylation of the reactive thiolate form of the complex is conducted with benzyl halides, or methyl iodide. Structural characterization of the target metallopolymer may be determined using 1H NMR and IR spectroscopies in conjunction with SEC.

Figure 24:
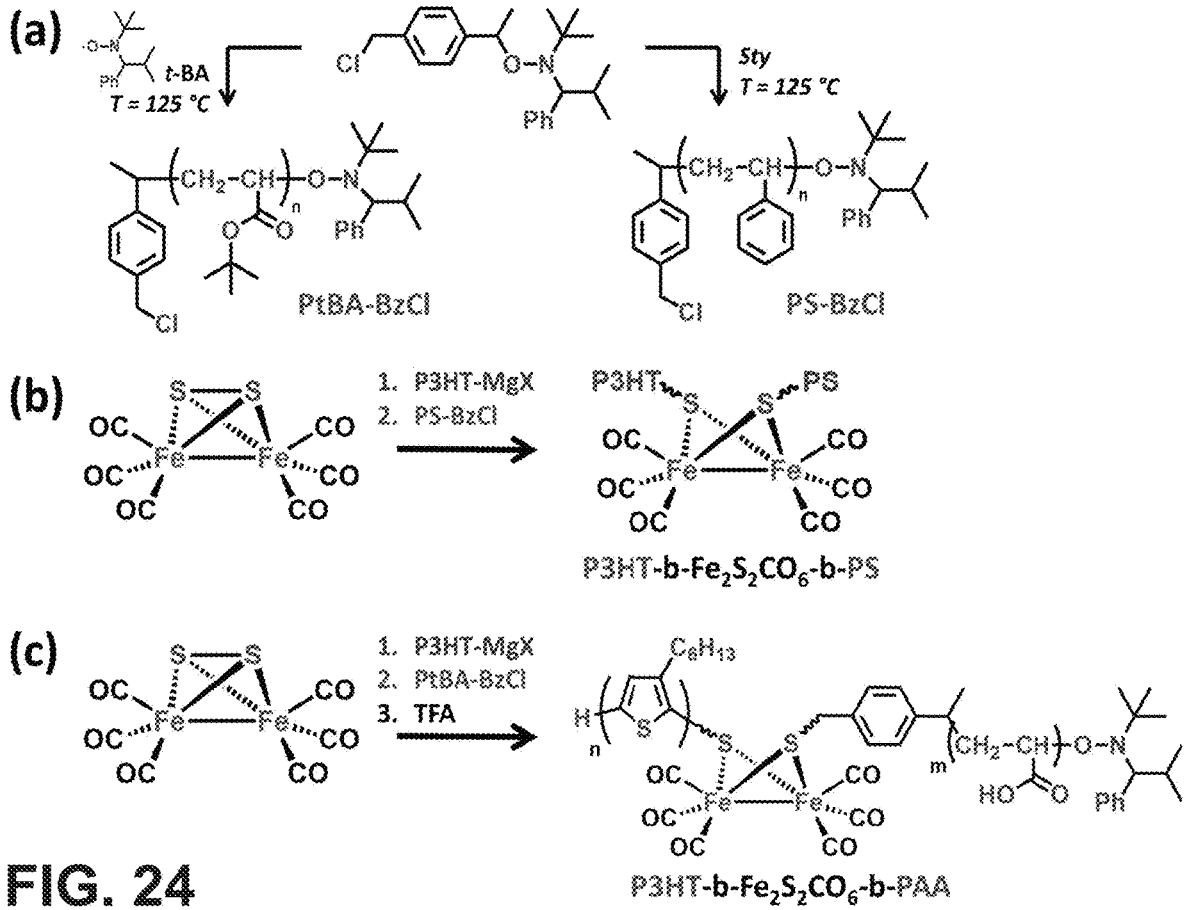
FIG. 24 shows an exemplary reaction scheme for (a) synthesis of benzyl halide terminated polystyrene and poly (t-butyl acrylate) followed by (b) alkylation of reactive P3HT thiolates with these polymeric benzyl halides (BnBr) to form A-B diblock metallopolymers (c) synthesis of water dispersible A-B diblocks via alkylation of poly-(t-BA) and deprotection with TFA.

Referring to FIG. 24, A-B diblock metallopolymers are prepared by alkylation of reactive P3HT thiolate intermediates with alkyl halide terminated polymers. The use of the benzyl chloride functional alkoxyamine initiators can afford well-defined homopolymers of polystyrene and polyacrylates bearing a primary benzyl chloride end group without the need for protecting group chemistry. Polystyrenes and poly(t-butyl acrylates) in the range of $M_n$~2000-5000 g/mol are prepared and used to form A-B diblock metallopolymer complexes, using the methods previously discussed. The efficiency of the alkylation reaction can be quantified using SEC. Purification of the metallopolymer can be conducted using silica gel column chromatography, which is effective to remove more polar polyacrylates.

Furthermore, water soluble A-B diblock metallopolymers can be prepared via alkylation of alkyl halide terminated methyl monoether polyethylene glycol ($M_n$~2000-10000 g/mol) with P3HT thiolate intermediates. Water soluble complexes can also be prepared by acidic deprotection of P3HT-block-$Fe_2S_2(CO)_6$-block-poly(acrylic acid) (P3HT-b-$Fe_2S_2CO_6$-b-PAA) with TFA, since the diiron complex was found to be stable to TFA. Without wishing to limit the invention to a particular theory or mechanism, the amphiphilic A-B diblock metallpolymers can form block copolymer micelles when dispersed in water.

Phosphine Terminated P3HT Ligands.

Figure 25:
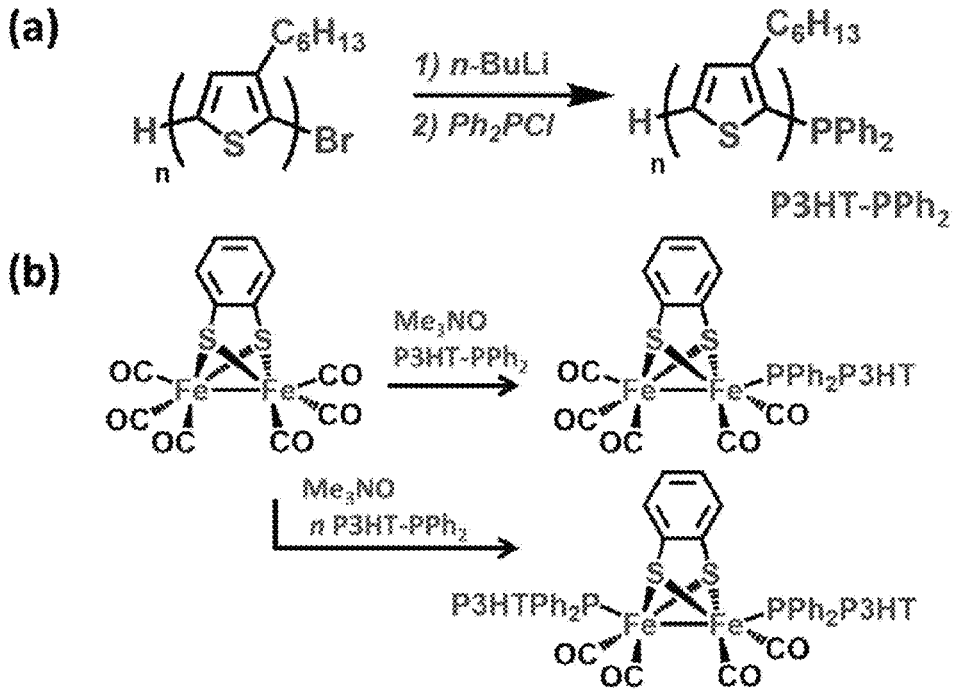
FIG. 25 shows an exemplary reaction scheme for (a) proposed synthesis of phosphine terminated P3HT ligands and (b) preparation of metallopolymer complexes with mono, or bis-P3HT ligands.

Referring to FIG. 25, an additional strategy for preparing P3HT covalently attached to a [FeFe]-hydrogenase active site mimic is to append P3HT with a phosphine moiety which can then be used as a ligand for iron in place of a CO ligand. The simplest strategy for accomplishing this is to prepare P3HT with a terminal phosphine ligand. In a few cases, the metal complexes can be electropolymerized to give conducting films but the preparation of polythiophenes appended with phosphines and their metal complexes have not been reported. Consequently, the first task is to prepare P3HT with a terminal phosphine. The standard method for preparing thiophene phosphines is to react a lithiothiophene with a phosphorus electrophile: $Ar_2PX$, $ArPX_2$ or $PX_3$, X=Cl or Br. The lithiothiophene is obtained by deprotonation of the thiophene with t-BuLi or halogen metal exchange of the α-halo (Br or I) thiophene with n-BuLi. Once the phosphine terminated P3HT is in hand, the reactions with Benzcat are carried analogously to the ligand substitution reactions. The ability of phosphine terminated P3HT ligated to Benzcat to generate $H_2$ on irradiation can be evaluated using the methodology outlined above for the other P3HT-[2Fe2S] polymers. Without wishing to limit the invention to a particular theory or mechanism, the [FeFe]-hydrogenase active site mimics with phosphines instead of CO ligands are reduced at potentials 0.2 to 0.3 V more negative. This means that the LUMO energy level of these complexes is raised and the viability of electron-transfer from the excited state HOMO of the P3HT moiety to the [2Fe2S] moiety may be at issue. However, the electron donating ability of the phosphine may be ameliorated by electron-withdrawing substituents; thus, metallopolymers can also also be prepared from the commercially available bis(p-trifluoromethylphenyl)phosphorus chloride and bis(p-pentafluoro-phenyl)phosphorus chloride. In addition, pyrrolidino groups on phosphorus increase their rr-acceptor properties and it has been reported that the mono-and bis-tripyrrolidinophosphine complexes undergo only small cathodic shifts of 30 and 60 mV, respectively, as compared to their all-CO ligated [2Fe2S] complexes.

Characterization of Metallopolymers

Various spectroscopic methods such as $^1H$ and $^{13}C$ NMR and IR are useful in characterizing 2Fe2S active site mimics as well as X-ray crystallography. X-ray crystal structure analysis is not feasible for the metallopolymers but NMR and IR spectroscopic analysis are essential. In addition, to $^1H$ and $^{13}C$ NMR spectroscopic analysis $^{31}P$ NMR spectroscopy are useful in characterizing the phosphino polymeric ligands and their 2Fe2S complexes. It should be noted that IR spectroscopic analysis is especially useful because the metal carbonyl stretching bands are especially strong and occur in a characteristic region of the IR that is devoid of most other absorptions. In addition, the position of these bands depends on the electron richness of the metal center, for example, the metal carbonyl IR stretching frequencies of 1PTA occur at 2052 (s), 1993 (s), 1978 (s), 1939 (w) whereas those of the more electron-rich center in the bis-phosphine complex 1PTA2 occur at 2002 (s), 1959 (s), 1936 (s), 1926 (w) $cm^{-1}$. In the case of P3HT, the hexyl groups and thiophene hydrogens occur in characteristic regions and it is known that in thiol terminated P3HT the chemical shift of the adjacent $CH_2$ moiety of the hexyl group undergoes a shift.

Intermolecular Electron Transfer

In one embodiment, poly(3-hexylthiophene) (P3HT) and fullerene derivatives are used in bulk heterojunction solar cells because upon irradiation, P3HT forms excitons which migrate to the interface with the fullerene derivative wherein ionization occurs with an electron migrating through the fullerene and the hole migrating through the P3HT. To effect exciton dissociation, a key advance was the finding that photoinduced electron-transfer from Tr-conjugated polymers such as polythiophene to $C_{60}$ was ultrafast. Consequently, bulk heterojunction cells, epitomized by regioregular poly(3-hexylthiophene) P3HT and a fullerene derivative: [6,6]-phenyl-$C_{61}$ butyric acid methyl ester $C_{61}$PCBM, in which the two materials form an interpenetrating bi-continuous material proved especially advantageous. Here, on photoexcitation, the exciton formed in the P3HT material diffuses to the interface with $C_{61}$ PCBM and an electron is transferred. In this process, the photoexcited P3HT acts as an electron donor and the $C_{61}$ PCBM acts as an electron acceptor. Although this electron transfer separates the electron and hole, they are still coulombically bound. This coulombically bound interfacial electron-hole pair must then dissociate into free charge carriers.

The fullerene derivative can be replaced by a bioinspired hydrogenase active site 2Fe-2S model and covalently linked. Furthermore, the experiments can be done in solution in the presence of weak acid that is stronger than acetic acid, and a sacrificial electron donor. It is expected that the polythiophene preferentially absorbs the light. Without wishing to limit the invention to a particular theory or mechanism, the exciton formed by absorption of a photon by P3HT would ionize and transfer an electron to Benzcat forming the corresponding radical anion and concomitantly forming a hole in the polymer. For this to be energetically favorable, the LUMO energy level of the P3HT must be higher in energy than the LUMO level of Benzcat. Furthermore, the reduction of potential of Benzcat and its LUMO energy can be tuned by substituents on the benzene ring. In order to generate $H_2$ from protons, $2e^-$ are required as follows: $2H^+ + 2e^- = H_2$.

Figure 26:
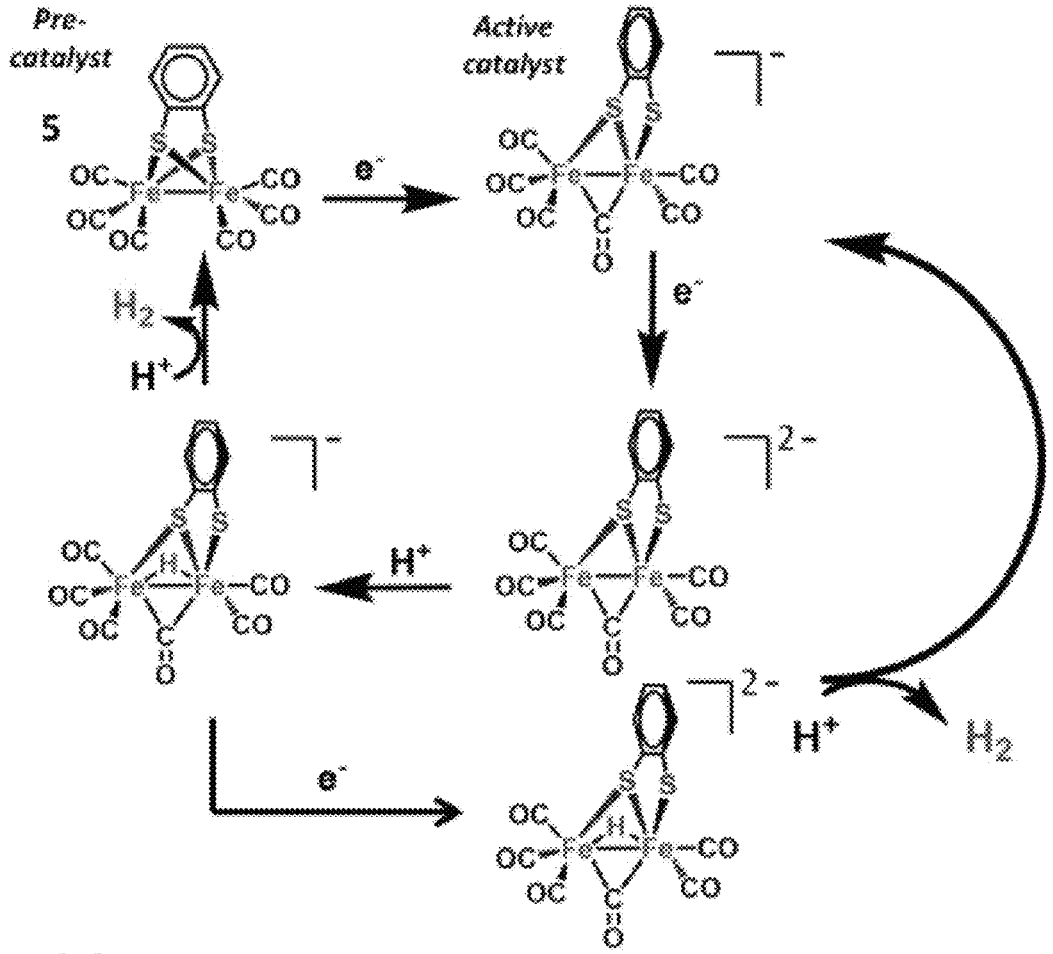
FIG. 26 is a non-limiting example catalytic generation of $H_2$ with benzoFe 2S2$(CO)_6$ (Benzcat).
Figure 27:
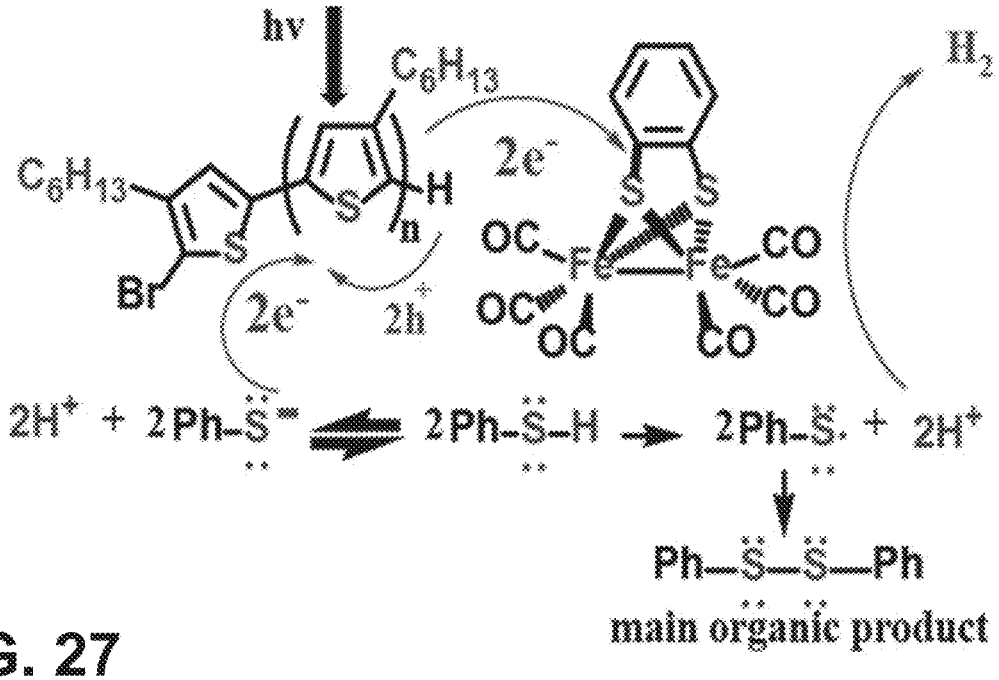
FIG. 27 shows a non-limiting example of a photocatalytic HER scheme.
Figure 28:
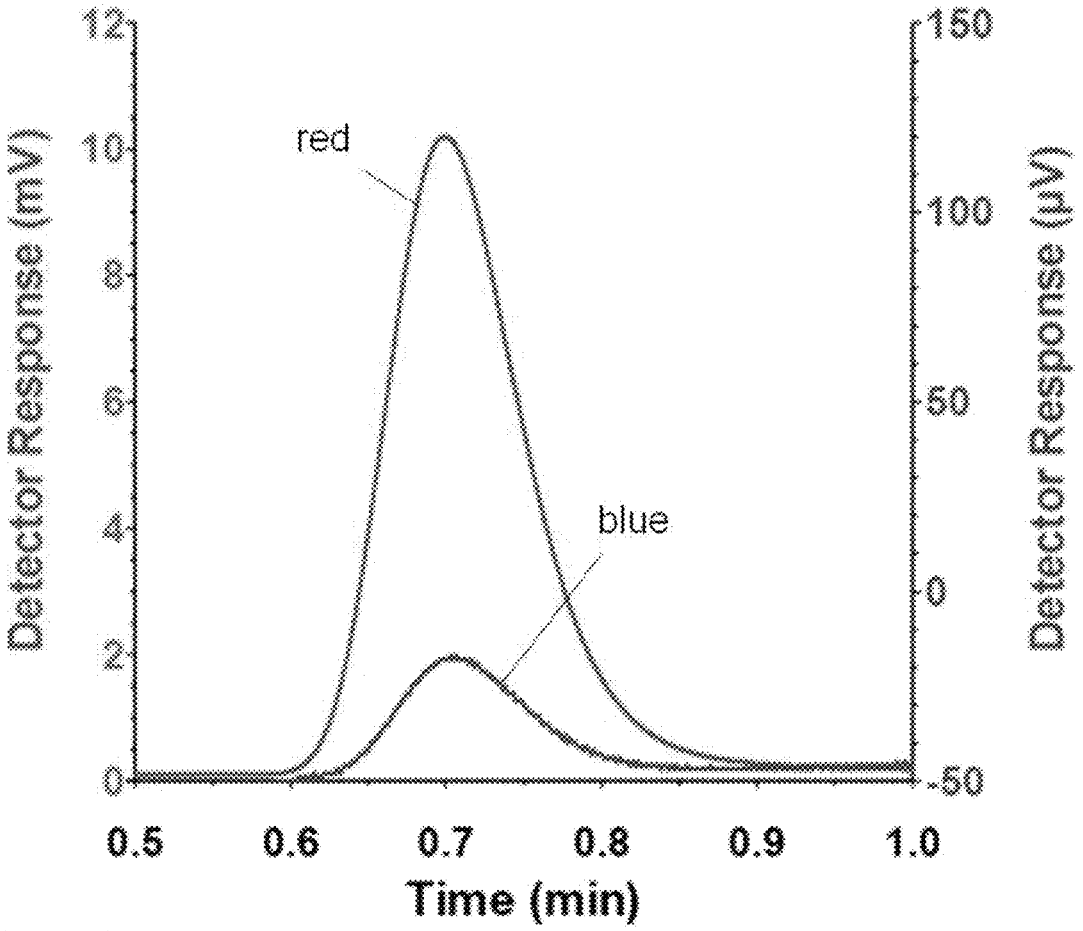
FIG. 28 shows a Gas Chromatogram (GC) of $H_2$ peak in overhead gasses upon irradiation of Benzcat, P3HT, and PhSH in toluene (red trace, left y-axis) and the control experiment without P3HT (blue trace, right y-axis). A third control without Benzcat did not produce detectable amounts of $H_2$ under the same conditions (data not shown).
Figure 29:
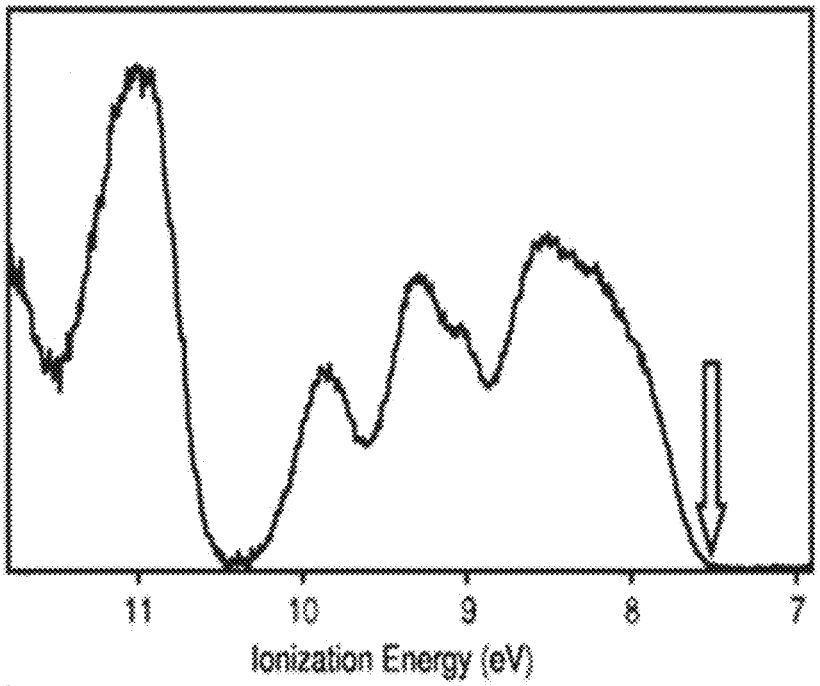
FIG. 29 shows Ultraviolet Photoelectron Spectroscopy (UPS) data for Benzcat showing an ionization onset (HOMO energy) at 7.50 eV.
Figure 30:
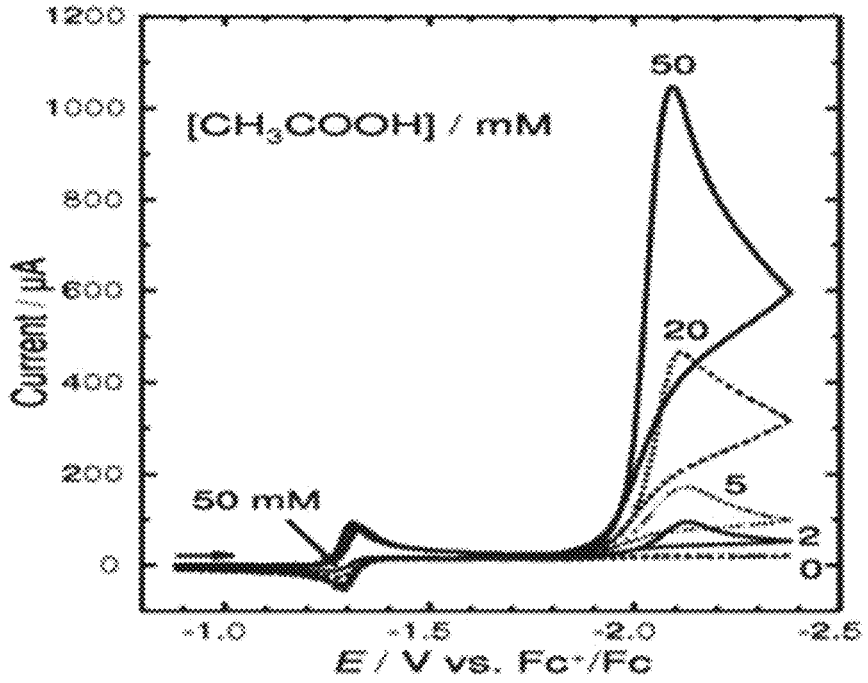
FIG. 30 shows CV of Benzcat (1 mM of the reactant in reaction (b) of FIG. 24) in $CH_3CN$ with increasing catalytic current and increasing amounts of acetic acid.

Addition of a second electron to Benzcat is more favorable energetically than addition of the first electron, that is, there is potential inversion, rendering addition of a second electron to the stable Benzcat anion radical more favorable than the first after reorganization as outlined in FIG. 26. Note that the reorganization obtained after one-electron reduction requires rotation around one of the Fe atoms, formation of a bridging CO and Fe13 S bond weakening. Protonation followed by $H_2$ loss regenerates Benzcat. The hole in P3HT is filled by the sacrificial electron donor regenerating P3HT.

An experiment was done in which a solution of P3HT and Benzcat in toluene was irradiated with light of greater than 450 nm with thiophenol as the proton and electron source and the formation of $H_2$ was detected by gas chromatographic analysis on a molecular sieves column using a thermal conductivity detector. Efficient photocatalytic generation of $H_2$ was shown by GC analysis (see FIG. 28). It is theorized that the mechanism occurs in which $2e^-$ are added to Benzcat and thiophenol protonates the dianion. The hole in the P3HT is filled by electron transfer from thiophenol and this generates strong acid to react with the μ-bridged hydride producing $H_2$ and regenerating Benzcat. It should be noted that spectroscopic studies with P3HT and Benzcat did not show any evidence for association in the ground state, that is, the UV-Vis absorption spectrum of a mixture of P3HT and Benzcat was the same as the sum of the individual spectra. In this experiment, the photoexcited P3HT and Benzcat must be near each other for electron transfer to occur. In other embodiments, it may be possible to improve this electron transfer by covalently attaching the two moieties by side-chain or end functionalization of P3HT.

Intramolecular Electron Transfer

The efficiency of electron transfer between P3HT and Fe2S2 catalytic moieties on irradiation can increase in the metallopolymers outlined above. Consequently, irradiation of these metallopolymers in organic solvents in the presence of thiophenol can more efficiently produce $H_2$. In addition, irradiation of the A-B diblock metallopolymers can be done in water or aqueous THF. Without wishing to limit the invention to a particular theory or mechanism, it is theorized that this reaction is a surface reaction in which the thiolate anion binds to the surface of the quantum dot and transfers an electron to the photoexcited quantum dot. The thiolate radical, which is observed by EPR spectroscopy, then couples and concomitantly forms $H_2$. However, no $H_2$ is produced upon irradiation of P3HT and thiophenol. The presence of Benzcat is required for rapid production of $H_2$. It is important to note that the present experiments were done in toluene. Under aqueous conditions, thiolate is present, but in toluene, its concentration is very low because the pKa of thiophenol in toluene is much greater than in water. It should be emphasized that under the present conditions, it is assumed that the reaction forming $H_2$ is ionic, not free radical. That is, a proton reacts with the iron hydride forming $H_2$. The consequences of performing the photoreaction with 2Fe2S metallopolymers in water are of value. It should be noted that irradiation of Benzcat in the presence of eosin as photosensitizer and $Et_3N$ as sacrificial electron donor at pH<6 in SDS micelles affords $H_2$. For example, the aqueous system allows for control of the pH of the solution using buffers. Irradiation of P3HT-2Fe2S in the presence of thiophenol at neutral pH may result in evolution of $H_2$ due to the free radical process outlined above owing to the presence of phenylthiolate. However, at low pH where there is little thiolate, the ionic mechanism outlined above may dominate. This is important because in water, splitting cell protons generated by oxidation of water can catalytically reduce the irradiation of the present catalysts. In the system in which hydrogenase is replaced by P3HT-2Fe2S photocatalysts, both the oxidation of water and the reduction of protons would be photocatalyzed. Ideally, in such a system no sacrificial reagent would be required.

Figure 31:
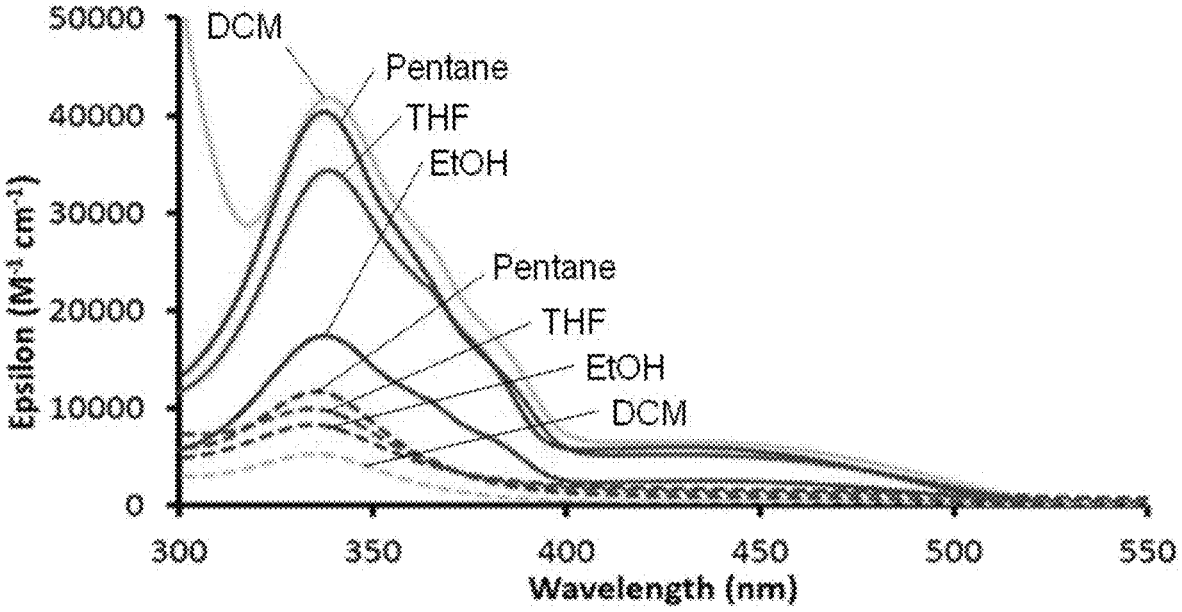
FIG. 31 shows absorption spectra for monothiophene complex (dotted lines) and terthiophene complex (solid lines) in various solvents at equal concentrations.

[FeFe]-Hydrogenase mimics absorb in the visible in the same region as polythiophenes. Consequently, it is relevant to consider which moiety preferentially absorbs light. Oligothiophenes may be able to selectively absorb light and there may even be charge transfer bands in these complexes. Of particular note is the visible absorption spectrum of terthiophene catalyst as compared with monothiophene catalyst, as shown in FIG. 31. The extinction coefficient for the absorption at ca. 350 nm increases dramatically as the number of thiophene rings increases. Furthermore, there appears to be long wavelength bands in the oligothiophene complexes that are not in the monothiophene complex. In the visible absorption spectrum of the terthiophene catalyst, there is a new peak with a maximum 90 nm to the pentane line of the monothiophene complex and the extinction coefficient is increased dramatically (ca. 25×). This long wavelength band suggests the possibility of a charge transfer band with the oligothiophene acting as the donor and the Fe2S2 moiety acting as the acceptor. Although the new long wavelength bands do not shift in absorption maxima as a function of solvent polarity, they still may be charge transfer bands.

ELECTROLYZER SYSTEMS

Figure 38A:
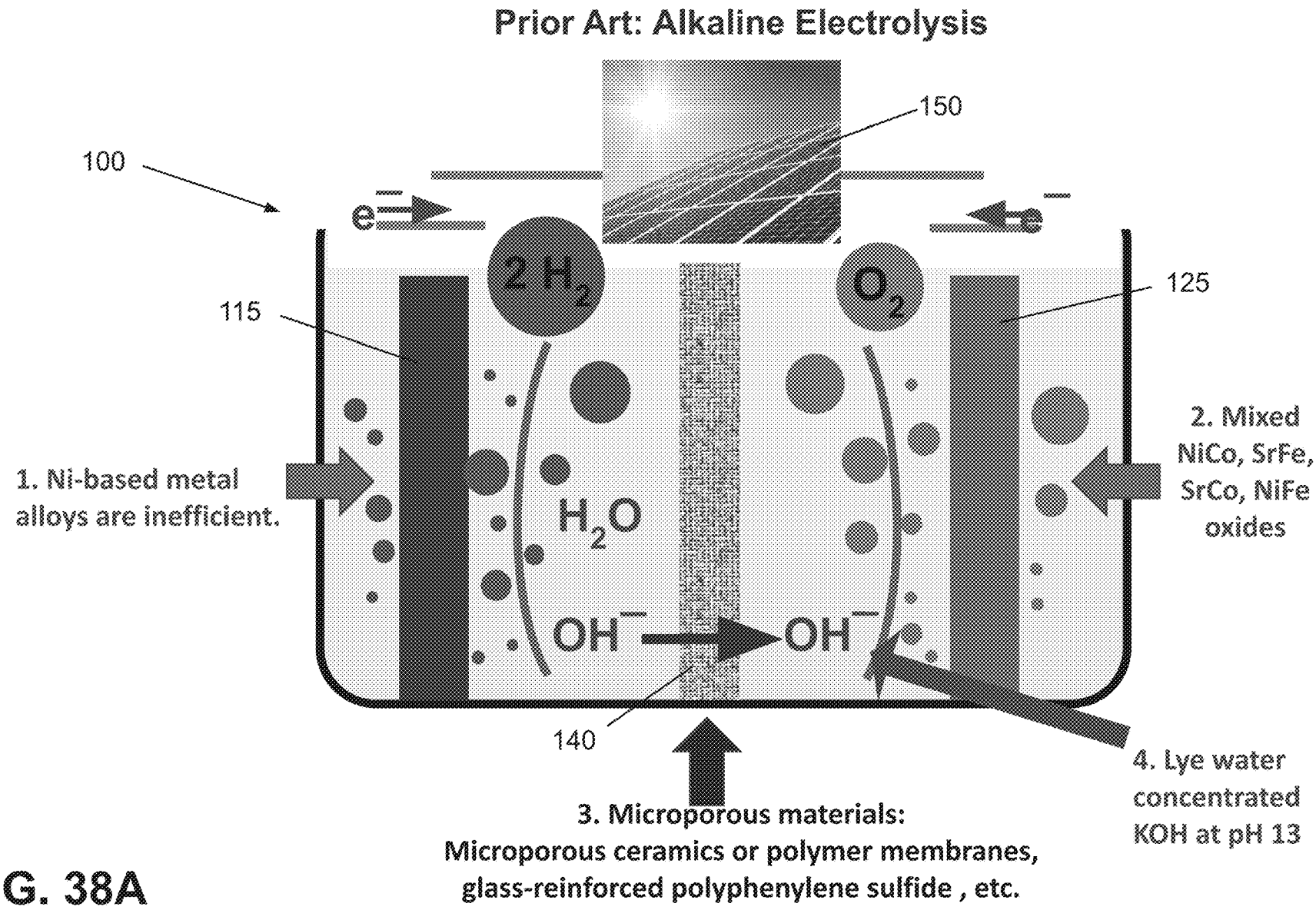
FIGS. 38A and 38B show methods and materials used in the prior art, e.g., alkaline electrolysis (FIG. 38A) and proton membrane exchange electrolysis (FIG. 38B) to generate hydrogen ($H_2$).
Figure 38B:
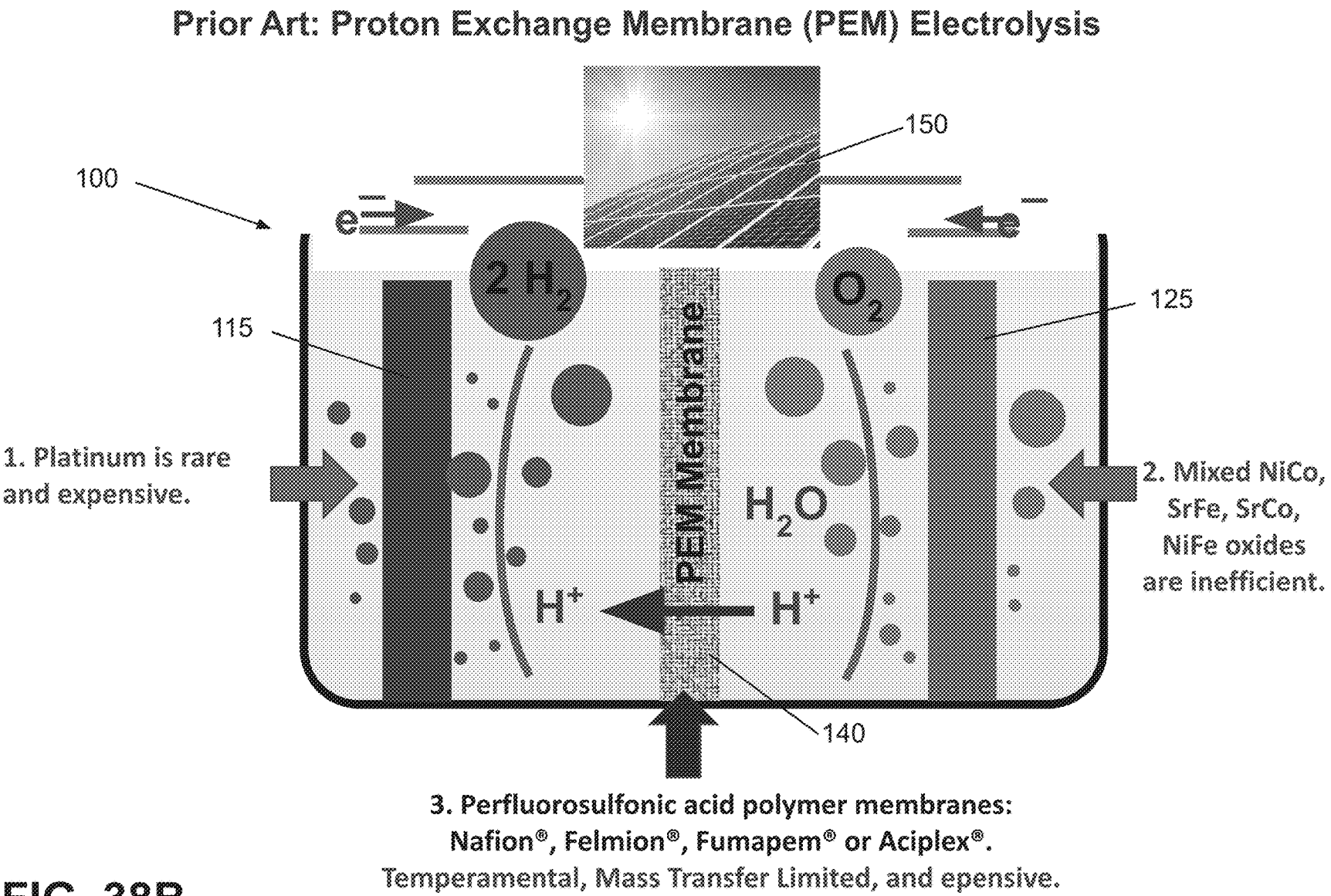

According to some embodiments, the electrocatalytic metallopolymer of the present invention can be used in an electrolyzer (100) for generating hydrogen ($H_2$). As shown in FIGS. 38A and 38B, prior electrolyzer devices utilized highly alkaline electrolytes which are inefficient on the cathode side for hydrogen production, or expensive ion exchange membranes and catalysts on the cathode side to generate hydrogen. This inefficiency and/or high costs limited the use of electrolyzers in industry. Hence, there is a need for more effective and cheaper electrolyzers.

The present invention can resolve the problems associated with previous electrolyzers by utilizing the electrocatalytic metallopolymers described herein. Without wishing to be bound to a particular theory or mechanism, the electrolyzers of the present invention are more efficient in generating hydrogen and have lower operating costs because they do not require the expensive catalysts.

Figure 38C:
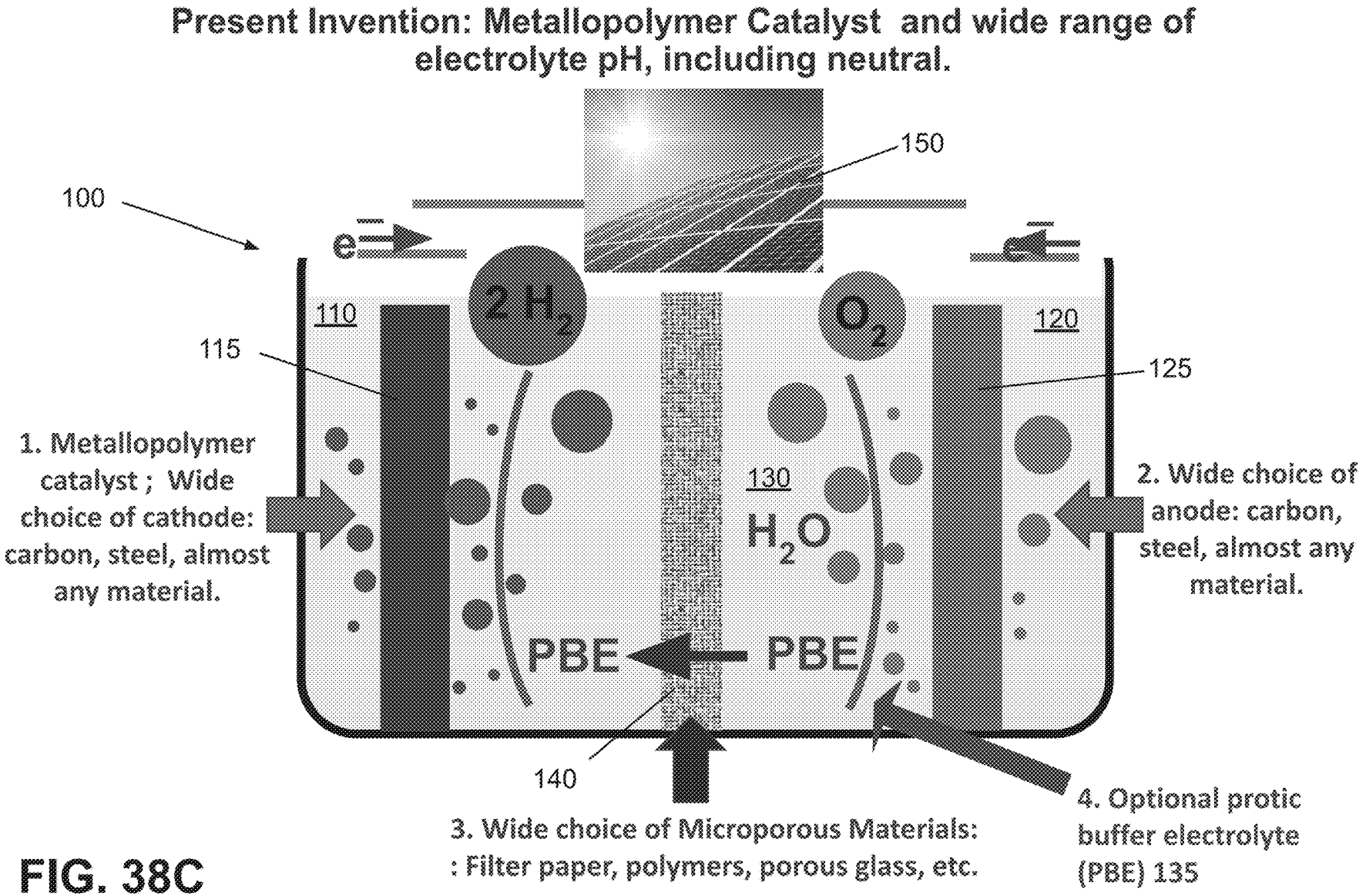
FIG. 38C shows schematic of an electrolyzer of the present invention for generating $H_2$ using the metallopolymers described herein as a catalyst and a wide choice of materials.

Referring now to FIG. 38C, the electrolyzer (100) may comprise a cathode (115) comprising the electrocatalytic metallopolymer (117) coupled to an electrically conductive material (118), an anode (125) for the electrical circuit to the cathode, and an aqueous solution (130). In some embodiments, the cathode (115) and anode (125) are in contact with the aqueous solution (130). In some embodiments, the anode (125) is electrically coupled to the cathode via electrode contacts (155).

Figure 44B:
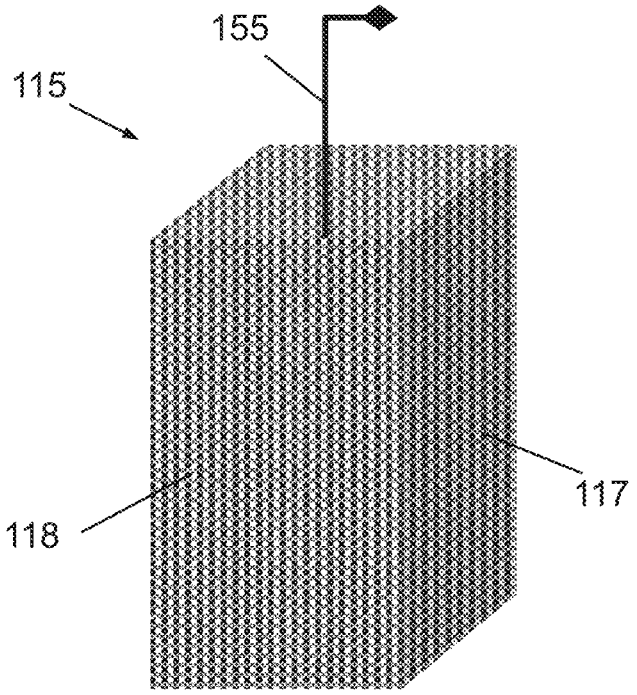
FIG. 44B shows a non-limiting example of a porous conductive material forming the cathode, with the electrocatalytic metallopolymer disposed thereon or within the pores of the material.

In some preferred embodiments, the metallopolymer (117) may be any one of the electrocatalytic metallopolymers (117) described herein. For instance, the metallopolymer may comprise an electrocatalytically active complex bonded to a polymer. In some embodiments, the metallopolymer accepts electrons and generates $H_2$. In some embodiments, the electrically conductive material (118) may comprise a flat surface as shown in FIG. 44A. The metallopolymer (117) may be disposed on the surface or embedded therein if the surface is porous. Referring to FIG. 44B, the metallopolymer (117) may be disposed on a surface of a substrate comprised of the porous material, or embedded within the pores. In some embodiments the metallopolymer may be disposed on the surface of the membrane (140).

In some embodiments, the electrically conductive material (118) is a rigid structure or a flexible structure. In other embodiments, the electrically conductive material (118) is a porous material, such as a foam or a mesh. For example, the electrically conductive material (118) may comprise a metallic foam or a metallic mesh. Any standard mesh or pore size can be used. For example, the openings of the mesh or pores may range from at least 20, 50, 100, 500 or 1000 microns and/or up to 1000, 2000, or 5000 microns. In some embodiments, the metallopolymer is integrated with the electrically conductive porous material. The cathodes described herein may comprise a flat or curved surface and may be in the form of an open lattice structure including truss, honeycomb, foam, grids, or interconnected lattices.

In some embodiments, the electrically conductive material (118) may be comprised of carbon, such as graphite, or a metal. Non-limiting examples of the metals include steel, Al, Ni, Fe, Cu, Pt, Pd, Ag, Au, Co, Mo, Ru, Os, Ga, Ti, Mn, Zn, V, Cr, W, Sn, mixtures thereof, alloys thereof, or combinations thereof. Other conductive materials (e.g., material that allows electrons to flow freely and fluidly from one point to another) may be used in accordance with the present invention. In some embodiments, the metallopolymer is integrated with the electrically conductive material.

Figure 44C:
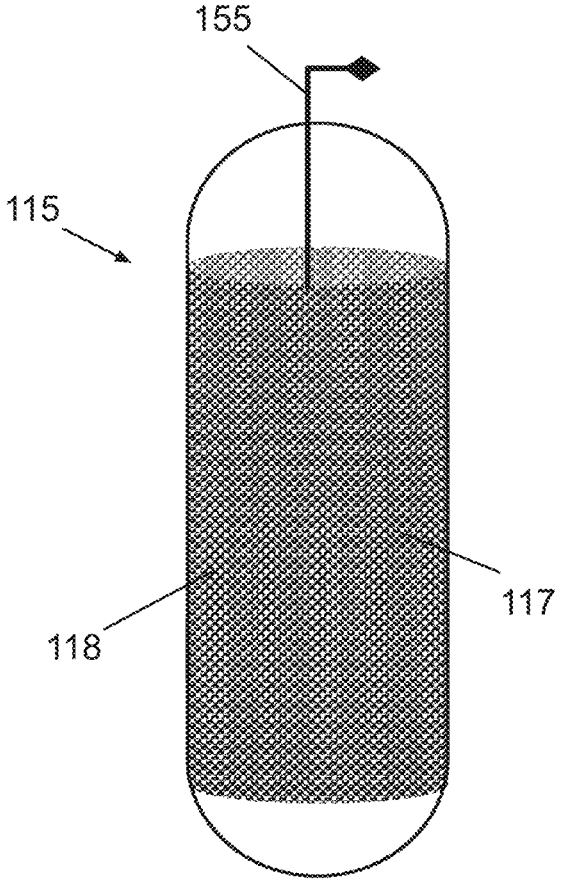
FIG. 44C shows a non-limiting example of a bed reactor with the cathode comprising electrocatalytic metallopolymer particulates.

In alternative embodiments, the electrically conductive material (118) may comprise particulates that are coated with the metallopolymer (117). Said particulates are placed in a bed or column, as shown in FIG. 44C, to form the cathode (115). In one embodiment, the electrically conductive material (118) may comprise metallic powder packings such as supported or unsupported catalytic metal particles. For example, the first and second metallic powder packings catalytic metal particles such as steel, Al, Ni, Fe, Cu, Pt, Pd, Ag, Au, Co, Mo, Ru, Os, Ga, Ti, Mn, Zn, V, Cr, W, Sn, mixtures thereof, alloys thereof, or combinations thereof. In some embodiments, the catalytic metal particles may be supported on electrically conductive substrates such as carbon substrates (e.g., activated carbon).

In alternative embodiments, the electrically conductive material (118) in the cathode side solution and the electrocatalytic metallopolymer (117) may be dissolved in the cathode side solution.

In some embodiments, the anode (125) may also be comprised of the electrically conductive material (118) described herein. The anode is electrically coupled to the cathode so as to form an electrical circuit.

In some embodiments, a membrane (140) may be disposed between the cathode (115) and the anode (125), thus separating the cathode (115) from the anode (125). The electrolyzer may comprise a cathode chamber (110) and an anode chamber (120) that is separated by the membrane (140). In some embodiments, the membrane (140) may comprise filter paper, polymers, glass (e.g., porous glass), ceramic, cloth, proton exchange membranes, or any other porous barrier. The electrolyzer described herein may further comprise a membrane to In some embodiments, the membrane (e.g., the porous membrane) has a pore size that prevents the mixing of gasses in the anode and cathode compartments. In alternative embodiments, the membrane may comprise a proton exchange membrane, including but not limited to, polymer membranes or composite membranes, fluoropolymers, sulfonated polymers, Neon®, Flemion®, or Aciplex®.

In some embodiments, the aqueous medium comprises water. A pH of the aqueous medium may be near-neutral or higher. For example, the pH may range from 5 to 7, or 6-8, or 7-9, or higher. In some embodiments, the pH of the aqueous solution may be in a range from about 1 to 10. In some embodiments, the pH of the aqueous solution may be in a range from about 1 to 7. In some embodiments, the pH of the aqueous solution may be in a range from about 5 to 10. In some embodiments, the pH of the aqueous solution may be in a range from about 5 to 8. In another embodiment, the pH of the aqueous solution may be in a range from about 6 to 10, or from about 6 to 8. In other embodiments, the pKa of the co-catalyst may be in a range from about 2 to 12. In one embodiment, the pKa of the co-catalyst may be in a range from about 2 to 7. In another embodiment, the pKa of the co-catalyst may be in a range from about 7 to 13.

One of the unique and inventive technical features of the present invention is that the electrolyzer described herein can generate hydrogen ($H_2$) at a neutral pH using a wide variety of conductive materials for the cathode and anode (see FIG. 38C). None of the presently known prior references or work has the unique inventive technical feature of the present invention. For example, methods used in the prior arts require the use of either a high pH or a low pH and/or expensive materials (see FIG. 38B) to generate hydrogen.

In further embodiments, the aqueous medium includes an electrolyte. In some embodiments, the electrolyte carries a current for the electrolysis process. The electrolyte may comprise a buffer solution (e.g., a phosphate buffer). In some embodiments, the buffer solution comprises a sodium phosphate buffer (e.g., PBS) or a TRIS buffer. The electrolyte composition may vary greatly depending on the process conditions and the type of electrolysis being conducted.

In other embodiments, the electrolyte may comprise a co-catalyst. In some embodiments, the electrolyte comprises a protic co-catalyst. The protic co-catalyst may be in a majority protic state and positively charged. Without wishing to limit the present invention, the protic co-catalyst increases the rate of $H_2$ generation without being consumed during the electrolysis process. In some embodiments, the protic co-catalyst may stabilize the pH of aqueous solution. In further embodiments, the protic co-catalysts may significantly reduce the overpotential energy requirement for electrolysis. Alternatively or in conjunction, the protic co-catalyst may increase the current density. Non-limiting examples of the protic co-catalyst include a phosphate buffer, imidazole, taurine (AES), 2-amino-2-methyl-1-propanol (AMP), 2-amino-2-methyl-1,3-propanediol (AMPD), tris-(hydroxymethyl)-aminomethane (Tris), bis-(hydroxymethyl)aminomethane (Bis-Tris), or Bis-Tris-Propane (BTP).

As used herein, the term "protic", when describing a compound such as the co-catalyst, refers to said compound having at least one H+ion, or proton, that it can donate. In some embodiments, a protic compound may be monoprotic (capable of donating one proton), diprotic (capable of donating two protons), or polyprotic (capable of donating multiple protons).

As used herein, the protonated or protic form refers to when the co-catalyst has a proton to contribute to the hydrogen evolution reaction (HER) reaction. Conversely, the deprotonated form is when this proton is dissociated from the molecule. The concentration of the protonated or protic form relative to the deprotonated form depends on the pH compared to the pKa. As a general rule, when the pH=pKa, the protonated and deprotonated forms are in equal concentration. When the pH<pKa, the solution is more acidic and excess protons will protonate the co-catalyst, therefore the concentration of the protonated form will be greater than the concentration of the deprotonated form. When the pH>pKa, the solution is more basic and the protons will dissociate from the co-catalyst, therefore the concentration of the deprotonated form will be greater than the protonated form.

According to other embodiments, the electrolyzer (100) may further comprise an energy source (150) electrically coupled to the cathode (115) and the anode (125) via electrode contacts (155). The energy source for powering the reactions may be a renewable energy source. Non-limiting examples include a solar energy source, a wind energy source, a hydraulic energy source, or a combination thereof.

In some embodiments, the present invention may comprise a hydrogen generating system comprising a plurality of electrolyzers (100) described herein. In one embodiment, the plurality of electrolyzers (100) may be arranged and operated in parallel so as to maximize hydrogen output. Each electrolyzer may comprise a cathode (115) comprising the electrocatalytic metallopolymer (117) coupled to an electrically conductive material (118), an anode (125) for the electrical circuit to the cathode, and an aqueous solution (130). In some embodiments, the number of electrolyzers can range from 2 to about 25 electrolyzers in the system. The product lines of the electrolyzers may be coupled to a single collection unit. For example, the $H_2$ output line of each electrolyzer may be combined into a single larger gas line. The $O_2$ output line of each electrolyzer may also be combined into another single larger gas line.

Since the electrolyzer (100) has been described herein, it is another objective of the present invention to utilize the electrolyzer (100) for fuel or chemical production. According to some embodiments, the present invention features a method of producing a fuel or chemical, comprising providing an electrolyzer (100) having a cathode (115) comprising an electrocatalytic metallopolymer (117), and an anode (125) for the electrical circuit to the cathode (115), flowing one or more solutions through the electrolyzer (100), and applying a voltage across the anode (125) and cathode (115) that causes a chemical reaction that produces a plurality of products from the one or more solutions, with the fuel or chemical being one of said products. Without wishing to limit the present invention, the electrocatalytic metallopolymer (117) can increase a production rate of said fuel or chemical. In other embodiments, the method may further comprise separating the fuel or chemical from the plurality of products and collecting the fuel or chemical.

Figure 39A:
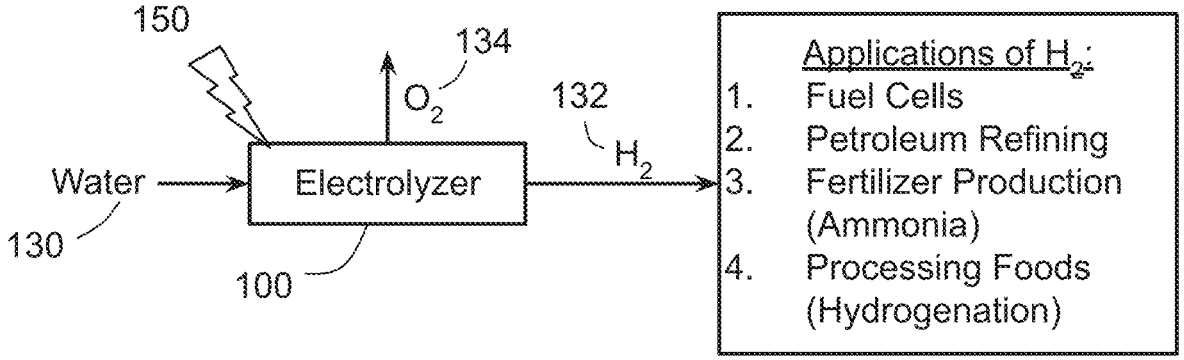
FIG. 39A is a block diagram for generating $H_2$ using the electrolyzer of the present invention, and non-limiting applications of said H2.

In some embodiments, the fuel is hydrogen ($H_2$). Thus, in some embodiments, the present invention features a method for producing $H_2$ utilizing the electrolyzer (100) as shown in FIG. 39A. In one embodiment, the method may comprise flowing water (130) into the electrolyzer (100), applying a voltage across the anode (125) and cathode (115) to dissociate water (130) into $H_2$ (132) at the cathode (115) and $O_2$ (134) at the anode (125), and collecting the $H_2$ (132) generated in the electrolyzer (100). In some preferred embodiments, the method generates green hydrogen by using electricity (150) from a renewable source, such as solar (e.g., photovoltaic cells) and wind energy (e.g., wind generators).

In some embodiments, water is transported or flowed into the electrolyzer (100) using a pump. In further embodiments, the water is cycled into the electrolyzer (100) using a pump. Alternatively or in conjunction, the flow of water in the electrolyzer can occur by natural convection. In a non-limiting embodiment, a gas separator is located above the electrolyzer. Water is introduced into the electrolyzer at the bottom and subsequently dissociated into $H_2$ and $O_2$ in the electrolyzer. These gasses rise and go into the gas separators where unreacted water is separated from the gasses. The liquid water flows back into the electrolyzer because of its higher density.

In some embodiments, the hydrogen may be used in multiple applications, including but not limited to, fuel cells, refining petroleum, producing fertilizers, and food processing. In some embodiments, the hydrogen may be used in heating/cooling, combustion, and/or fuel cells for transportation, including vehicles, airplanes, and space shuttles. In other embodiments, the hydrogen may be used in steel production. In some embodiments, the hydrogen may be used to produce ammonia for fertilizers. In further embodiments, the hydrogen may be used in hydrogenation reactions to produce hydrogenated oils for food production.

In some embodiments, the method described herein may generate about 10 L to about 100,000 L of hydrogen per hour per gram of metallopolymer at standard temperature and pressure (STP). In some embodiments, the method described herein may generate about 100 L-500 L of hydrogen per hour per gram of catalyst at STP. In other embodiments, the method may generate about 500 L-1,000 L of hydrogen per hour per gram of catalyst at STP, or about 1,000 L-3000 L of hydrogen per hour per gram of catalyst at STP, or about 3,000 L-5,000 L of hydrogen per hour per gram of catalyst at STP, or about 5,000 L-10,000 L of hydrogen per hour per gram of catalyst at STP. In some embodiments, the methods described herein may generate about 10,000 L-25,000 L of hydrogen per hour per gram of catalyst at STP, or about 20,000 L-L 35,000 L of hydrogen per hour per gram of catalyst at STP, or about 30,000 L-45,000 L of hydrogen per hour per gram of catalyst at STP, or about 40,000 L-50,000 L of hydrogen per hour per gram of catalyst at STP. In some other embodiments, the methods described herein may generate about 45,000 L-70,000 L of hydrogen per hour per gram of catalyst at STP, or about 60,000 L-85,000 L of hydrogen per hour per gram of catalyst at STP, or about 75,000 L-90,000 L of hydrogen per hour per gram of catalyst at STP, or about 85,000 L-100,000 L of hydrogen per hour per gram of catalyst at STP.

In other embodiments, for every kilowatt of power supplied, the method operates with about 100-800 amps of hydrogen-producing current. In some embodiments, for every kilowatt of power supplied, the method operates with about 100-300 amps of hydrogen-producing current, or about 200-400 amps of hydrogen-producing current, or about 300-500 amps of hydrogen-producing current. In some other embodiments, for every kilowatt of power supplied, the method operates with about 400-600 amps of hydrogen-producing current, or about 500-700 amps of hydrogen-producing current, or about 600-800 amps of hydrogen-producing current.

In one non-limiting embodiment, with a 300 watt power energy source producing 700 amps of current (e.g., typical 72-cell solar panel), and a mass of 0.09 gm of catalyst, the method described herein produced 300 liters of hydrogen (26 gm) per hour (3333 L of hydrogen per hour per gram of catalyst) at standard temperature and pressure (e.g., 600 gallons of hydrogen per solar panel per 8 hours of sunlight). A molar concentration of catalyst in water matches the hydrogen production of platinum operating under similar conditions with just 0.02 V greater overpotential.

Figure 39B:
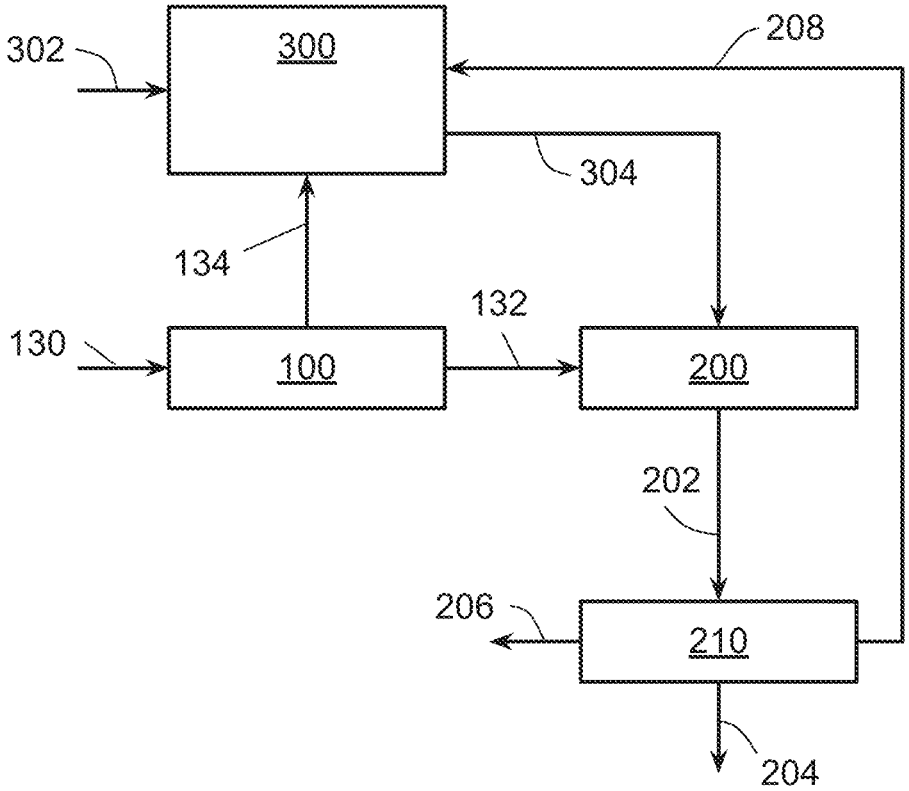
FIG. 39B shows a non-limiting example of a block diagram for generating $H_2$ (e.g., green hydrogen) for fuels or chemicals.

According to some embodiments, the hydrogen produced in the electrolyzer of the present invention may be used in producing other synthetic products, an example of which is depicted in FIG. 39B. Water (130) is introduced in the electrolyzer (100) to produce $H_2$ (132) at the cathode (115) and $O_2$ (134) at the anode (125). The $O_2$ (134) may optionally be used in a reforming process (300), which may comprise steam reforming, authothermal reforming, dry reforming, and/or partial oxidation, in which $O_2$ (134) reacts with a carbonaceous material (302), which may comprise renewable biomaterials, to produce syngas (304). The $H_2$ (132) from the electrolyzer (100) and the syngas (304) are reacted together in a catalytic reaction (200), e.g., Fischer-Tropsch Synthesis, to produce a product stream (202) comprising water and synthetic products. The product stream (202) undergoes a separation process (210) to separate out the water (206), synthetic products (204), and tail gas (208). The tail gas (208) may be recycled to the optional reforming process (300). In some embodiments, the synthetic products (204) may comprise synthetic gasses, hydrocarbons, alcohols, or waxes. In some embodiments, the separation process (210) may comprise distillation.

In some embodiments, the catalytic reaction may be syngas reactions, including Fischer-Tropsch or alcohol and/or ester synthesis, Bosch reactions. In some embodiments, the synthetic products may be Fischer-Tropsch liquids, synthetic natural gas or other alkanes, ammonia, methanol, alcohols, wax, or polymers.

In some embodiments, the method allows for the reduction (e.g., $2H_20+2e^{-\rightarrow H}{}_2+2OH^-$) of water (e.g., within a neutral range) to generate hydrogen ($H_2$) at the cathode. In other embodiments, the fuel is a product of other types of reduction reactions.

In some embodiments, the electrolyzer can operate under a variety of operating conditions. In one embodiment, the electrolyzer can operate under mild/ambient conditions (e.g., 0° C. to 40° C. and 0.8 atm to 1.2 atm). In other embodiments, the operating conditions can be extended to other temperatures and/or pressures. For example, the electrolyzer can operate at a temperature of at least 0° C., 20° C., 25° C., 30° C., 50° C., 70° C., or below the boiling point of the reaction solution, e.g. below 100° C. for water at normal atmospheric pressure. In some embodiments, the electrolyzers can operate at an appropriate elevated pressure to allow for reaction temperatures above 100° C. or elevated temperatures above the boiling point. In other embodiments, the electrolyzers can operate at a pressure of at least 0.5 atm, or at least 1 atm, or at least 2 atm, or at least 5 atm, or at least 10 atm.

ELECTROLYSIS CELL EXAMPLE

The following are non-limiting examples of the present invention. It is to be understood that said examples are provided for the purpose of demonstrating the present invention in practice, and is in no way intended to limit the invention. Equivalents or substitutes are within the scope of the invention.

Figure 40A:
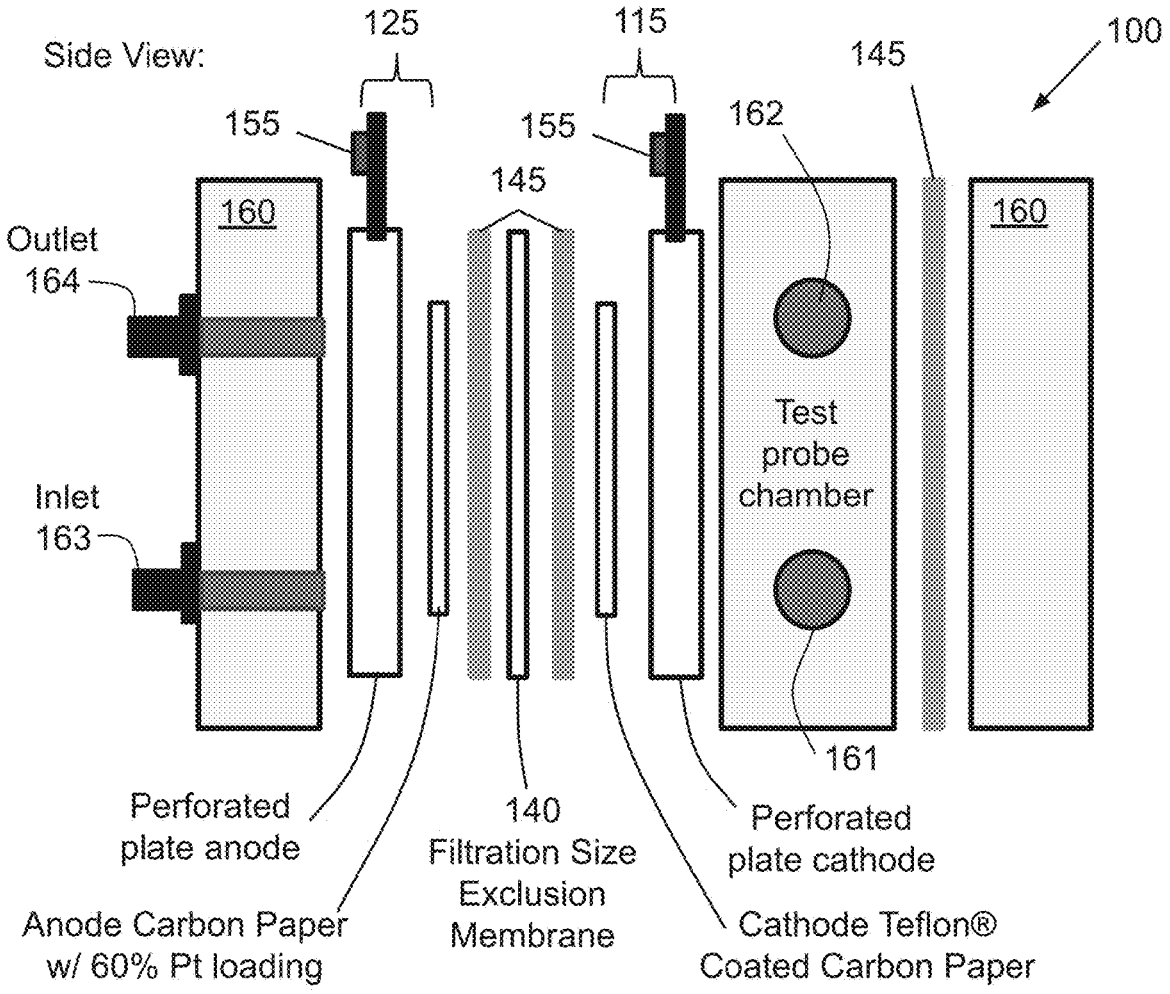
FIG. 40A shows a non-limiting schematic of the electrolysis cell that has been constructed and tested for the production of $H_2$ as described herein.
Figure 40A:
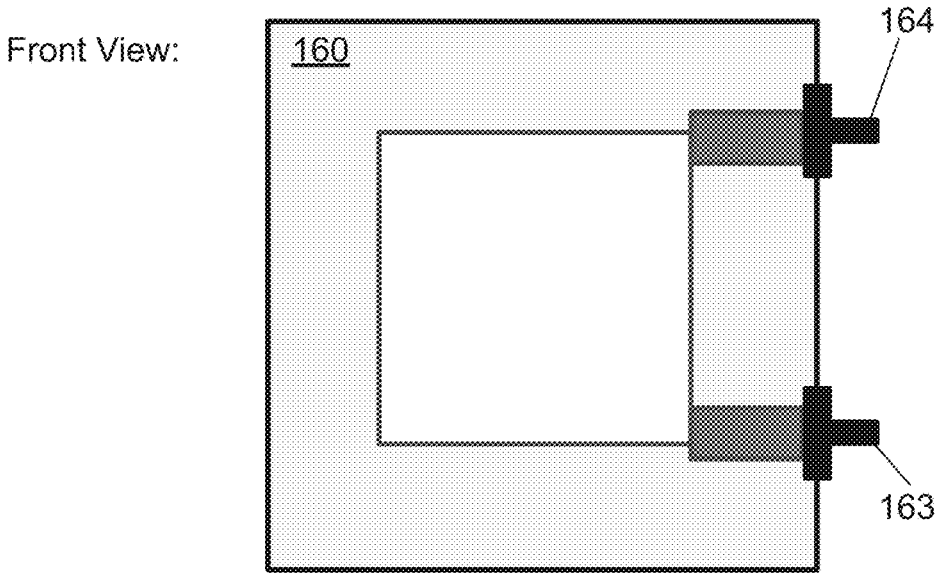
Figure 40B:
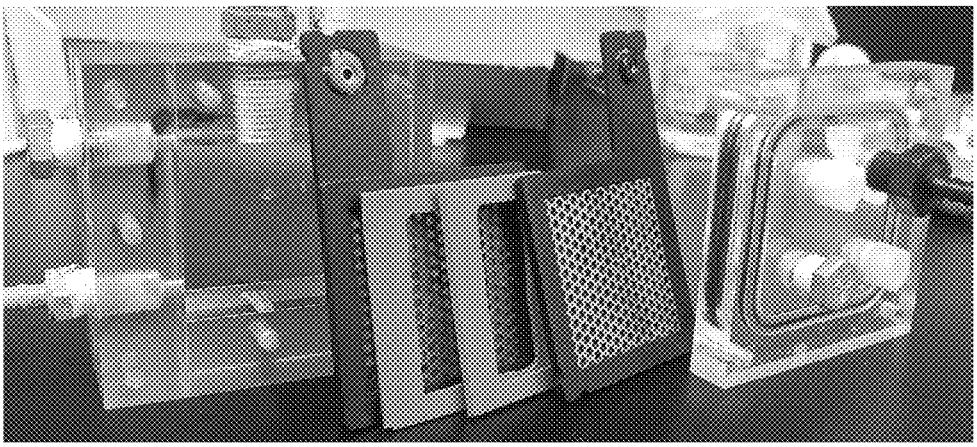
FIG. 40B is a photo showing an exploded view of the electrolysis cell.
Figure 40C:
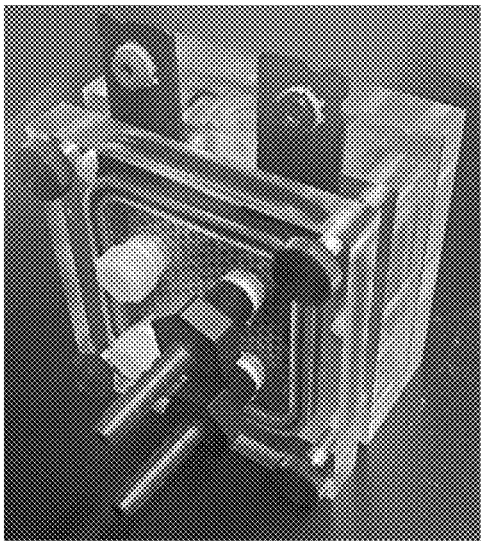
FIG. 40C shows the assembled electrolysis cell.

Referring to FIG. 40A-40C, the flow cell end plates (160) may be acrylic plexiglass to allow viewing of the inner cell while in operation. The endplates (160) sandwich the electrodes (115, 125) and membrane (140) with rubber gasket seals (145) between each layer. Slight tightening with hand screws is sufficient to seal the cell/electrolyzer (100). The gaskets (145) are made from silicon rubber (e.g., outer square: 5 cm×5 cm, inner square: 4 cm×3.5 cm). The electrodes (115, 125) may be made from carbon paper (e.g., Fuel Cell Store, 3 cm×4 cm) placed on conductive perforated plates (Fuel Cell Store; outer square: 5.3 cm×5.3 cm, inner square of conductive plate: 4 cm×4 cm). The counter electrode on the anode (oxidation) side has a 60% platinum loading. The membrane (140) is a size-exclusion filter paper (Snyder Filtration) and cut to fill the area between the perforated plates (5.3 cm×5.3 cm).

The electrolyte solution (e.g., the aqueous solution, 130 ) is composed of 1M TRIS in 18 Mohm water and corrected to pH 7 using HCl. The metallopolymer catalyst (117) is dissolved in the 1M TRIS solution used on the cathode side for $H_2$ generation at a concentration of 0.000005 M.

The flow cell (100) is set up so the solution containing the metallopolymer catalyst (117) circulates on the cathode side of the cell, while the anode side is set up using 1M TRIS solution without any metallopolymer catalyst. A simple submersible water pump (Mavel Star) is used to flow the solution (130) through the cell as it operates. The submersible water pump is operated at a rate of ~0.3 gallons per minute. The flow cell (100) is operated at standard temperature and pressure under normal atmosphere.

Figure 41A:
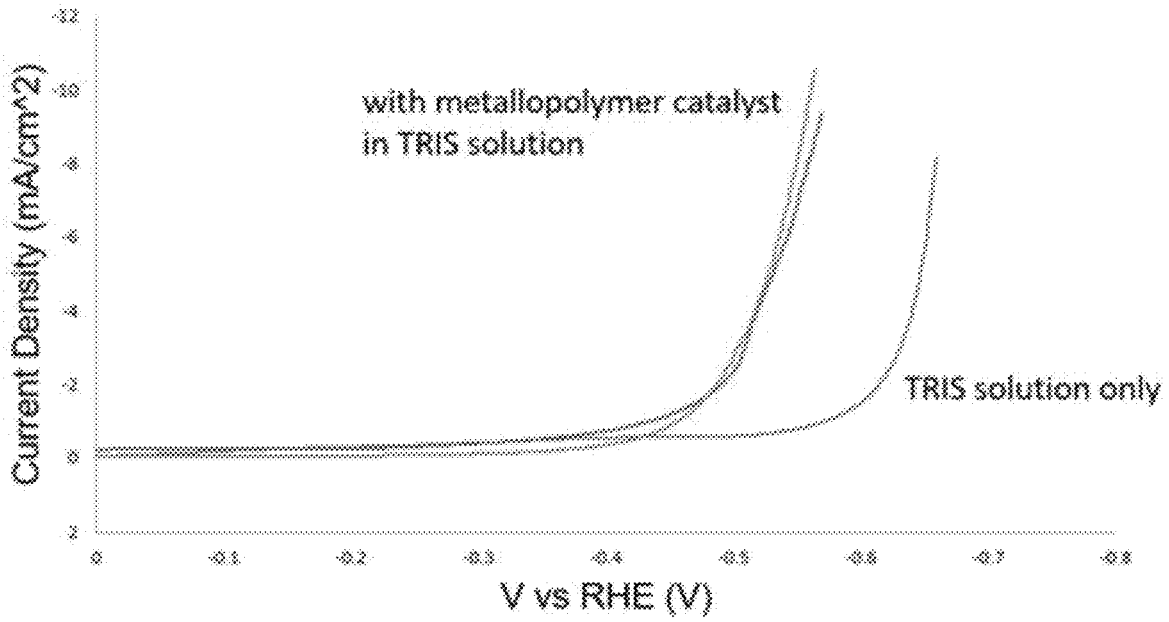
FIG. 41A shows the increasing current production of hydrogen at lower voltage with the metallopolymer present in the electrolysis cell.

Experiments were carried out with a Gamry Interface 1000B potentiostat to observe the potential (voltage) at which hydrogen production occurred and the current (hydrogen) produced once catalysis occurred (FIG. 41A).

Figure 41B:
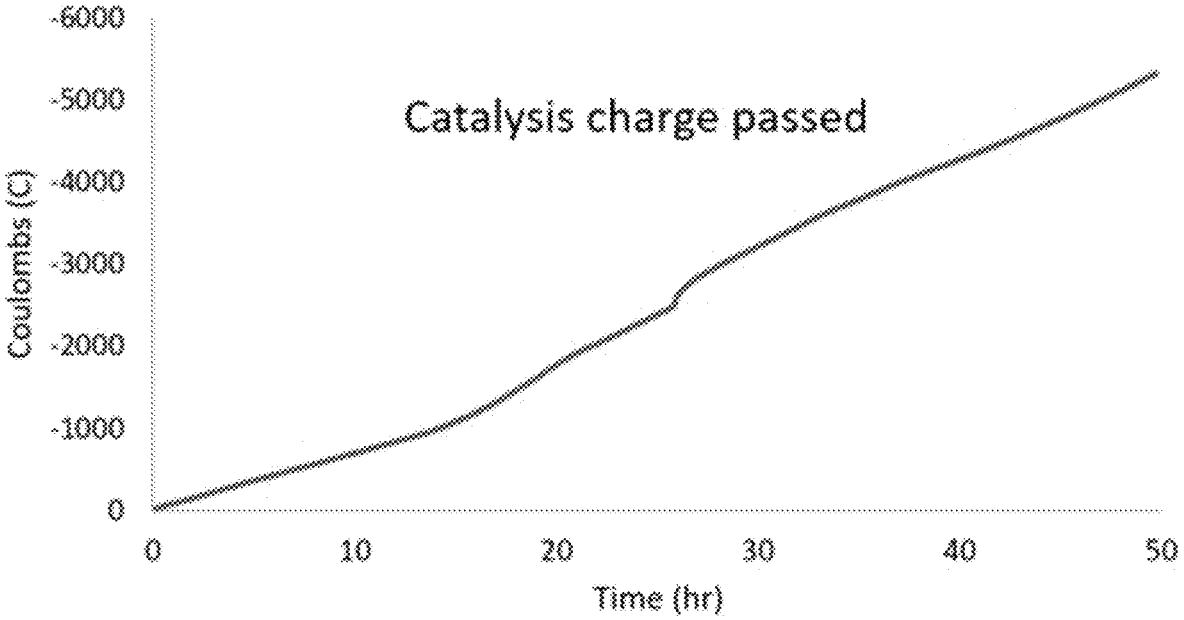
FIG. 41B shows the current of hydrogen production over 50 hours of continuous operation of the electrolysis cell.
Figure 42A:
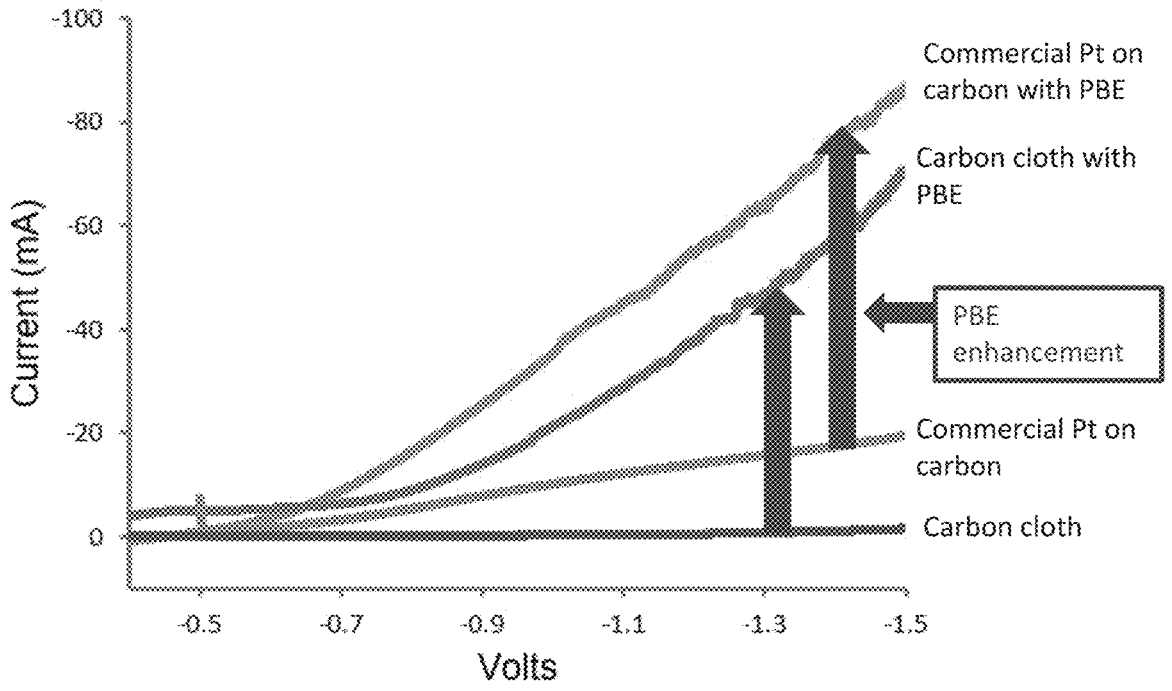
FIG. 42A shows that a protic buffer electrolyte (PBE; e.g., a co-catalyst) increases the rate without being consumed in the electrolysis cell.
Figure 42B:
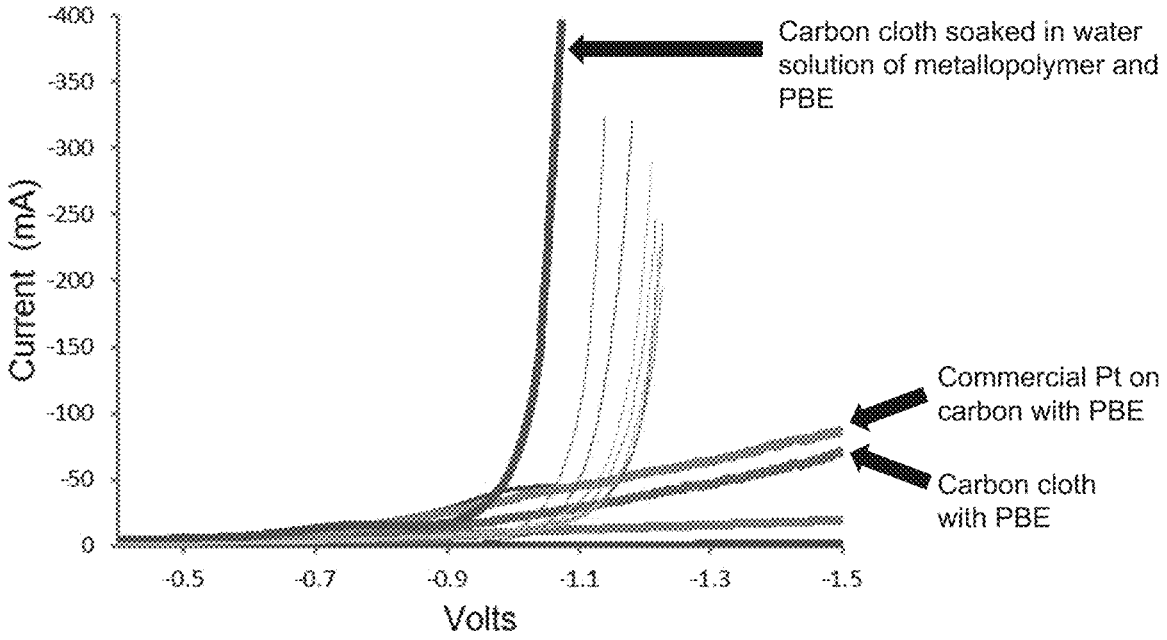
FIG. 42B shows that the addition of a metallopolymer catalyst, e.g., as described herein, greatly increases the rate compared to just using PBE in the electrolysis cell.

FIG. 41B shows the amount of catalytic charge passed over the first 50 hours of operation. The amount of charge per hour continues unabated at this stage, and indicates no loss of catalyst in this time. These experiments are ongoing. At 50 hours, each catalyst site has produced 41,000 molecules of hydrogen.

METALLOPOLYMER CATHODE EXAMPLES

The following are non-limiting examples of the present invention. It is to be understood that said examples are provided for the purpose of demonstrating the present invention in practice, and is in no way intended to limit the invention. Equivalents or substitutes are within the scope of the invention.

Metallopolymer Preparation

The preparation of an arbitrary size PDMAEMA-g-[2Fe-2S] metallopolymer C (Scheme 1, below) by ATRP starting from the [2Fe-2S] metalloinitiator molecule A, DMAEMA molecule B, and the Cu(I)Br/HMTETA catalyst is described above. In order to obtain different molecular weight metallopolymer samples, well-controlled ATRP polymerizations were carried out with different ratios of monomer to initiator. Kinetic studies of each ratio of monomer to initiator were completed before each sample was synthesized to determine the reaction time for the approximate desired molecular weight for each metallopolymer sample. After purification was completed, the resulting metallopolymer was further characterized by DOSY NMR, GPC, and IR to establish the size and molecular weight. The samples were stored under Ar at −20° C. The samples retained their catalytic activity for over 2 years even after repeated warming to room temperature and exposure to oxygen during sampling and experimentation.

Scheme 3

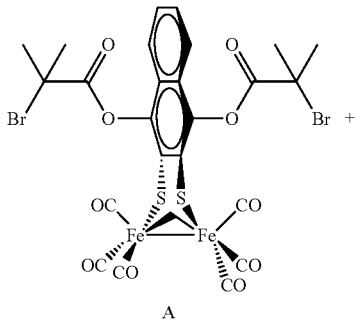

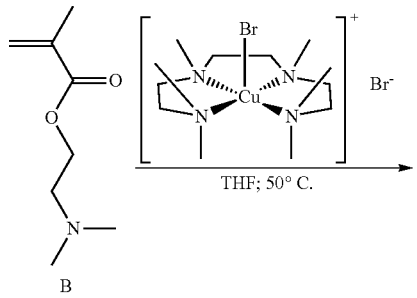

-continued

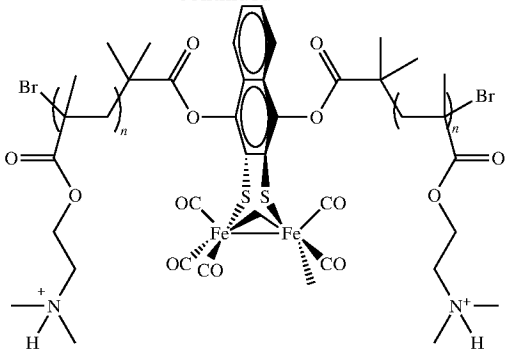

C

Example reaction conditions for polymer chain lengths n:

A:B = 1:50 1 hour n = 9
A:B = 1:100 ½ hour n = 36
A:B = 1:200 2 hour n = 112

Hydrodynamic Radii of the Metallopolymers.

The most important feature of the size of the metallopolymers in relation to these experiments is the geometric dimension of the metallopolymer rather than the molecular weight. Therefore, the metallopolymers discussed henceforth will be delineated based on the hydrodynamic radii. The hydrodynamic radii of the metallopolymers were estimated experimentally from the diffusion coefficients measured by 1H DOSY NMR and the Stokes-Einstein equation. The 1H DOSY NMR were performed in 1M TRIS-DCI in D2Oadjusted to a pH of 7.00±0.01 to have a metric of metallopolymer size in the same solution conditions that were employed for the electrocatalytic analysis. The 1H DOSY measurement gives reproducible diffusion coefficients with an uncertainty of approximately 1%. The Stokes-Einstein equation assumes that the object is spherical, however, PDMAEMA-g-[2Fe-25S] metallopolymers are likely not spherical. The ratio of equatorial (a) and axial (c) radii is less than three for these metallopolymer systems which corresponds to an over-approximation of the Stokes radii by ~10%.26 For this study, analyses of PDMAEMA-g-[2Fe-2S] metallopolymers with the approximate hydrodynamic radii of 18 Å, 28 Å, 42 Å and 64 Å.

Cyclic Voltammetry Comparison.

Figure 32:
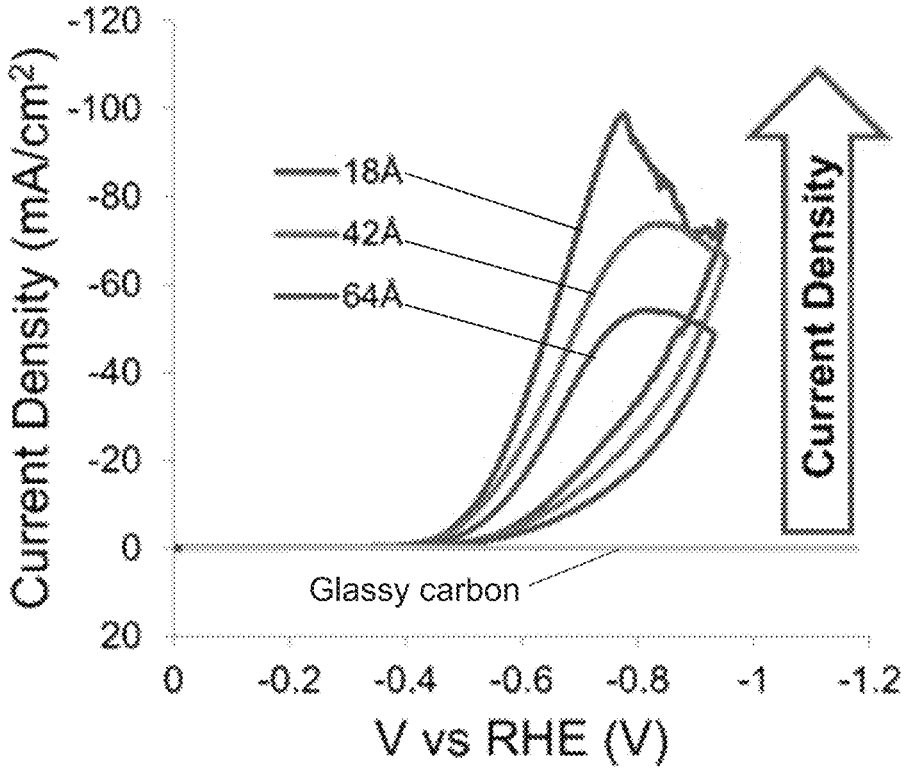
FIG. 32 shows a cyclic voltammetry comparison of PDMAEMA-g-[2Fe-2S] metallopolymers with hydrodynamic radii of 18 Å, 42 Å, 64 Å, and glassy carbon (grey) in 1 M TRIS adjusted to pH 7.00±0.01 aqueous solution. Experiments were conducted ata scan rate of 0.10 V/s.

The electrocatalytic production of hydrogen by PDMAEMA-g-[2Fe-2S] metallopolymers with different hydrodynamic radii were investigated by CV in neutral solution with 1 M TRIS used as a protic buffer electrolytel8 (FIG. 32). The $H_2$ generation by the PDMAEMA-g-[2Fe-2S] metallopolymers showed an increase in catalytic current density with decrease in hydrodynamic radii from 64 Å to 18 Å. The peak current density of the small metallopolymer was attenuated by rapid H2 bubble formation at the electrode and can be seen in the unusual CV profile as the scan proceeds through the peak. The average peak current densities of multiple CVs taken at 0.1 V/s for the 18 Å metallopolymer was −92±10 mA/cm2, −84±4 mA/cm2 for the 42 Å, and −62±11 mA/cm2 for the 64 Å. The standard deviations are a consequence of variations in surface conditions for adsorption and bubble formation from experiment to experiment.

Metallopolymer Concentration Dependence.

Figure 33:
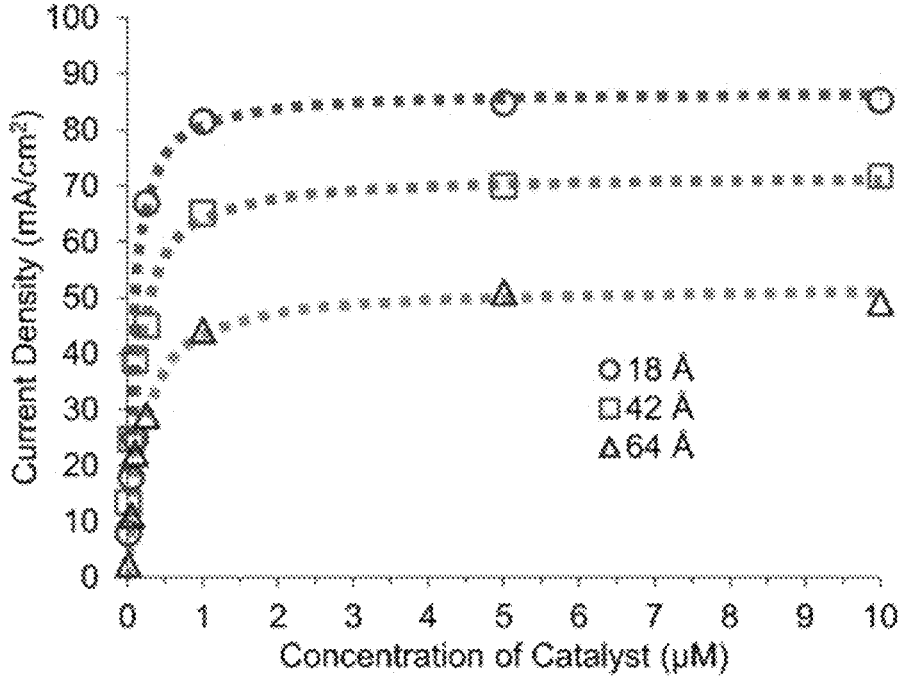
FIG. 33 shows current density versus concentration comparison for PDMAEMA-g-[2Fe-2S] metallopolymers with hydrodynamic radii of 18 Å (red circles), 42 Å (green squares), and 64 Å (blue triangles) in 1 M TRIS adjusted to pH 7.00±0.01. The dashed lines show fits of the adsorption isotherm with a Langmuir model. Experiments were performed with a glassy carbon electrode and a scan rate of 0.10 V/s.

FIG. 33 shows the dependence of current density on con-centration of the metallopolymers based on CVs taken at 0.10 V/s. The concentration dependence follows the form of a Langmuir adsorption isotherm. The plateau of the cur-rent density beginning around a concentration of 1 μM is due to formation of a monolayer of the metallopolymers on the surface. The dashed lines in FIG. 33 show fits of the adsorption isotherms using a standard Langmuir model. In the Langmuir adsorption model, the current density j is given by a maximum current density $j_{max}$ times the fraction of adsorption sites occupied (θ) by an electroactive molecule (A):

$$j = j_{max} x \theta = j_{max} x \frac{K_{ads}[A]}{1 + K_{ads}[A]} \quad \text{(Equation 1)}$$

where $K_{ads}$ is the equilibrium constant for adsorption characterized by the reaction:

$$A + S \leftrightarrows AS \quad \text{(Equation 2)}$$

In Equation 2, S is an empty surface site and AS is a site on the electrode occupied by A. The fits are generated by optimizing the two parameters $j_{max}$ and $K_{ads}$ of Equation 1 for a range of [A] values. The $j_{max}$ values increase from 52 mA/cm$^2$ for the 64 Å metallopolymer to 72 mA/cm$^2$ for the 42 Å metallopolymer to 87 mA/cm$^2$ for the 18 Å metallopolymer, indicative of an increasing number of electroactive species in a monolayer on the surface with decreasing size of the species. The equilibrium constants for adsorption ($K_{ads}$) used in the fits shown in FIG. 33 were $K_{ads}$=13 for the 18 Å, $K_{ads}$=8 for the 42 Å, and $K_{ads}$=5 for the 64 Å. The observed increase of $K_{ads}$ with the decrease of polymer size is consistent with less steric crowding and more avail-able adsorption sites for the smaller polymers per unit area.

The adsorption on the surface persists after completion of the electrochemical experiments and removal of the electrode from the solution. After removing and rinsing the electrode and then placing the electrode in a solution with the same electrolyte but not containing metallopolymer, the first CV scan shows the same catalytic peak with the current density reduced by 15-50%. The catalysis peak disappears on subsequent scans, consistent with the transient equilibrium nature of the adsorption indicated by the Langmuir isotherms.

Electrochemically Active Surface Coverage (ECSC).

Figure 34:
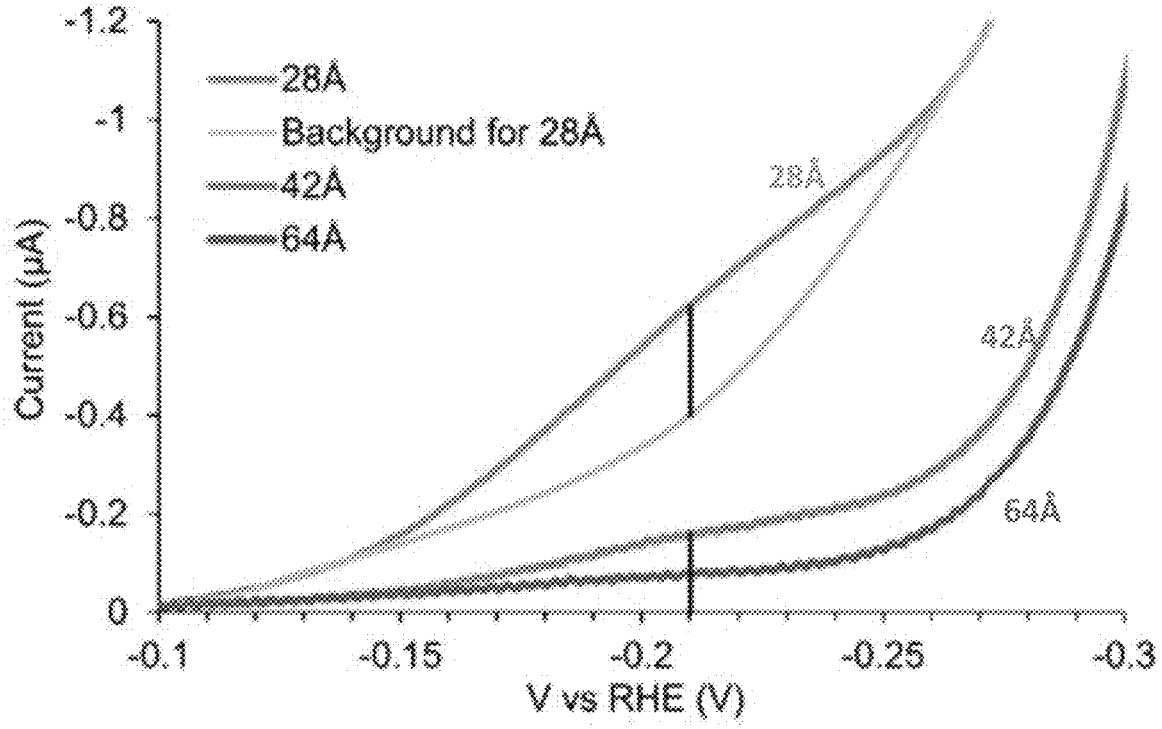
FIG. 34 shows CVs in 1.00 M TRIS adjusted to pH 8.00±0.01 of the initial reduction of the [2Fe-2S] active site with a concentration of 10 μM metallopolymer with hydrodynamic radii of 28 Å, 42 Å, and 64 Å PDMAEMA-g-[2Fe-2S] metallopolymer. The CVs are adjusted for a linear baseline. The gray trace shows the rise of catalytic current for the 28 Å sample. The peak currents of the pre-catalytic reduction were estimated at −0.21 V as shown by the black vertical lines.

The different sizes of the polymers as indicated by the hydrodynamic radii leads to different amounts of electroactive [2Fe-2S] catalyst adsorbed to the electrode. The electrochemically active surface coverage (ECSC, sites per square centimeter) for each metallopolymer size was evaluated using the current of the pre-catalytic reduction of the [2Fe-2S] active site (FIG. 34). To measure this pre-catalytic reduction, the CVs were performed in 1 M TRIS adjusted to pH 8.00±0.01. By changing to a higher pH solution, the thermodynamic potential of catalysis is shifted more negative allowing for the initial reduction of [2Fe-2S] to be observed before the catalytic peak. With observation of these pre-catalytic currents due to reduction of the active site, the ECSC can be estimated using Equation 3. The initial reduction currents were found to be −0.22 μA for the 28 Å, −0.16 μA for the 42 Å, and −0.08 μA for the 64 Å. The amount of electroactive [2Fe-2S] sites absorbed to the cathode was estimated to be $8.2\times10^{-12}$ mol/cm$^2$ for the 28 Å radius sample, $6.0\times10^{-12}$ mol/cm$^2$ for 42 Å, and $3.0\times10^{-12}$ mol/cm$^2$ for 64 Å. An overall increase in [2Fe-2S] catalysts ECSC trends with reducing the polymer size.

$$\Gamma_{echem} = \frac{i_{[2Fe-2S]}}{(n^2F^2/4RT)vA} \quad \text{(Equation 3)}$$

The concentration of nietailopOiymers in a monolayer on the surface can be estimated with a simple physical model based on the area of the surface occupied by the metallopolymer. The close-packed concentrations are very similar to the electrochemically active surface concentrations. This agreement indicates that the metallopolymers form reasonably close-packed arrangements on the surface and all of the adsorbed [2Fe-2S] sites are electrochemically active. This is an important finding in explaining the high activity of these metallopolymer electrocatalysts because it demonstrates an efficient and effective natural assembly of the metallopolymers and the [2Fe-2S] sites on the electrode surface Overpotential Differences Using Linear Sweep Voltammetry.

To illustrate the effect of polymer size on overpotential, linear sweep voltammetry was performed with a rotating disk electrode. Shown in FIG. 35, the onset of catalytic current occurs at approximately −0.45 V for all three metallopolymer sizes. This indicates that the electron transfer overpotential for onset of current is independent of polymer size, consistent with the similar proximity of the active sites to the electrode surface. The similarity of onset potential for catalysis also indicates that the thermodynamic and reaction overpotentials are similar. The overpotentials diverge when scanned to more negative potentials for higher current densities. Comparison of overpotentials at a current density of 10 mA/cm$^2$ is common in the literature (often referred to as $\eta_{10}$). The overpotential change between the large and small metallopolymers of 22 mV to reach a current density of 10 mA/cm$^2$ is attributed to a difference in concentration overpotential for the surface concentration of the catalyst. The larger metallopolymer has a larger concentration overpotential because of the smaller concentration of active sites on the surface. Consequently, the larger metallopolymer requires a more negative potential to reach the same current density as the smaller metallopolymer. The difference in concentration overpotential increases as the current density increases. A summary of the polymer sizes and electrochemical characteristics is given in Table 1.

TABLE 1

Summary of metallopolymer size and electrocatalytic characteristics.

| $M_{n,\ GPC}$ (g/mol) | $R_{hyd}$[a] (Å) | $^{J}$@0.10 V/s [b] (mA/cm2) | (V) |
|---|---|---|---|
| 3.5k | 18 | −92 ± 10 | −0.56 |
| 12.2k | 42 | −84 ± 4 | −0.57 |
| 24.3k | 64 | −62 ± 11 | −0.58 |

[a]$^1$H DOSY NMR was performed in 1M TRIS-DCl in $D_2O$ with a metallopolymer concentration of approximately 100 μM
[b] Cyclic voltammetry peak current density. The peak current density of the small metallopolymer was attenuated by rapid $H_2$ bubble formation at the electrode.
[c] Overpotential vs. RHE at current density of 10 mA/cm$^2$ was determined using LSV (scan rate of 5 mV/s) with a rotating disk electrode (2000 RPM).

Rate of Catalysis.

Figure 36:
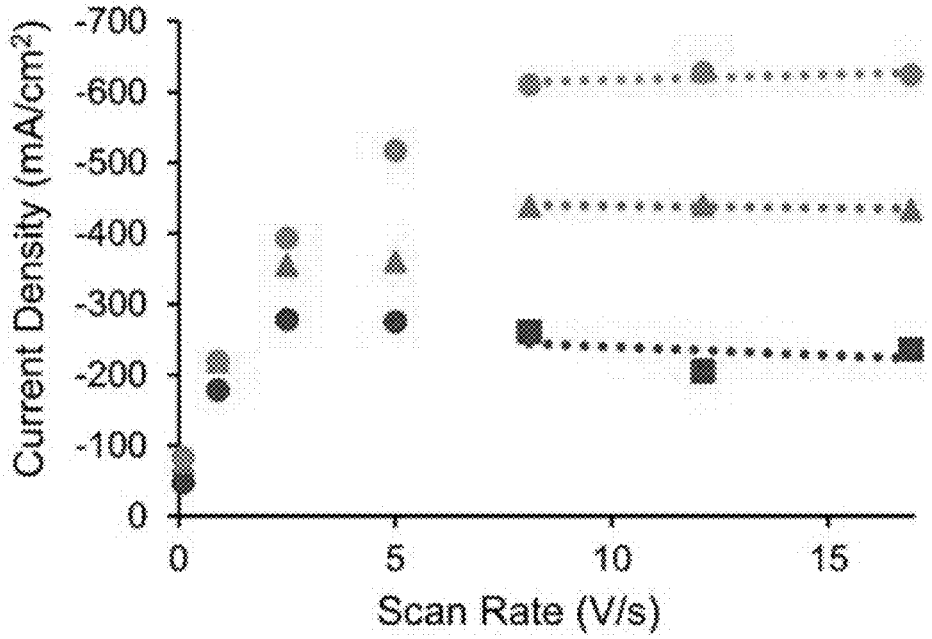
FIG. 36 shows dependence of current density on scan rate for PDMAEMA-g-[2Fe-2S] metallopolymers with hydrodynamic radii of 28 (orange circles), 42 (green triangles), and 64 Å (blue squares) in 1 M TRIS adjusted to pH 7.00±0.01.

Due to the fast rate for catalysis observed for the PDMAEMA-g-[2Fe-2S] metallopolymers, the proton source near the electrode is rapidly depleted during a CV performed at a scan rate of 0.1 V/s and bubble formation becomes problematic. Both factors are rate limiting. To diminish the effect of proton source depletion and bubble formation, CVs were taken with increasing scan rates to decrease the time scale of the experiment to the point where current density is no longer dependent on scan rate. As shown in FIG. 36, the catalytic current density becomes independent of the scan rates when the CVs are swept at a rate of 8.1 V/s and higher. The average current densities for the three measurements in the plateau region were found to be −621 mA/cm$^2$ for the 28 Å, −437 mA/cm$^2$ for the 42 Å, and −234 mA/cm $^2$ for the 64 Åmetallopolymer.

Catalytic Rates.

Using these plateau current densities ($J_{pl}$), in conjunction with the estimated surface coverage determined above, the catalytic rates of hydrogen molecule production per active site per second can be approximated. The per-active site rates (~±5%) were found to be $3.9\times10^5 s^{-1}$ for the 28 Å, $3.8\times10^5 s^{-1}$ for the 42 Å, and $4.1\times10^5\ s^{-1}$ for the 64 Å. The rates of hydrogen production per active site do not trend with polymer size indicating that the polymer corona is not inhibiting proton transfer to the [2Fe-2S] active site.

TABLE 2

Experimental polymer and electrocatalytic characteristics for plateau current and rate of active site.

| $M_{n,\ GPC}$ (g/mol) | $R_{hyd}$[a] (Å) | $J_{pl}$[b] (mA/cm$^2$) | $\Gamma_{echem}$ (mol/cm$^2$) | k[c] ($s^{-1}$) |
|---|---|---|---|---|
| 8.5k | 28 | −621 | $8.2 \times 10^{-12}$ | $3.9 \times 10^5$ |
| 12.2k | 42 | −437 | $6.0 \times 10^{-12}$ | $3.8 \times 10^5$ |
| 24.3k | 64 | −234 | $3.0 \times 10^{-12}$ | $4.1 \times 10^5$ |

[a]1H DOSY NMR was performed in 1M TRIS-DCl in D2O with a metallopolymer concentration of approximately 100 μM.
[b]Plateau current densities are an average of current densities from scan rates of 8.1, 12.1, and 16.9 V/s at −0.9 V vs RHE (see FIG. 36).
[c]Rate of hydrogen molecules produced per catalytic site per second at the plateau current.

Electrochemical Impedance Spectroscopy (EIS) to Compare Resistance to Electron Transfer in Catalysis.

Figure 35:
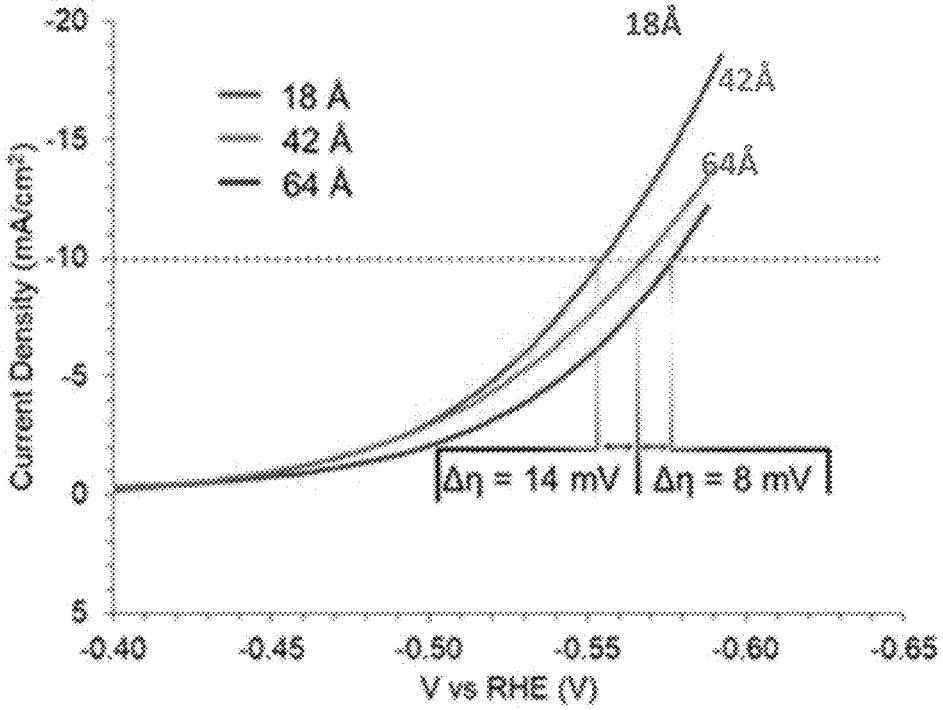
FIG. 35 shows linear sweep voltammograms of 10 μM PDMAEMA-g-[2Fe-2S] metallopolymers with hydrodynamic radii of 18 Å, 42 Å, and 64 Å using a rotating disk electrode at a rotation of 2000 RPM and scan rate of 5 mV/s. Overpotentials are indicated at current densities of 10 $mA/cm^2$ (grey dashed line) with change in overpotential ($\Delta\eta$) indicated.
Figure 37:
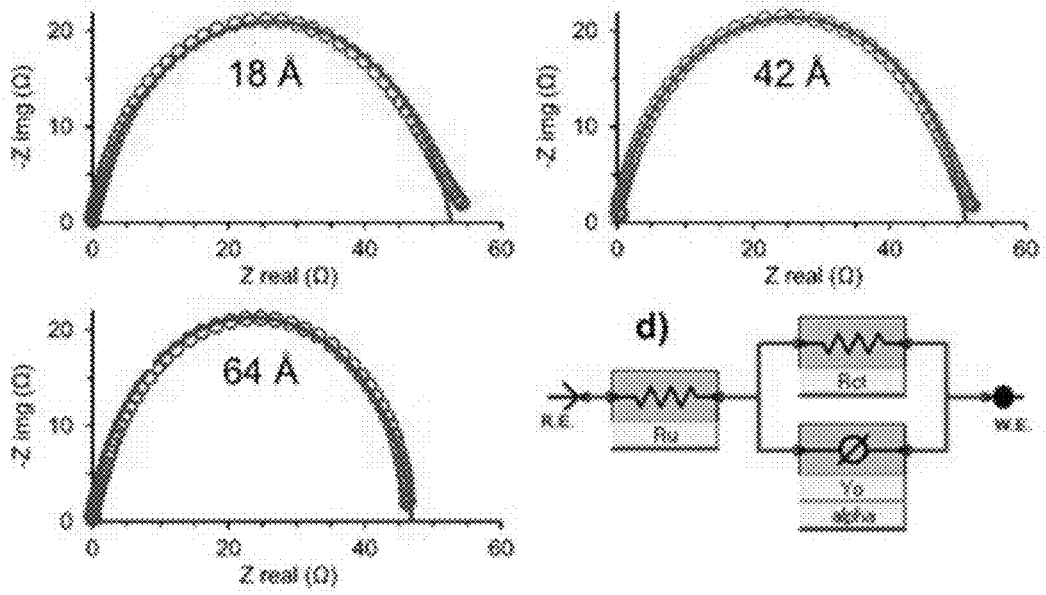
FIG. 37 shows EIS comparison of metallopolymers with hydrodynamic radii of 18 Å, 42 Å, and 64 Å. Experimental data are open circles and fits are solid lines. The equivalent circuit used for all fits is shown. The EIS data was collected using a RDE rotating at 2000 RPMs with 10 mV of alternating current ata holding potential of −0.59 V vs RHE.

Electrochemical impedance spectroscopy also shows that the performance of the catalytic site is not strongly dependent on the size of the metallopolymer. Nyquist plots from the EIS of three different-sized metallopolymers are shown in FIG. 37. The holding potential is in the region of catalysis slightly above 10 mA/cm$^2$ current density (FIG. 35). The Nyquist plots show that a single overall time-constant feature dominates catalysis. The EIS data does not show evidence of a Warburg impedance indicating that a diffusion-controlled process is not a significant factor. The simple standard equivalent circuit shown in FIG. 37 models the EIS data well. The circuit has a commonly used resistor/capacitor (RC) combination preceded by the uncompensated resistance (Ru) of the system. The capacitor of the RC circuit is a constant phase element typically used to account for the imperfect capacitance seen with an electrochemical double layer. The alpha value for capacitance is close to 0.9 in each case. The fits of the EIS Nyquist plots show only minor differences in the resistance to charge transfer with 53Ω for 18 Å, 51Ω for the 42 Å, and 47Ω for the 64 Åmetallopolymer. The differences are due primarily to small differences in low frequency impedance on the right of the Nyquist curves related to the adsorption of the metallopolymers. These differences are most clearly seen in the low-frequency region of the Bode plots. The smaller metallopolymers show evidence at low frequencies of a second high-resistance process that contributes a small amount to catalysis, and the largest metallopolymer shows evidence of an inductive component at low frequencies. Overall, the EIS data demonstrates that the electroactive [2Fe-2S] sites adsorbed to the surface have similar charge transfer resistances, meaning they have similar electron transfer rates and similar proton reduction rates. Increasing polymer size does not inhibit the rate of electron transfer in catalysis appreciably, indicating the [2Fe-2S] active sites are in similar contact with the electrode and solution.

Molecular Dynamics.

To further corroborate and provide additional insight into the metallopolymer-electrode surface conformational dynamics, an initial molecular dynamics (MD) modeling of the adsorption of the metallopolymer to the electrode surface was carried out. After dynamic sampling of the conformer structures of the 3.5 k molecular weight metallopolymer and annealing the structure, the metallopolymer was placed ~5 Å above a slightly negatively charged graphite surface (~0.0003 $e^-$ per carbon atom). With initiation of the dynamics, the protonated amines are drawn directly to the cathode surface by electrostatic forces after ~2 picoseconds. After ~10 picoseconds the protonated amines of the polymer arms on both sides of the active site are adsorbed to the surface. The polymer continues to spread and flatten against the surface and within less than 20 picoseconds this action pulls the active site into close contact with the surface. The retention of the active site close to the surface is conducive to fast electron transfer.

Looking down on the fully adsorbed species on the surface shows the protonated amines spread out to tether the metallopolymer to the surface. This view also shows that the sulfur atoms and one iron atom are exposed to solution. These are the sites proposed for protonation in catalytic schemes of proton reduction by hydrogenases and their mimics. In addition to the geometric accessibility of these sites, the two-electron reduced active site has a strong electrostatic attraction for protons and fast proton transfer. This positioning of the active site next to the surface will occur similarly for the longer polymers, so the electron transfer rates and proton reduction rates per active site will be similar as observed.

The molecular dynamics also show that the metallopolymer has little barrier to gliding over the surface, and thus the metallopolymers can adjust to a close-packing arrangement. The smaller metallopolymer has a greater current per unit area simply because it has more active sites per unit area in a close-packed arrangement. Finally, a second layer of metallopolymer does not have the benefit of the protonated amines interacting directly with the electrode surface, and in contrast has repulsive interactions with the protonated amines in the first monolayer. The Langmuir plots in FIG. 33 show that a second layer of metallopolymers is not favored at these concentrations, so the active sites are not covered and remain exposed to the solution As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

What is claimed is:

1. An electrolyzer (100) for generating hydrogen (H2) comprising:

a) a cathode (115) comprising an electrocatalytic metallopolymer (117) coupled to an electrically conductive material (118), wherein the metallopolymer (117) comprises an electrocatalytically active complex bonded to a polymer, wherein the metallopolymer (117) accepts electrons and generates $H_2$, wherein the metallopolymer (117) is according to the following;

Complex—$L_1$—$(Polymer)_i$, wherein i is 1 or 2, and wherein the electrocatalytically active complex contains the following [2Fe-2S] cluster:

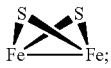

b) an anode (125); and c) an aqueous solution (130), wherein the cathode (115) and anode (125) are in contact with the aqueous solution (130).

2. The electrolyzer (100) of claim 1, wherein $L_1$ is bonded to the complex at the sulfur atoms.

3. The electrolyzer (100) of claim 1, wherein the polymer is according to the following:

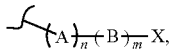

wherein X is I, Br or Cl, wherein m ranges from about 1-1,000, wherein n ranges from about 1-1,000, wherein A and B are each derived from an unsaturated monomer, and wherein A is identical to B or A is different from B, wherein the polymer imparts water solubility to the metallopolymer (117).

4. The electrolyzer (100) of claim 1, wherein the electrically conductive material (118) comprises a porous material comprised of carbon or metal.

5. The electrolyzer (100) of claim 1, wherein a pH of the aqueous medium is about 5 to 8.

6. The electrolyzer (100) of claim 1, wherein the aqueous medium comprises an electrolyte.

7. The electrolyzer (100) of claim 6, wherein the electrolyte comprises a protic co-catalyst, wherein the protic co-catalyst is in a majority protic state and is positively charged, wherein the protic co-catalyst increases the rate of $H_2$ generation without being consumed during the electrolysis process.

8. The electrolyzer (100) of claim 7, wherein the protic co-catalyst comprises a phosphate buffer, imidazole, taurine (AES), 2-amino-2-methyl-1-propanol (AMP), 2-amino-2-methyl-1,3-propanediol (AMPD), tris-(hydroxymethyl)-aminomethane (Tris), bis-(hydroxymethyl)aminomethane (Bis-Tris), or Bis-Tris-Propane (BTP).

9. The electrolyzer (100) of claim 1, further comprising a membrane (140) separating the cathode (115) from the anode (125).

10. The electrolyzer (100) of claim 9, wherein the membrane (140) comprises carbon paper, carbon cloth, carbon felt, filter paper, polymers, proton exchange membranes, glass, or cloth.

11. The electrolyzer (100) of claim 1, further comprising an energy source (150) electrically coupled to the cathode (115) and the anode (125) via electrode contacts (155).

12. The electrolyzer (100) of claim 11, wherein the energy source (150) is a renewable energy source, wherein the renewable energy source comprises a solar energy source, a wind energy source, a hydraulic energy source, or a combination thereof.

13. A method for producing a fuel or chemical utilizing the electrolyzer (100) of claim 1, the method comprising:

a) providing an electrolyzer (100);

b) flowing one or more solutions through the electrolyzer (100);

c) applying a voltage across the anode (125) and cathode (115) that causes a chemical reaction that produces a plurality of products, wherein the fuel or chemical is one of said products, wherein the electrocatalytic metallopolymer (117) increases a production rate of said fuel or chemical; and d) separating the fuel or chemical from the plurality of products; and e) collecting the fuel or chemical.

14. The method of claim 13, wherein the fuel or chemical is hydrogen ($H_2$).

15. The method of claim 14, wherein the method produces about 10L to about 100,000 L of hydrogen per hour per gram of metallopolymer at standard temperature and pressure.

16. The method of claim 14, wherein for every kilowatt of power supplied, the method operates with about 100-800 amps of hydrogen-producing current.

17. The method of claim 13, wherein the one or more solutions comprises an electrolyte, wherein the electrolyte comprises a protic co-catalyst, wherein the protic co-catalyst is in a majority protic state and is positively charged, wherein the protic co-catalyst increases the rate of fuel generation without being consumed during the electrolysis process.

* * * * *